US011697182B2

(12) United States Patent
Yagur et al.

(10) Patent No.: US 11,697,182 B2
(45) Date of Patent: Jul. 11, 2023

(54) METHOD AND APPARATUS FOR REMOVING STOCK MATERIAL FROM A SURFACE

(71) Applicant: DYNAMIC CONCRETE, LLC, Orlando, FL (US)

(72) Inventors: Ron Yagur, Lake Mary, FL (US); Patrick Pollitt, Orlando, FL (US)

(73) Assignee: DYNAMIC CONCRETE, LLC, Orlando, FL (US)

( * ) Notice: Subject to any disclaimer, the term of this patent is extended or adjusted under 35 U.S.C. 154(b) by 972 days.

(21) Appl. No.: 16/384,518

(22) Filed: Apr. 15, 2019

(65) Prior Publication Data

US 2019/0337111 A1 Nov. 7, 2019

Related U.S. Application Data

(63) Continuation-in-part of application No. 15/499,475, filed on Apr. 27, 2017, now Pat. No. 10,259,095.

(60) Provisional application No. 62/328,069, filed on Apr. 27, 2016.

(51) Int. Cl.
*B24B 7/18* (2006.01)
*B24B 41/047* (2006.01)

(52) U.S. Cl.
CPC ..... *B24B 7/186* (2013.01); *B24B 41/047* (2013.01)

(58) Field of Classification Search
CPC .. B24B 7/18; B24B 7/186; B24B 7/22; B24B 7/226; B24B 41/047; B24D 7/06; B24D 7/066; B24D 7/08
USPC ..... 451/353
See application file for complete search history.

(56) References Cited

U.S. PATENT DOCUMENTS

| | | | |
|---|---|---|---|
| 3,026,655 | A | 3/1962 | Osenberg |
| 3,124,911 | A | 3/1964 | Vinella |
| 3,169,262 | A | 2/1965 | Allen et al. |
| 3,701,221 | A | 10/1972 | Vinella |
| 3,934,377 | A | 1/1976 | Tertinek |
| 4,918,872 | A | 4/1990 | Sato |
| 5,054,245 | A | 10/1991 | Coty |
| 5,247,765 | A | 9/1993 | Quintana |
| 5,480,258 | A | 1/1996 | Allen |
| 5,567,503 | A | 10/1996 | Sexton |

(Continued)

FOREIGN PATENT DOCUMENTS

FR 1087078 A * 11/1953

OTHER PUBLICATIONS

FR-1087078-A—Machine Translation (Year: 1953).*

*Primary Examiner* — Lee D Wilson
*Assistant Examiner* — Alberto Saenz
(74) *Attorney, Agent, or Firm* — John L. DeAngelis; Wolter, Van Dyke, Davis, PLLC

(57) ABSTRACT

Tooling is provided for mounting to a tooling plate to remove stock material from a surface based on rotation of the tooling plate about an axis. The tooling includes a backing plate and a plurality of segments. Each segment includes a bond and diamonds. The plurality of segments are secured to the backing plate such that a spacing is provided between the plurality of segments in a circumferential direction defined by an arc from a first side to a second side of the backing plate and/or a radial direction orthogonal to the circumferential direction. A method is also provided for removing stock material from a surface using the tooling.

20 Claims, 40 Drawing Sheets

(56) References Cited

U.S. PATENT DOCUMENTS 5,605,493 A * 2/1997 Donatelli ..... A47L 11/4061 451/550
5,890,833 A 4/1999 Allen
5,911,620 A 6/1999 Spangenberg
6,299,522 B1 10/2001 Lee
6,494,773 B1 12/2002 Marchini
6,786,556 B2 9/2004 Due
6,814,657 B2 11/2004 Spangenberg
7,004,823 B2 * 2/2006 Kisboll ..... B24B 37/26 451/529
7,104,739 B2 9/2006 Lagler
7,137,876 B2 11/2006 Immordino, Jr. et al.
7,247,085 B1 7/2007 Anderson
7,563,156 B2 7/2009 Anderson
7,775,741 B2 8/2010 Copoulos
8,105,134 B2 * 1/2012 Palushaj ..... A46D 1/00 451/490
8,172,649 B2 5/2012 Mann, Jr
8,282,445 B2 10/2012 Goldberg et al.
8,464,420 B2 6/2013 Ye
8,684,796 B2 4/2014 McCutchen
8,839,479 B2 9/2014 Hruby
8,888,564 B1 11/2014 Wood
9,145,650 B2 9/2015 Leblanc
9,862,067 B2 1/2018 Winterfjord et al.
2005/0124270 A1 6/2005 Palushi et al.
2009/0283089 A1 * 11/2009 Sung ..... C22C 26/00 51/309
2011/0300784 A1 * 12/2011 Tchakarov ..... B24D 7/066 451/259
2012/0270483 A1 * 10/2012 Bae ..... B24D 7/066 451/540
2013/0189908 A1 7/2013 Strickland
2013/0331015 A1 * 12/2013 Kimoto ..... B24D 7/06 451/548
2014/0227949 A1 8/2014 Popov et al.
2015/0196183 A1 7/2015 Clark et al.
2016/0031061 A1 2/2016 Truong

* cited by examiner

METHOD AND APPARATUS FOR REMOVING STOCK MATERIAL FROM A SURFACE

CROSS-REFERENCE TO RELATED APPLICATIONS

This application is a Continuation-In-Part application that claims priority to U.S. Provisional Application No. 62/328,069, filed Apr. 27, 2016, and further claims priority to U.S. application Ser. No. 15/499,475, filed Apr. 27, 2017, the entire contents of both are hereby incorporated by reference as if fully set forth herein, under 35 U.S.C. § 120.

BACKGROUND

Concrete grinding refers to a method that uses a machine equipped with metal bond diamonds for grinding the concrete floor, beginning with a lower grit diamond and working toward higher grit diamond to smooth and tighten the concrete floor.

Concrete polishing continues from the last highest grit metal bond diamond that was used and involves tooling made from resin bond diamonds. The difference between metal and resin bond tooling is that the diamonds in the metal bond are held together in a matrix composed of an assortment of metal elements such as copper, tin, iron, etc. and diamonds in the resin bond are held together in a matrix composed of resin material. Concrete polishing is a process by which the floor is honed from a low grit to as high a grit as desired to produce an extremely smooth floor that if so desired can shine like a mirror as higher resin diamond grits are used.

The burnishing process utilizes burnishing pads that for the most part help remove wax or other similar chemicals from a floor using a stripping pad or similar pad and in turn reapply the wax or other chemicals using a variety of burnishing pads, by melting the material into the floor using a burnishing pad that rotates at high speed thereby creating heat and melting and driving the material into the tiny pores of the concrete floor. Burnishing pads are also available with various diamond grits impregnated into the pad which at times can remove some of the resin bond diamond polishing process or bring back to life a polished concrete floor that has lost its shine.

SUMMARY

FIG. 10 is an image that illustrates an example of a front view of conventional tooling 1000 for a diamond tooling plate. The conventional tooling 1000 includes a pair of round segments 1002*a*, 1002*b* that are mounted to a backing plate 1001. The inventor of the present invention noted several drawbacks of such conventional tooling. For example, the inventor recognized that since the tooling 1000 rotates in a circumferential direction 1004 when mounted to the tooling plate, the shape and spacing of the segments 1002*a*, 1002*b* is not optimized to sweep away remove stock material. Thus, the inventor recognized that an improved tooling could be developed where the tooling segments are spaced apart in the circumferential direction 1004, so that subsequent circumferentially-spaced tooling segments could sweep away removed stock material in the circumferential direction. Additionally, the inventor recognized that the improved tooling would advantageously provide a radial gap based on the circumferential spacing between the segments in the direction 1004, which would provide an efficient means for sweeping away removed stock material due to radial centrifugal forces during the use of the tooling along the surface.

In a first set of embodiments, tooling is provided for mounting to a tooling plate to remove stock material from a surface based on rotation of the tooling plate about an axis. The tooling a backing plate and a plurality of segments, where each segment includes a bond and diamonds. The plurality of segments are secured to the backing plate such that a spacing is provided between the plurality of segments in a circumferential direction defined by an arc from a first side to a second side of the backing plate and/or a radial direction orthogonal to the circumferential direction.

In a second set of embodiments, a method is provided for removing stock material from a surface. The method includes assessing the stock material and the surface to determine optimal tooling for removing the stock material from the surface. The method also includes mounting tooling to a tooling plate based on the assessing step. The method also includes rotating the tooling plate about an axis. The method also includes moving the tooling plate over the surface to remove the stock material.

Still other aspects, features, and advantages are readily apparent from the following detailed description, simply by illustrating a number of particular embodiments and implementations, including the best mode contemplated for carrying out the invention. Other embodiments are also capable of other and different features and advantages, and its several details can be modified in various obvious respects, all without departing from the spirit and scope of the invention. Accordingly, the drawings and description are to be regarded as illustrative in nature, and not as restrictive.

BRIEF DESCRIPTION OF THE DRAWINGS

Embodiments are illustrated by way of example, and not by way of limitation, in the figures of the accompanying drawings in which like reference numerals refer to similar elements and in which.

DETAILED DESCRIPTION

Concrete grinders are available as hand tools or large machines mounted on a moveable frame that is wheeled over the surface of the concrete. The grinder can be used on most any concrete surface from a countertop to a large building floor.

Concrete grinders use an abrasive spinning wheel to grind or polish with an abrasive surface of diamond. The use of diamond tooling is the most common type of abrasive used under concrete grinders and it is available in different grits values that range from a 6 grit to the high thousands. The higher range grits are typically used for honing and polishing the concrete surface, as described above.

Concrete is usually ground dry for convenience although a filter-equipped vacuum is needed to capture the fine dust produced. Concrete can also be ground wet in which case no vacuum is used but the clean-up is more difficult.

Grinding machines are usually powered from a single or three-phase supply depending on the availability of power source at the job and/or the country where the work is being done. A variable speed grinding machine motor is an advantageous feature that allows for varying the grinding speed to keep the tooling in contact with the floor.

Figure 1A:
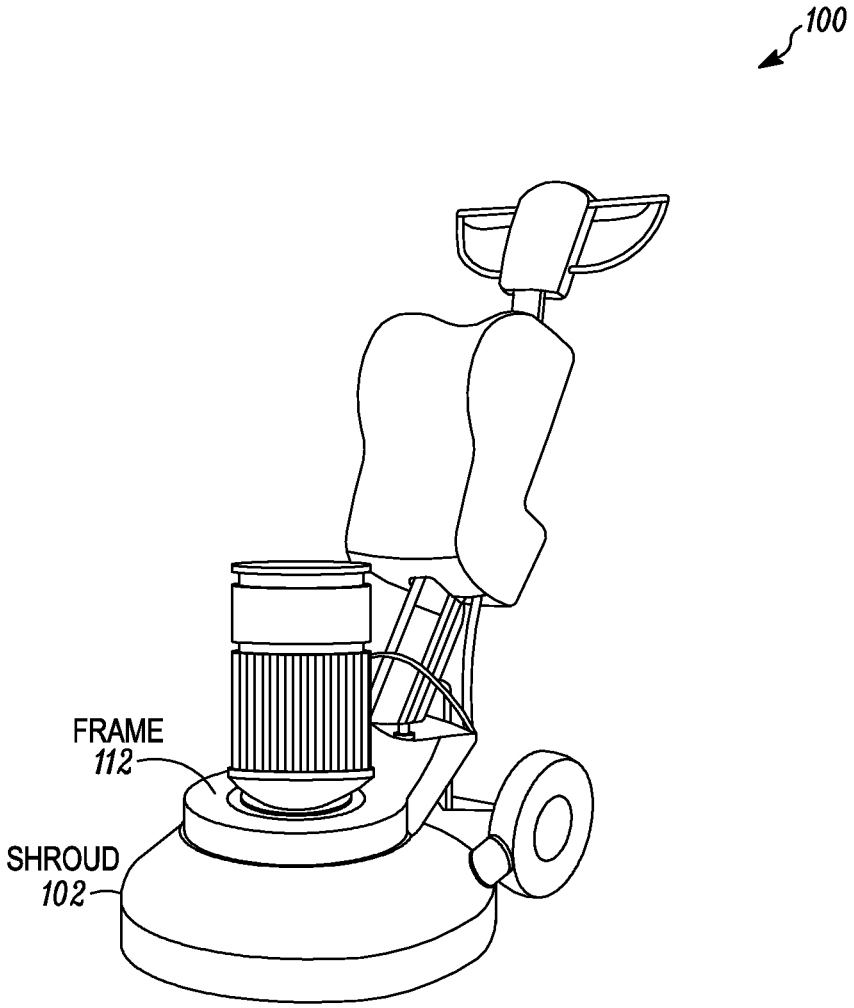
FIG. 1A (PRIOR ART)
FIG. 1A is an image that illustrates an example of a conventional concrete grinder.
Figure 1B:
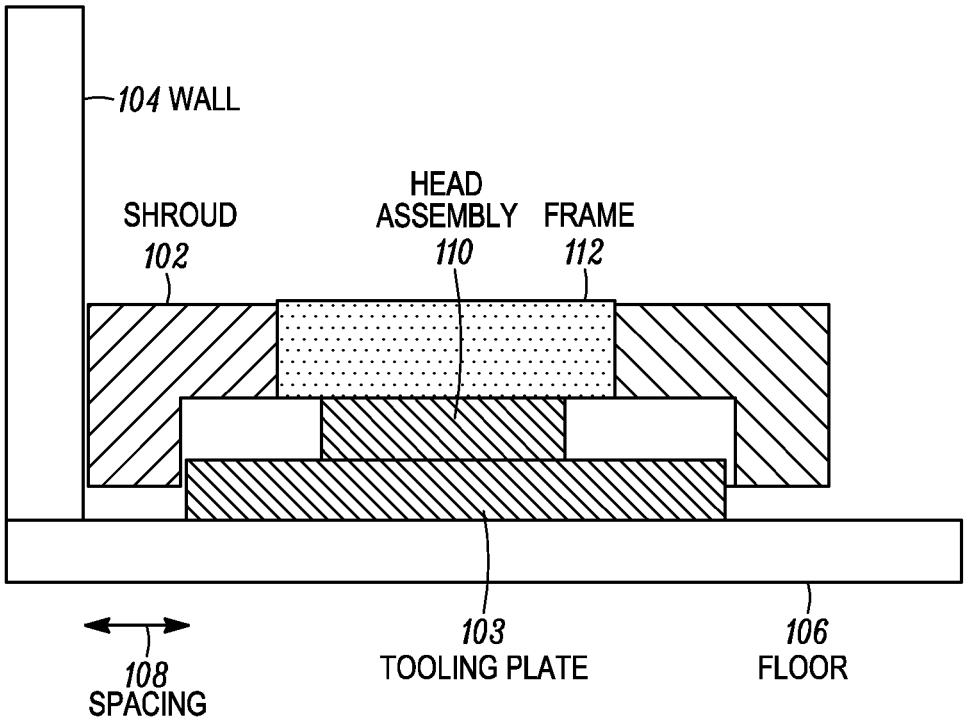
FIG. 1B (PRIOR ART)
FIG. 1B is a block diagram that illustrates an example of a cross-sectional view of the conventional concrete grinder of FIG. 1A at an intersection of a wall and floor surface.

FIG. 1A is an image that illustrates an example of a conventional concrete grinder 100 including a motor mounted on a frame 112 and a shroud 102. FIG. 1B is a block diagram that illustrates an example of a cross-sectional view of the conventional concrete grinder 110 of FIG. 1A at an intersection of a wall 104 and floor 106 surface. The concrete grinder 110 includes a tooling plate 103 that is rotatably mounted to a head assembly 110 that in-turn is mounted to the frame 112. In one embodiment, the tooling plate 103 is a diamond tooling plate. As depicted in FIG. 1B, the tooling plate 103 of the conventional concrete grinder 110 cannot get within a minimum spacing 108 of the wall 104 surface and thus the conventional concrete grinder 110 cannot grind concrete over the minimum spacing 108. This is because the tooling plate 103 and head assembly 110 cannot be moved relative to the frame 112 and instead are operated in a fixed position relative to the frame 112. As a result of this, a hand grinder must be used to grind concrete within the minimum spacing 108.

It is here recognized that conventional concrete grinders 100 have several drawbacks. As previously discussed, conventional concrete grinders 100 are limited as they cannot grind a concrete surface within a minimum spacing 108 of a wall 104. Consequently, hand grinders must be used to grind concrete over the minimum spacing 108. The inventors of the present invention recognized that this introduces two notable drawbacks. First, hand grinding is labor intensive and thus increases the time and cost of performing a project. Second, hand grinding is visually distinctive from machine grinding and thus there is no blending between the grinded concrete in the minimum spacing 108 (hand grinded) and the grinded concrete outside the minimum spacing 108 (machine grinded). Instead, obvious visual boundaries between the hand grinding in the minimum spacing 108 and machine grinding outside the minimum spacing 108 can be seen.

The inventors of the present invention developed an apparatus that overcomes these noted drawback of conventional concrete grinders. In one embodiment, the apparatus is a grinding machine where the head assembly and tooling plate can be displaced in a direction orthogonal to the rotational axis of the tooling plate. In one embodiment, the head assembly and tooling plate can be displaced in a direction orthogonal to the rotational axis of the tooling plate, so that the tooling plate can grind concrete right up to the wall surface. In other embodiments, the apparatus includes a head assembly and tooling plate that is positioned (e.g. the head assembly and tooling plate need not be adjustable in the direction orthogonal to the rotational axis of the tooling plate) such that the tooling plate can grind concrete right up to the wall surface. This advantageously saves costs during a project, as it eliminates the necessity of hand grinding over the minimum spacing 108. Additionally, this advantageously improves the visual blending of the grinding over the floor surface all the way to the wall surface.

Notwithstanding that the numerical ranges and parameters setting forth the broad scope are approximations, the numerical values set forth in specific non-limiting examples are reported as precisely as possible. Any numerical value, however, inherently contains certain errors necessarily resulting from the standard deviation found in their respective testing measurements at the time of this writing. Furthermore, unless otherwise clear from the context, a numerical value presented herein has an implied precision given by the least significant digit. Thus a value 1.1 implies a value from 1.05 to 1.15. The term "about" is used to indicate a broader range centered on the given value, and unless otherwise clear from the context implies a broader range around the least significant digit, such as "about 1.1" implies a range from 1.0 to 1.2. If the least significant digit is unclear, then the term "about" implies a factor of two, e.g., "about X" implies a value in the range from 0.5× to 2×, for example, about 100 implies a value in a range from 50 to 200. Moreover, all ranges disclosed herein are to be understood to encompass any and all sub-ranges subsumed therein. For example, a range of "less than 10" can include any and all sub-ranges between (and including) the minimum value of zero and the maximum value of 10, that is, any and all sub-ranges having a minimum value of equal to or greater than zero and a maximum value of equal to or less than 10, e.g., 1 to 4.

Some embodiments of the invention are described below in the context of treating a floor surface. In other embodiments, the invention is described in the context of concrete grinding. In still other embodiments, the invention is described in the context of concrete polishing. In still other embodiments, the invention is described in the context of burnishing. Other embodiments of the invention are described below in the context of scrubbing any surface, sanding wood, screening any surface, scarifying, bush hammers and carbide slicers.

As used herein the term "orthogonal" refers to about 90±20 degrees. In some embodiments, the term "orthogonal" refers to about 90±10 degrees. In other embodiments, the term "orthogonal" refers to about 90±5 degrees.

As used herein the term "treat" or "treating" a floor surface refers to any of concrete grinding, concrete polishing, burnishing or brushing the floor surface. As used herein, the term "tooling plate" refers to any of a metal bond diamond tooling plate, a resin bond diamond tooling plate, a burnishing pad, a quick change plate and a scrub brush.

As used herein the term "stock material" refers to any material that is sought to be removed or grinded off a surface. In one embodiment, stock material can include one or more of coating, mastic, glue, thin-set, concrete, paint, epoxy, urethane. As used herein, the term "bond" refers to a unique mixture of minerals or elements (e.g. cobalt, copper, nickel, etc.) mixed and matched in specific ratios to adhere diamonds together and configured for use in diamond tooling to remove stock material from a surface (e.g. hard concrete, soft concrete, etc.). As used herein, "soft bond" means a bond with a unique mixture of minerals or elements that is configured to be used to remove relatively hard or non-aggressive stock material (e.g. hard concrete) from a surface. As used herein, a "hard bond" means a bond with a unique mixture of minerals or elements that is configured to be used to remove relatively soft or aggressive stock material (e.g. soft concrete) from a surface. As used herein, the term "grit size" refers to a range of diamond size corresponding to a size of a mesh through which the diamonds are screened or filtered. In an example, "30/40 grit size" represents diamonds with a range between 30 grit and 40 grit, based on diamonds being screened or filtered through a 30/40 size mesh.

1. Overview

Figure 2A:
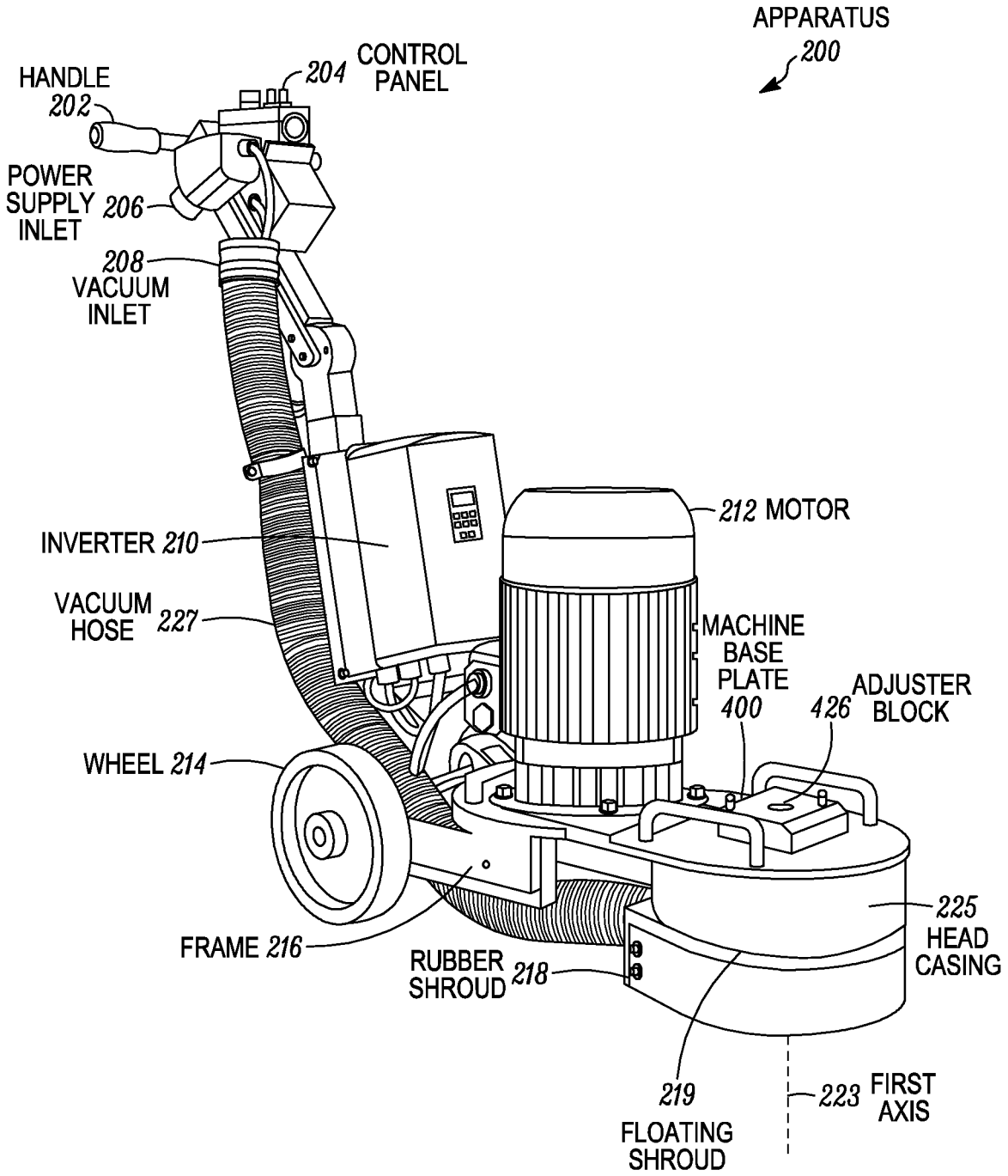
FIG. 2A is an image that illustrates an example of a perspective view of an apparatus for treating a floor surface, according to an embodiment.

FIG. 2A is an image that illustrates an example of a perspective view of an apparatus 200 for treating a floor surface, according to an embodiment. In one embodiment, the apparatus 200 is an all-in-one grinder, polisher, burnisher and zero-tolerance edger. In other embodiments, the apparatus 200 is used to perform one or more of grinding, polishing, burnishing and zero-tolerance edging. In an example embodiment, values of one or more parameters of the apparatus 200 are about the same as the values depicted in Table 1 below:

TABLE 1

| | |
|---|---|
| Model | DDG 1220 |
| Grinding Diameter | 292 mm (11.5")/490 mm (19.25") |
| Grinding Plate Diameter | 280 mm (11")/476 (18.75") |
| Grinding Plate Speed | 575-1800 RPM |
| Weight | 159 Kg (350 lbs) |

However, parameter values of the apparatus 200 are not limited to the values listed in Table 1 and include different values for the listed parameters and/or values for different parameters not listed in Table 1. In other embodiments, a length of the apparatus 200 is about 62 inches, a width of the apparatus 200 is about 18 inches and a height of the apparatus 200 is about 47 inches.

In one embodiment, the apparatus 200 includes a frame 216 and a pair of wheels 214 mounted to the frame 216. Additionally, the apparatus 200 includes a motor 212 mounted to the frame 216. In one embodiment, the motor 212 is a variable speed single head grinder with flex head technology powered by Dual Phase (e.g. Single or 3-Phase) or a dedicated 3-Phase motor (e.g. 230 Volt~480 Volt, 7.5 Horsepower 3-phase motor). In an example embodiment, values of one or more parameters of the motor 212 are about the same as the values depicted in Table 2 below:

TABLE 2

| | | | | |
|---|---|---|---|---|
| Model | DDG1220W230 | DDG1220W480 | DDG1220W380 | DDG1220D230 |
| Power Supply | 230 V/3 Phase | 440 V/3 Phase | 400 V/3 Phase | 220 V 10 |
| Voltage | 208-240 V | 420-480 V | 380-410 V | 220 V |
| Current | 17.9 A | 8.97 A | 10.5 A | 50 A |
| Frequency | 60 Hz | 60 Hz | 50 HZ | 60 Hz |
| Motor | 5.5 kW (7.5 hp) | 5.5 kW (7.5 hp) | 5.5 kW (7.5 hp) | 5.5 kW (7.5 hp) |

However, parameter values of the motor 212 are not limited to the values listed in Table 2 and include different values for the listed parameters and/or values for different parameters not listed in Table 1. A power supply inlet 206 is connected to an appropriate power supply, based on one or more of the above parameters of the motor 212. In other embodiments, instead of an electrical power source, the motor 212 is powered with a gasoline source (e.g. propane tank) that is mounted to the frame 216. An inverter 210 is also provided between the power supply inlet 206 and the motor 212.

In some embodiments, the apparatus 200 includes a handle 202 to push the apparatus 200 over a floor surface and a control panel 204 to vary one or more operating parameters of the apparatus 200. In one embodiment, the control panel 204 includes a first control to select a rotation direction (e.g. left or right) of the bottom plate 226, a second control to select a rotation speed of the bottom plate 226, a third control to start the apparatus 200 and a fourth control to stop the apparatus 200. In an example embodiment, less or more than these controls are provided in the control panel 204.

Figure 2B:
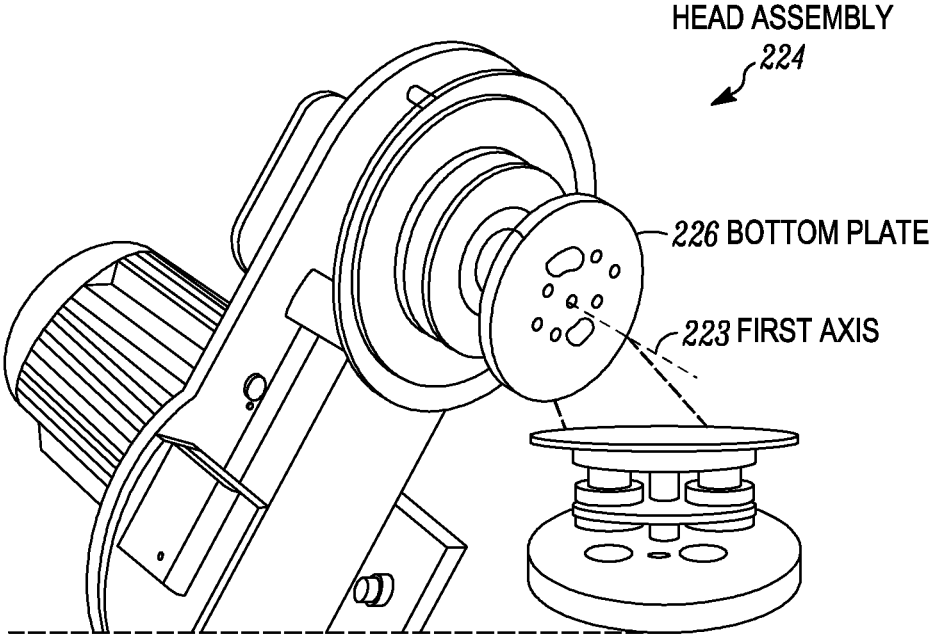
FIG. 2B is an image that illustrates an example of a perspective view of a head assembly of the apparatus of FIG. 2A, according to an embodiment.
Figure 2C:
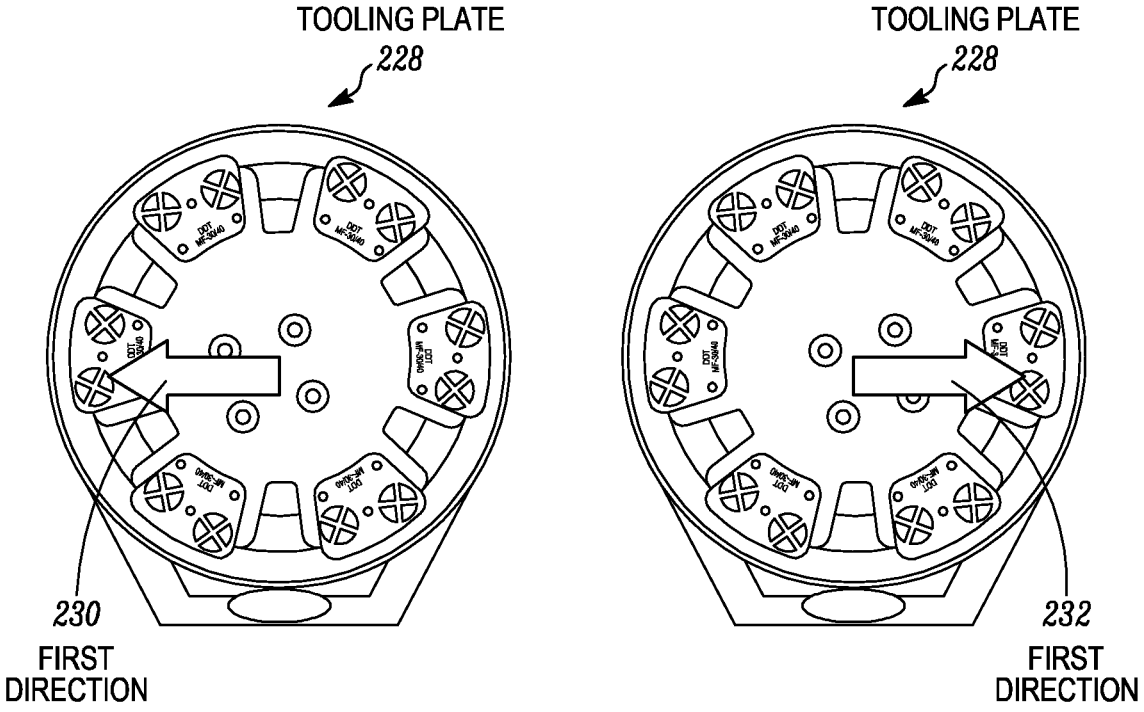
FIG. 2C is an image that illustrates an example of a bottom view of a tooling plate mounted on the bottom plate of FIG. 2B, according to an embodiment.
Figure 2D:
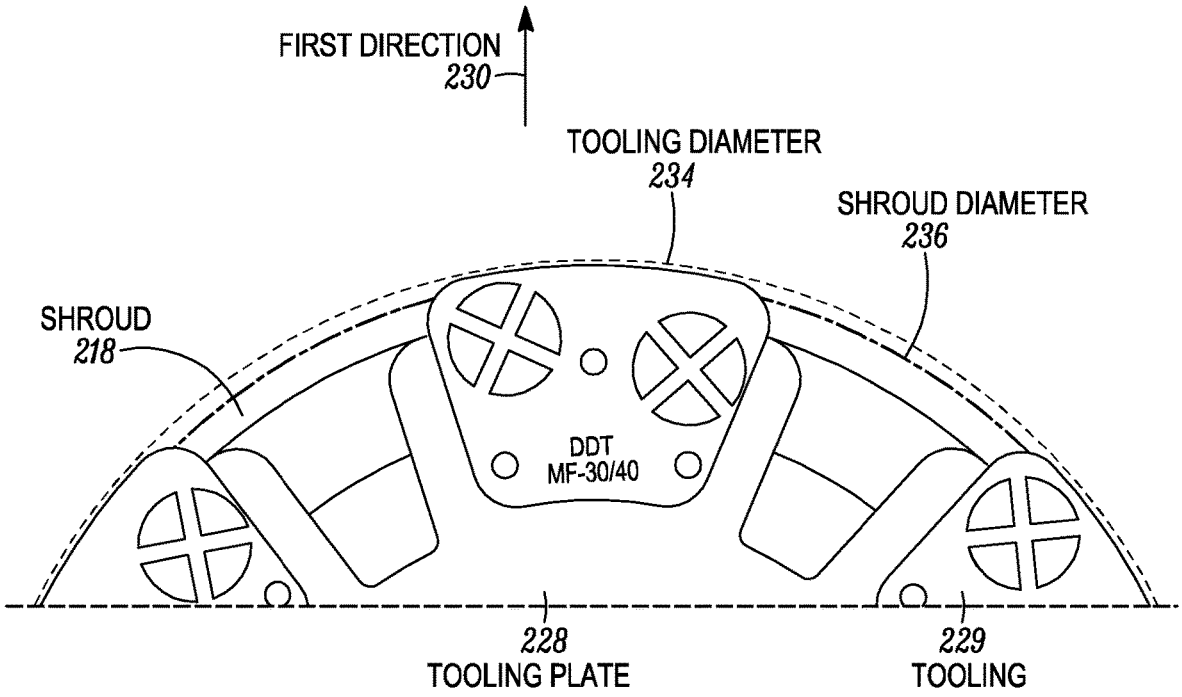
FIG. 2D is an image that illustrates an example of a partial bottom view of the tooling plate of FIG. 2C, according to an embodiment.
Figure 2E:
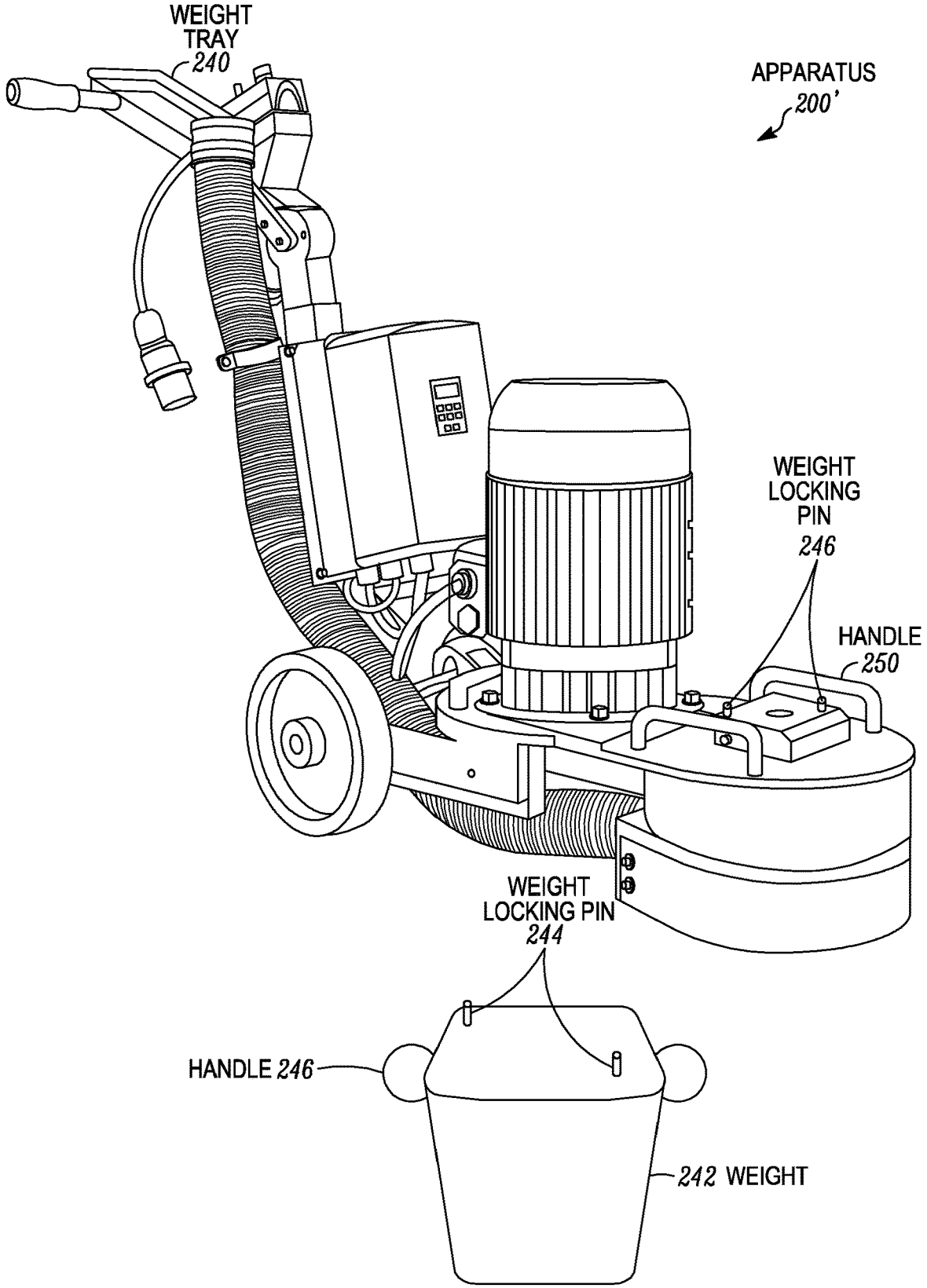
FIG. 2E is an image that illustrates an example of a perspective view of an apparatus for treating a floor surface, according to an embodiment.

FIG. 2E is an image that illustrates an example of a perspective view of an apparatus 200' for treating a floor surface, according to an embodiment. The apparatus 200' is similar to the apparatus 200 of FIG. 2A but further includes one or more weights 242 that can be used to vary the applied weight by the tooling plate 228 on the floor surface. In one example embodiment, the adjuster block 426 includes a pair of weight locking pins 246 that are spaced to receive the weight 242. In this example embodiment, the weight locking pins 246 of the adjuster block 426 are received in spaced apart slots in a base of the weight 242 to securely fix the weight 242 to the adjuster block 426. Additionally, earth magnets at the base of the weight 242 securely fix the weight 242 to the adjuster block 426 (e.g. steel material). In this example embodiment, the positioning of the weight 242 on the adjuster block 426 increases the applied weight by the tooling plate 228 on the floor surface. In an example embodiment, the weight 242 is about 40 pounds. In an example embodiment, the weight 242 includes weight locking pins 244 that are similar to the weight locking pins 246 on the adjuster block 426 and thus an additional weight 242 can be mounted on top of the first weight 242, to further increase the applied weight by the tooling plate 228 on the floor surface. In some embodiments, more than two weights 242 can be stacked on top of each other. In this example embodiment, where the weight 242 is about 40 pounds, the mounting of two weights 242 on the adjuster block 426 increases the applied weight by about 80 pounds. In an example embodiment, the applied weight by the tooling plate 228 on the floor surface, in an absence of the weights 242 (i.e. due to the frame 216) is about 150 pounds. Example embodiments where a user may want to increase the applied weight by the tooling plate 228 on the floor surface include polishing or grinding glue off the floor surface.

Additionally, as depicted in FIG. 2E, the apparatus 200' includes a weight tray 240 adjacent to the handle 204. The weight tray 240 includes a slot that is sized to receive one or more of the weights 242, to reduce the applied weight of the tooling plate 228 on the floor surface. In one embodiment, the slot of the weight tray 240 is sized so that an inner diameter of the slot is about equal to an outer diameter (e.g. outer width) of the weight 242 and thus the weight 242 is slidably received within the slot. Additionally, in another embodiment, the earth magnets at the base of the weight 242 secure the weight 242 to steel material along the weight tray 240, to securely fix the weight 242 in the weight tray 240. In some embodiments, a lateral position of the weight 242 in the weight tray 240 can be adjusted. In this example embodiment, each inch that the weight 242 is moved in the weight tray 240 varies the applied weight of the weight 242 by a fixed amount (e.g. 5 pounds). In some embodiments, a length of the slot in the weight tray 240 is sufficient to support two weights 242, side-by-side. Example embodiments where a user may want to reduce the applied weight by the tooling plate 228 on the floor surface include using a larger diameter (e.g. 20", 27") tooling plate 228, where a reduction in the applied weight reduces the pressure on the tooling plate 228.

In some embodiments, the apparatus 200 includes a rubber shroud 218 secured around a perimeter of a floating shroud 219. To secure the rubber shroud 218 around the perimeter of the floating shroud 219, in a first step a vacuum hose 227 outlet is secured to a dust port inlet on a floating shroud 219. The floating shroud 219 is then secured around the perimeter of the head casing 225. The rubber dust shroud 218 is then secured on shroud pins of the floating shroud 219. In this example embodiment, the rubber dust shroud 218 is pulled to an opposite side of the floating shroud 219 and secured to shroud pins on the opposite side of the floating shroud 219.

FIG. 2B is an image that illustrates an example of a perspective view of a head assembly 224 of the apparatus 200 of FIG. 2A, according to an embodiment. In one embodiment, the head assembly 224 includes a bottom plate 226 that is operatively coupled to the motor 212 so that the bottom plate 226 rotates about a first axis 223. In an example embodiment, the apparatus 200 is equipped with a single (e.g. 12 inch) bottom plate 226, which is adjustable by design to move left or right (e.g. orthogonal to the first axis 223) in order to get right up against an edge of a wall for zero-tolerance edging. However, the bottom plate 226 need not be adjustable and in some embodiments, the apparatus 200 includes the bottom plate 226 that is positioned at a lateral position relative to the frame 216 such that the tooling plate 228 mounted to the bottom plate 226 can treat the floor surface including an edge of the floor surface intersecting the wall surface. In an example embodiment, the apparatus 226 includes the bottom plate 226 that is in a fixed lateral position relative to the frame 216 such that the tooling plate 228 extends to (or beyond) the shroud 218 and treats the floor surface including an edge of the floor surface intersecting the wall surface.

FIG. 2C is an image that illustrates an example of a bottom view of a tooling plate 228 mounted on the bottom plate 226 of FIG. 2B, according to an embodiment. In an embodiment, where the tooling plate 228 is mounted to the bottom plate 226 by passing screws through holes in the tooling plate 228 and threading the screws into holes in the bottom plate 226. In an example embodiment, the tooling plate 228 is mounted to the bottom plate 226 by threading screws (e.g. four M12×1.75×25 screws) into holes in the bottom plate 226 using a tool (e.g. 8 mm Allen wrench). Based on rotation of the bottom 226, the tooling plate 228 (e.g. metal bond diamond tooling plate, resin bond diamond tooling plate, burnishing pad, scrub brush) also rotates and treats the floor surface (e.g. concrete grinding, concrete polishing, burnishing, brushing, etc.) as the apparatus 200 moves over the floor surface.

In some embodiments, the apparatus 200 is configured to displace the bottom plate 226 in a first direction 230 orthogonal to the first axis 223 so that the tooling plate 228 mounted to the bottom plate 226 is also displaced in the first direction 230. In other embodiments, the apparatus 200 is configured to displace the bottom plate 226 in a second direction 232 orthogonal to the first axis 223 so that the tooling plate 228 mounted to the bottom plate 226 is also displaced in the second direction 232.

FIG. 2D is an image that illustrates an example of a partial bottom view of the tooling plate 228 of FIG. 2C, according to an embodiment. In one embodiment, tooling 229 is mounted to the tooling plate 228. In one embodiment, the tooling 229 is a trapezoid plate with a plurality of holes. To install the tooling 229 on the tooling plate 228, the holes of the trapezoid plate are aligned with corresponding holes on the tooling plate 228 and a plurality of screws (e.g. M6×1×14) are screwed through the trapezoid plate holes and into the tooling plate 228 holes with a tool (e.g. 4 mm Allen wrench). In an example embodiment, the trapezoid plate is a diamond tooling plate. In another example embodiment, the tooling 229 is mounted to the tooling plate 228 such that an outer diameter of the tooling 229 extends beyond an outer diameter of the tooling plate 228.

In some embodiments, based on the displacement of the tooling plate 228 in the first direction 230 (FIG. 2C), the tooling plate 228 and/or the tooling 229 are displaced such that a diameter 234 of the tooling plate 228 and/or the tooling 229 extends beyond a diameter 236 of the shroud 218. In an example embodiment, as depicted in FIG. 2D, the diameter 234 of the tooling 229 extends beyond the diameter 236 of the shroud 218. In other embodiments, the diameter of the tooling plate extends beyond the diameter of the shroud 218.

Figure 3A:
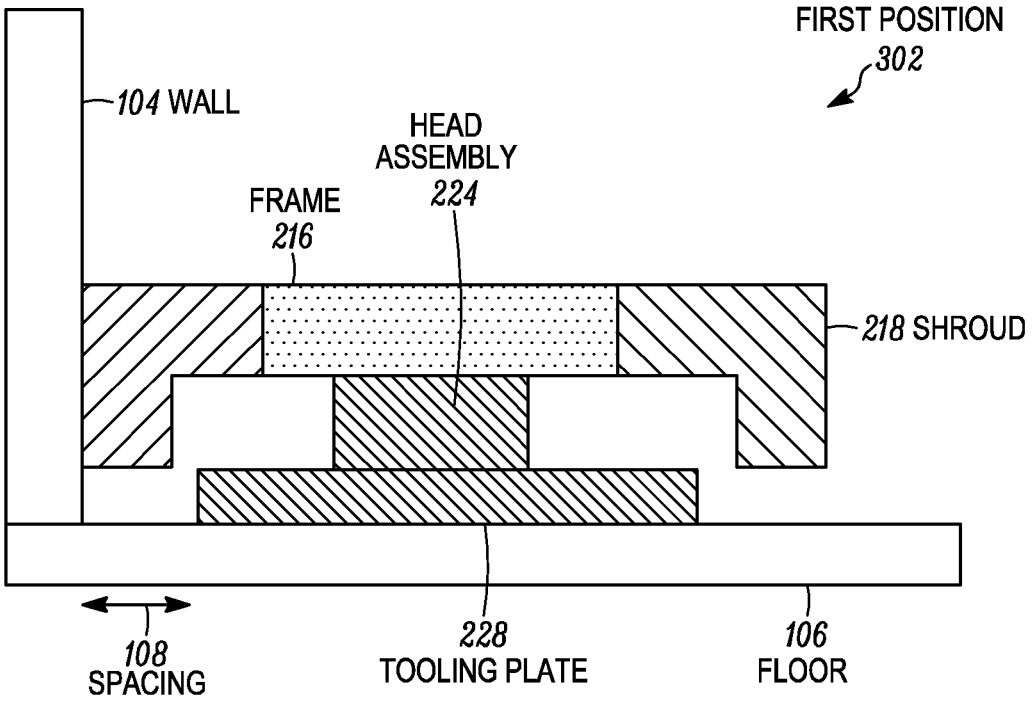
FIG. 3A is a block diagram that illustrates an example of a cross-sectional view of the apparatus of FIG. 2A in a first position at an intersection of a wall and floor surface, according to an embodiment.

FIG. 3A is a block diagram that illustrates an example of a cross-sectional view of the apparatus 200 of FIG. 2A in a first position 302 at an intersection of a wall 104 and floor 106 surface, according to an embodiment. As depicted in FIG. 3A, in the first position 302 the head assembly 224 and tooling plate 228 are positioned in a centered position relative to the frame 216. Additionally, as depicted in FIG. 3A, an outer diameter of the tooling plate 228 is less than an inner diameter of the shroud 218 and thus the tooling plate 228 does not extend to the shroud 218 or to the wall 104 surface in the first position 302. As with the conventional concrete grinder (FIG. 1B), a minimum spacing 108 is provided between the tooling plate 228 and the wall 104 surface.

Figure 3B:
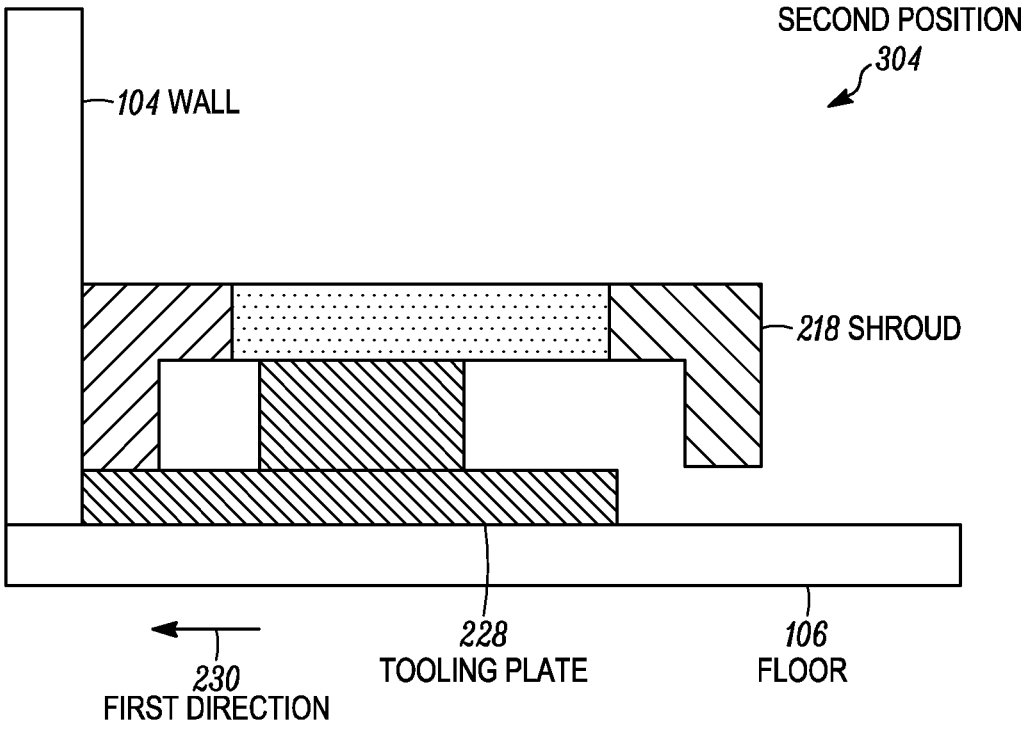
FIG. 3B is a block diagram that illustrates an example of a cross-sectional view of the apparatus of FIG. 2A in a second position at an intersection of a wall and floor surface, according to an embodiment.

FIG. 3B is a block diagram that illustrates an example of a cross-sectional view of the apparatus of FIG. 2A in a second position 304 at an intersection of a wall 104 and floor 106 surface, according to an embodiment. In one embodiment, the second position 304 is based on displacing the head assembly 224 (e.g. bottom plate 226) and tooling plate 228 in the first direction 230 (FIGS. 2C-2D). As a result, the tooling plate 228 extends to the shroud 218 and up against the wall 104 surface. Consequently, the tooling plate 228 achieves zero-tolerance edging, where the tooling plate 228 can treat the floor 106 right up to an intersection with the wall 104 surface. In other embodiments, the apparatus 200 includes the head assembly 224 (e.g. bottom plate 226) and tooling plate 228 that are fixed in the second position 304. In an example embodiment, the bottom plate 226 and tooling plate 228 are permanently fixed in the second position 304 and thus in this example embodiment, the apparatus 200 is dedicated to treatment of the edge of the floor 106 intersecting with the wall 104 surface.

Figure 4A:
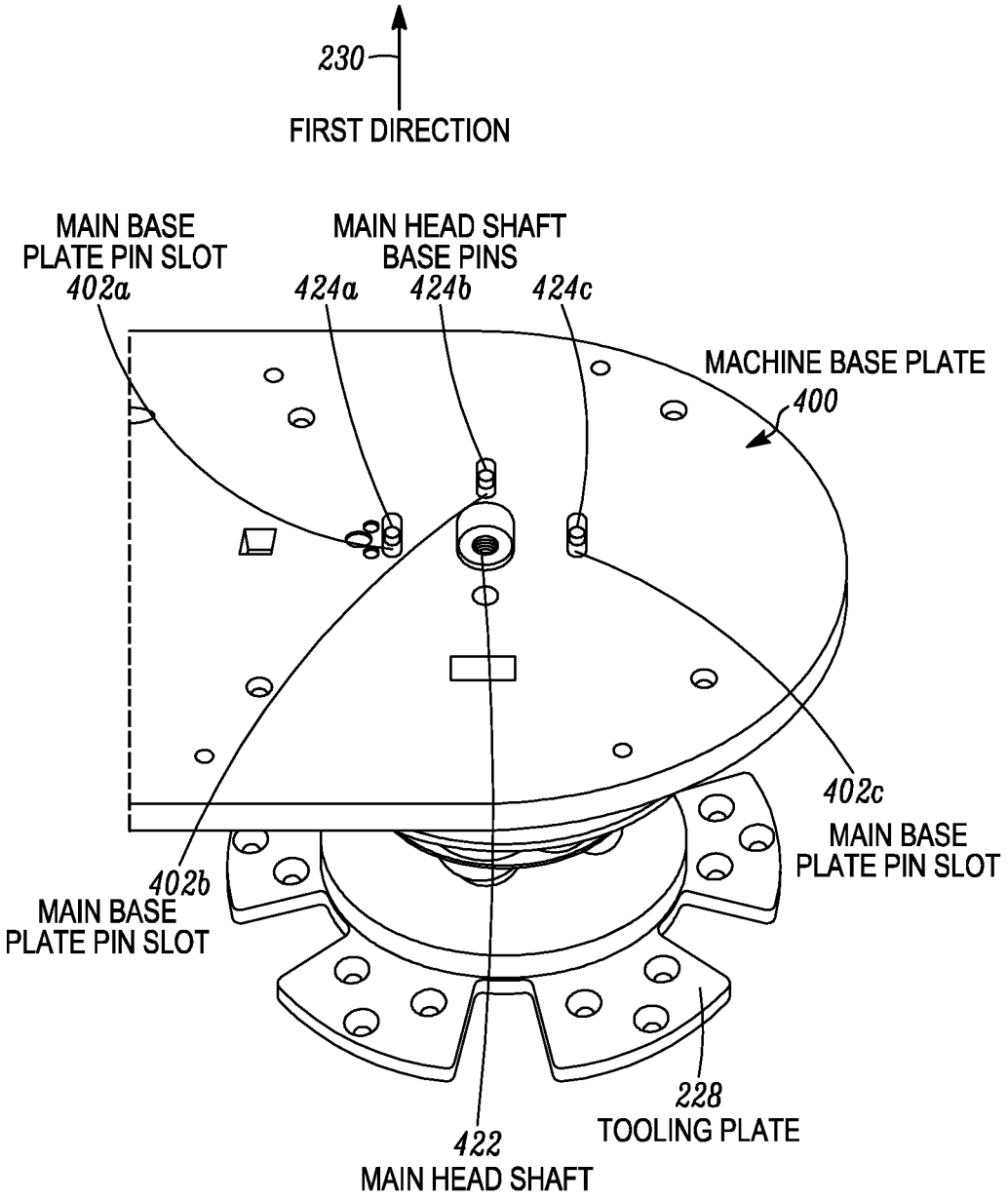
FIG. 4A is an image that illustrates an example of a top perspective view of a machine base plate of the frame of the apparatus of FIG. 2A, according to an embodiment.

FIG. 4A is an image that illustrates an example of a top perspective view of a machine base plate 400 of the frame 216 of the apparatus 200 of FIG. 2A, according to an embodiment. In one embodiment, the machine base plate 400 includes a main head shaft slot 404 and pin slots 402*a*, 402*b*, 402*c*. In an example embodiment, the slots 402*a*, 402*b*, 402*c*, 404 are aligned in the first direction 230, such that a long dimension of the slots is parallel to the first direction 230 and a short dimension of the slots is orthogonal to the first direction 230. In an example embodiment, the main head shaft slot 404 has a long dimension of about 44.5 mm and a short dimension of about 25.3 mm. In an example embodiment, the slots 402*a*, 402*b*, 402*c* each have a long dimension of about 27.8 mm and a short dimension of about 7.9 mm.

Figure 4B:
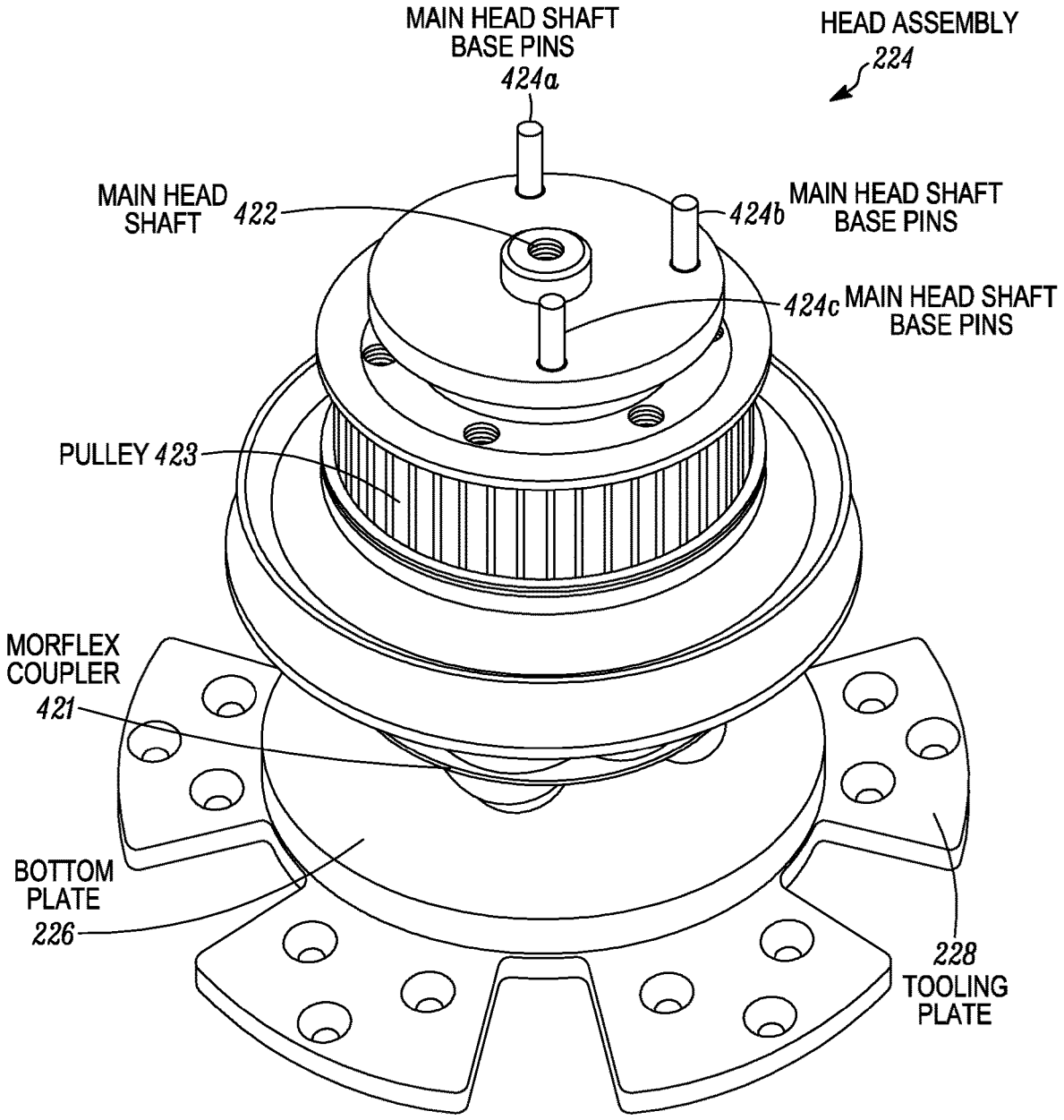
FIG. 4B is an image that illustrates an example of a perspective view of a head assembly of the apparatus of FIG. 2A, according to an embodiment.

FIG. 4B is an image that illustrates an example of a perspective view of a head assembly 224 of the apparatus 200 of FIG. 2A, according to an embodiment. The head assembly 224 includes the bottom plate 226. In some embodiments, the tooling plate 228 mounted to the bottom plate 226 is not considered part of the head assembly 224 nor part of the apparatus 200. As further depicted in FIG. 4B, the head assembly 224 includes a main head shaft 422 and mean head shaft base pins 424*a*, 424*b*, 424*c*. In an example embodiment, the height of the main head shaft 422 is about 10 mm and a height of the main head shaft base pins 424*a*, 424*b*, 424*c* is about 20 mm. Additionally, in some embodiments, the head assembly 224 includes a MORFLEX® coupler 421 supplied by Regal Beloit Americas, Inc. Florence, Ky. In an example embodiment, the MORFLEX® coupler 421 compensates for undulations in the floor surface by permitting the bottom plate 226 to tilt over a range of angles (e.g. 1.5 to 10 degrees) and remain square to the floor over such undulations. Additionally, in some embodiments, the head assembly 224 includes a pulley 423 where a belt driven by the motor 212 is wrapped around the pulley to rotatably couple the head assembly 224 to the motor 212.

Figure 4C:
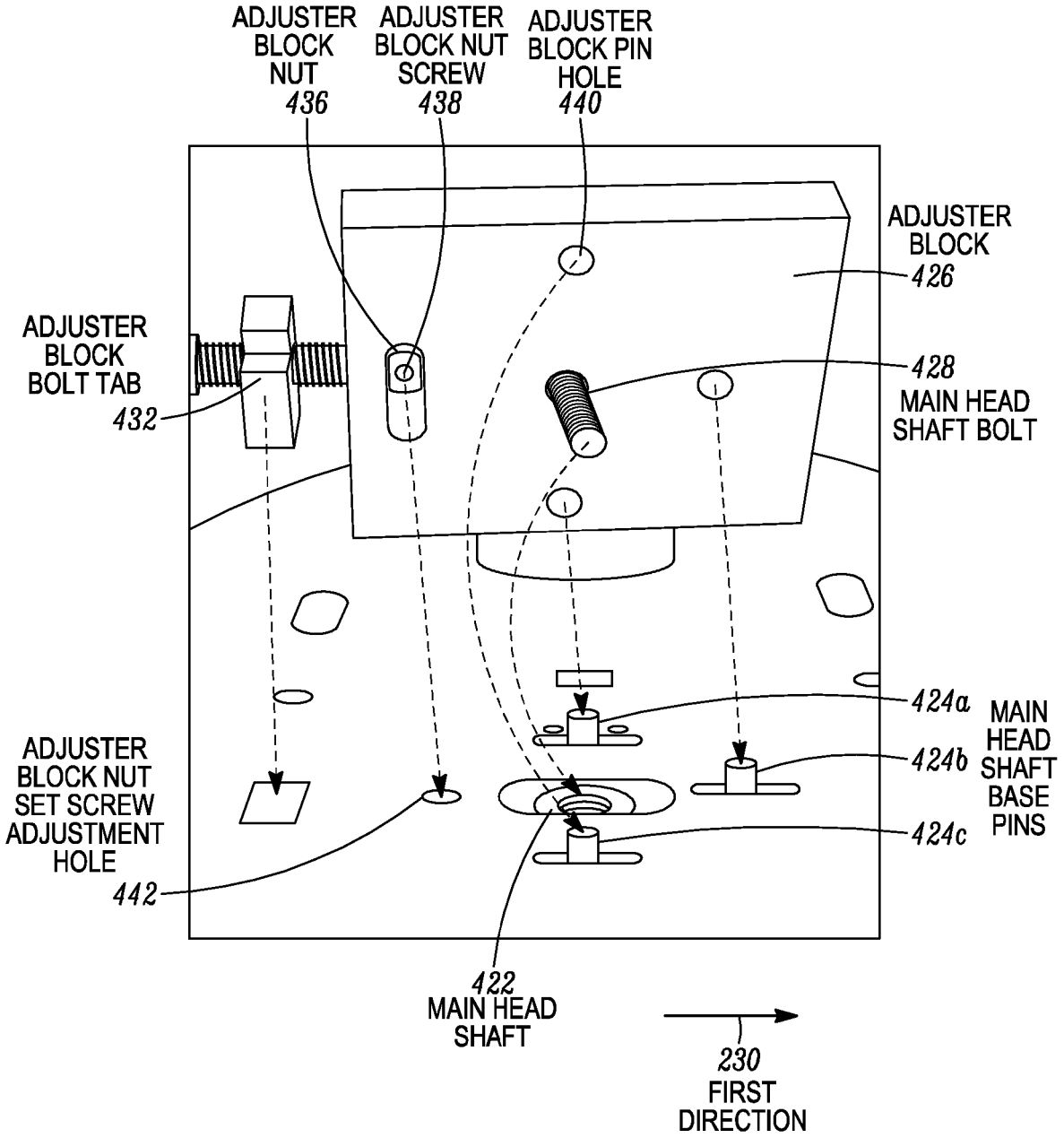
FIG. 4C is an image that illustrates an example of an exploded view of the adjuster block and the machine base plate of FIG. 4D, according to an embodiment.

FIG. 4C is an image that illustrates an example of an exploded view of an adjuster 426 block and the machine base plate 400 of FIG. 4A, according to an embodiment. In some embodiments, the head assembly 224 of FIG. 4B is positioned underneath the machine base plate 400 of FIG. 4A. The main head shaft 422 is received in the main head shaft slot 404 and main head shaft base pins 424*a*, 424*b*, 424*c* are received in the pin slots 402*a*, 402*b*, 402*c*. In one embodiment, the main head shaft slot 404 is configured to slidably receive the main head shaft 422 so that the main head shaft 422 can be displaced in the first direction 230. Additionally, when the main head shaft 422 is displaced in the first direction 230, the bottom plate 226 (and tooling plate 228) is displaced in the first direction 230. In an example embodiment, the main head shaft slot 404 is so configured based on the alignment of the long dimension of the main head shaft slot 404 in the first direction 230.

In one embodiment, the machine base plate pin slots 402*a*, 402*b*, 402*c* are configured to slidably receive the main head shaft base pins 424*a*, 424*b*, 424*c* so that the main head shaft base pins 424*a*, 424*b*, 424*c* can be displaced in the first direction 230. Additionally, when the main head shaft base pins 424*a*, 424*b*, 424*c* are displaced in the first direction 230, the bottom plate 226 (and tooling plate 228) is displaced in the first direction 230. In an example embodiment, the machine base plate pin slots 402*a*, 402*b*, 402*c* are so configured based on the alignment of the long dimension of the slots 402*a*, 402*b*, 402*c* in the first direction 230.

Figure 4D:
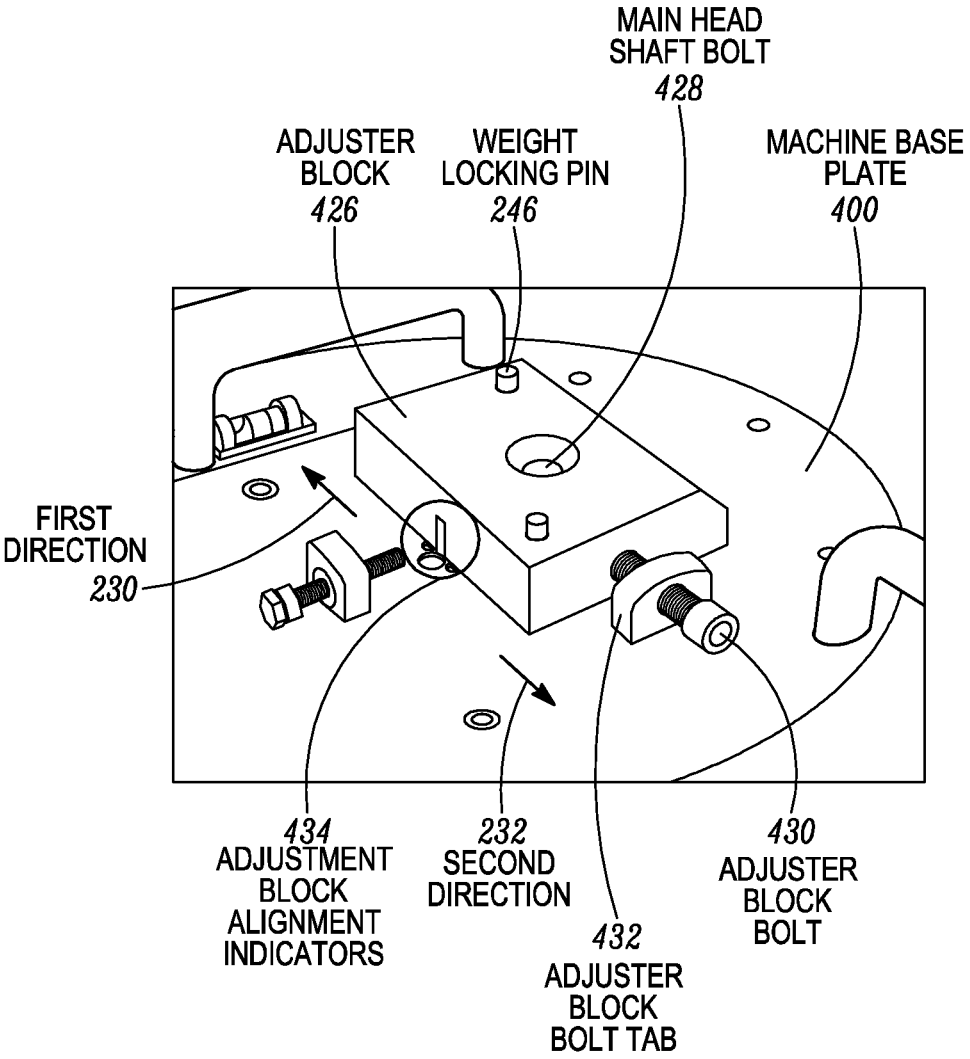
FIG. 4D is an image that illustrates an example of a perspective view of an adjuster block mounted on the machine base plate of FIG. 4A, according to an embodiment.

FIG. 4D is an image that illustrates an example of a perspective view of an adjuster block 426 mounted on a surface the machine base plate 400 of FIG. 4A, according to an embodiment. In some embodiments, a main head shaft bolt 428 is provided to secure the adjuster block 426 to the main head shaft 422 (FIG. 4C) so that the main head shaft 422 is configured to displace in the first direction 230 (e.g. along the main head shaft slot 404) upon displacement of the adjuster block 426 in the first direction 230. In some embodiments, the main head shaft bolt 428 is initially tightened, which prevents displacement of the adjuster block 426 along the machine base plate 400 and thus prevents displacement of the main head shaft 422 in the first direction 230. In these embodiments, the main head shaft bolt 428 is slightly loosened (e.g. ½ to ¾ turn) after which the adjuster block 426 can be displaced along the surface of the machine base plate 400, resulting in displacement of the main head shaft 422. In some embodiments, an adjuster block bolt 430 is operatively connected to the adjuster block 426 so that the adjuster block 426 displaces in the first direction 230 upon rotation of the adjuster block bolt 430 in a clockwise direction and the adjuster block 426 displaces in the second direction 232 upon rotation of the adjuster block bolt 430 in a counterclockwise direction. In another embodiment, the adjuster block bolt 426 is displaced in the first direction upon rotation of the adjuster block bolt 430 in the counterclockwise direction and the adjuster block 426 is displaced in the second direction 232 upon rotation of the adjuster block bolt 430 in the clockwise direction.

Although the adjuster block bolt 430 is depicted and discussed as one embodiment in which the adjuster block 426 could be displaced in the first direction 230 or second direction 232, the embodiments of the present invention is not limited to this arrangement and includes all arrangements know to one of ordinary skill in the art to displace the adjuster block 426 in the first direction 230 or second direction 232. In one example embodiment, after slightly loosening (e.g. ½-¾ turn) the main head shaft bolt 428, a motor (e.g. linear actuator) could be used to displace the adjuster block 426 in the first direction 230 or second direction 232. In this example embodiment, the motor could be mounted to the machine base plate 400 and operatively coupled to the adjuster block 426 so that the adjuster block 426 is displaced in the first direction 230 or second direction 232. In another example embodiment, after slightly loosening the main head shaft bolt 428, the user can displace the machine base plate 400 relative to the head assembly 224 by moving a handle 250 (FIG. 2E) of the machine base plate 400 in the first direction 230 or the second direction 232. In this example embodiment, movement of the handle 250 in the first direction 230 or second direction 232 causes displacement of the machine base plate 400 in the first direction 230 (or second direction 232) relative to the head assembly 224 and thus results in (relative) displacement of the bottom plate 226 in the first direction 230 or second direction 232. In some embodiments, the adjuster block bolt 430 is M12×1.75×60 sized bolt and the main head shaft bolt 428 is M12×1.75×35 size bolt. In an example embodiments, both of the adjuster block bolts 430 and the main head shaft bolt 428 can be adjusted using the same tool (e.g. 10 mm Allen wrench).

In some embodiments, FIG. 4D depicts an adjuster block bolt tab 432 mounted to the machine base plate 400. In one embodiment, the adjuster block bolt tab 432 is welded to the machine base plate 400. In other embodiments, the adjuster block bolt tab 432 is mounted to the machine base plate 400 using mounting tabs 433 (FIG. 4E) on either side of the adjuster block bolt tab 432, where each mounting tab 433 includes an opening 435 to pass a bolt to mount the adjuster block bolt tab 432 to the machine base plate 400. In one embodiment, the adjuster block bolt tab 432 includes an opening to rotatably mount the adjuster block bolt 430. The adjuster block bolt tab 432 advantageously permits the user to conveniently turn the adjuster block bolt 430 (e.g. using a tool) without having to physically hold the adjuster block bolt 430 while turning the adjuster block bolt 430.

Figure 4E:
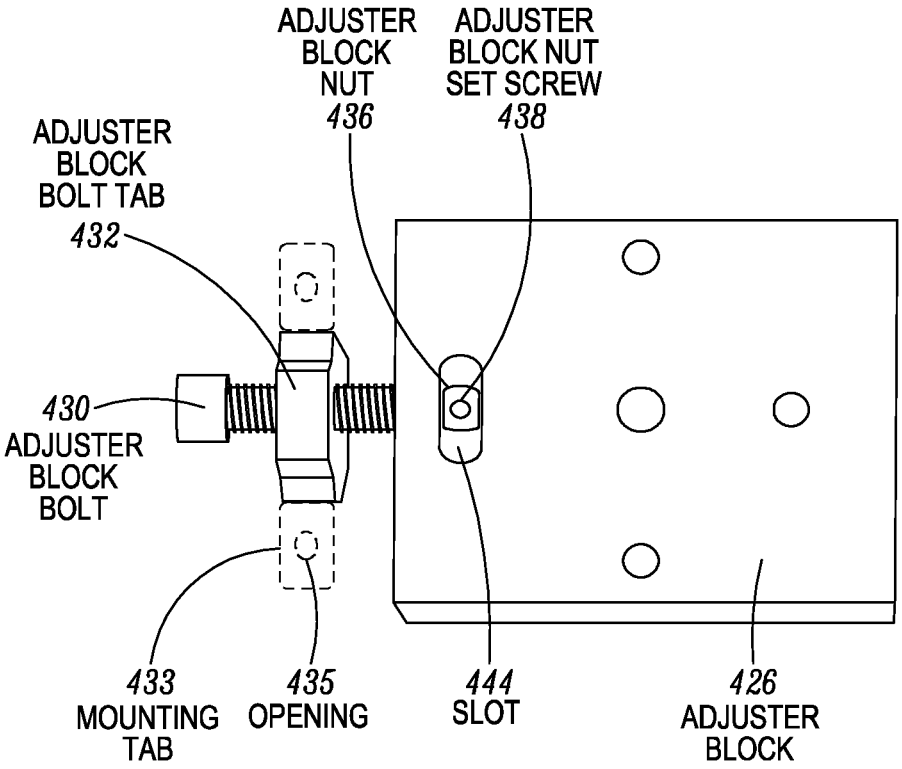
FIG. 4E is an image that illustrates an example of a bottom view of the adjuster block of FIG. 4C, according to an embodiment.

FIG. 4E is an image that illustrates an example of a bottom view of the adjuster block 426 of FIG. 4C, according to an embodiment. In some embodiments, the adjuster block 426 includes a slot 444 that is sized to receive an adjuster block nut 436. The adjuster block bolt 430 is threaded through an opening in one end of the adjuster block 426 and into the adjuster block nut 436 positioned in the slot 444. After the adjuster block bolt 430 has threaded into the slot 444 and into the adjuster block nut 436, the adjuster block bolt 430 is rotatably fixed to the adjuster block nut 436 within the slot 444. By rotatably fixing the adjuster block bolt 430 to the adjuster block nut 436 within the slot 444, rotation of the adjuster block bolt 430 causes the adjuster block 426 to displace in the first direction 230 or second direction 232, depending on the direction of rotation of the adjuster block 430. In one example embodiment, the adjuster block bolt 430 is rotatably fixed to the adjuster block nut 436 using an adjuster block nut set screw 438. In this example embodiment, the adjuster block nut set screw 438 is passed through an opening in the adjuster block nut 436 and into a side of the adjuster block nut 430 within the adjuster block nut 436.

Figure 4F:
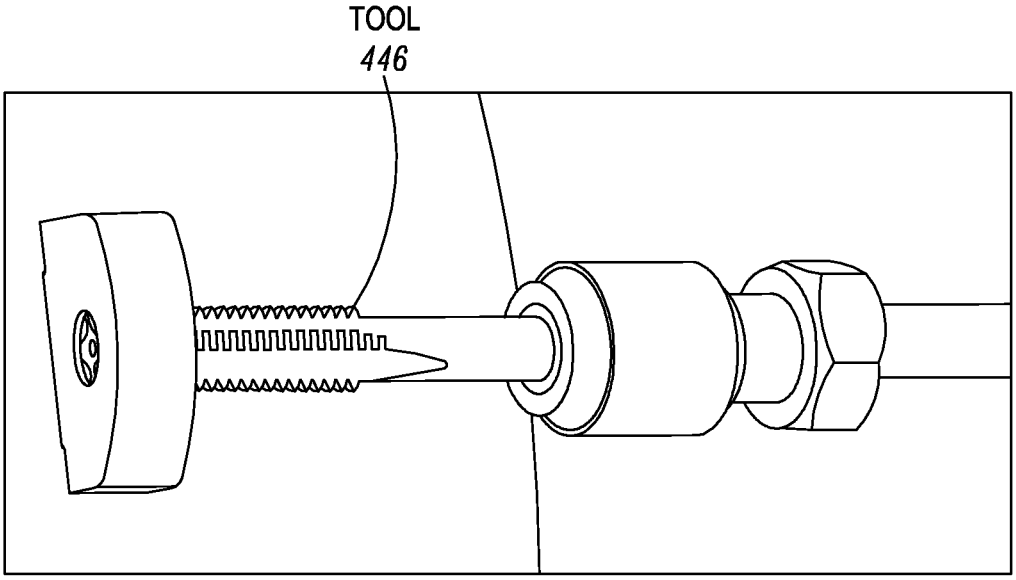
FIG. 4F is an image that illustrates an example of a front view of a tap tool inserted in an adjuster block bolt tab of FIG. 4C, according to an embodiment.
Figure 4G:
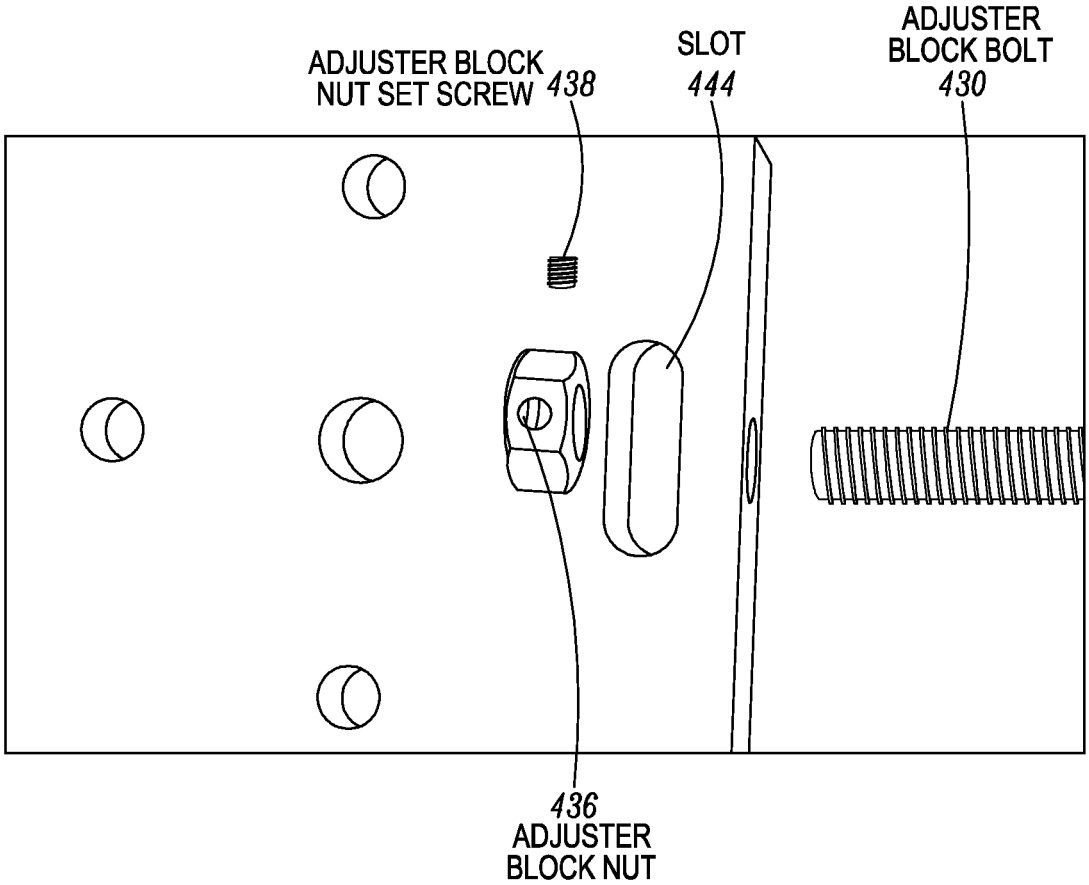
FIG. 4G is an image that illustrates an example of a bottom view of the adjuster block, adjuster block nut and adjuster block nut set screw of FIG. 4D, according to an embodiment.
Figure 4H:
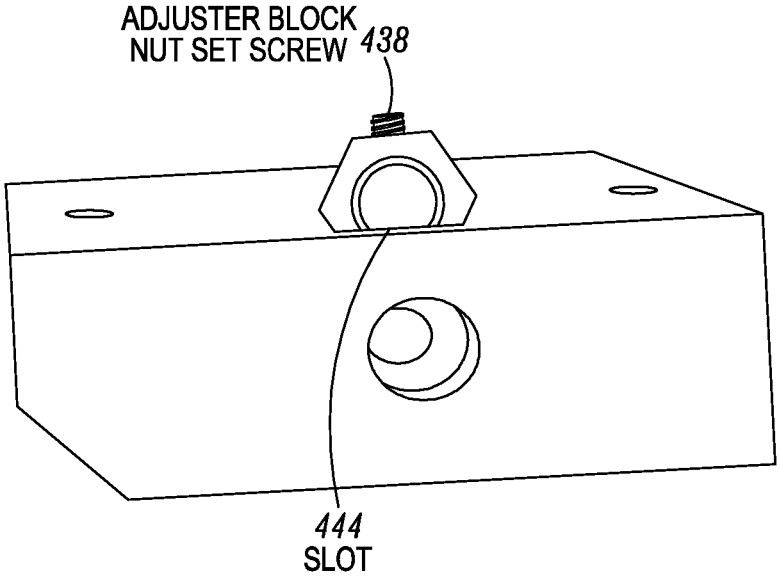
FIG. 4H is an image that illustrates an example of a side view of the adjuster block nut inserted into the slot of the adjuster block, according to an embodiment.
Figure 4I:
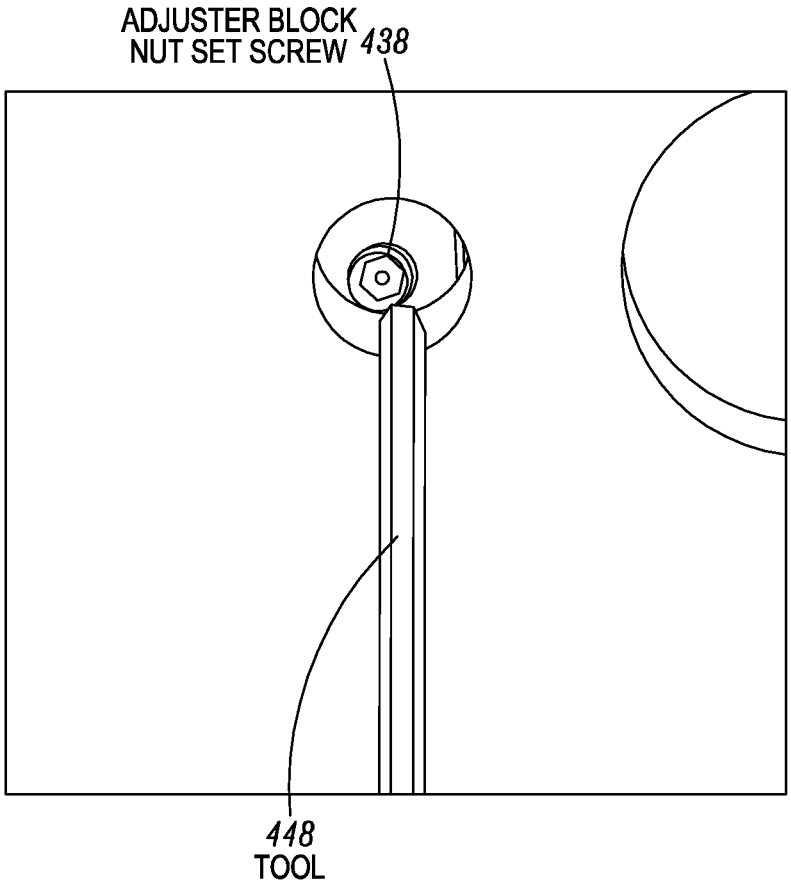
FIG. 4I is an image that illustrates an example of a bottom view of the adjuster block nut set screw in the adjustment hole of FIG. 4D, according to an embodiment.

FIGS. 4F-4I are images that illustrates an example of various stages of installing the adjuster block 426 on the machine base plate 400, including installing the adjuster block nut 436 within the slot 444 of the adjuster block 426. In a first step, the adjuster block bolt tab 432 is welded to the machine base plate 400. In one embodiment, as depicted in FIG. 4F, in a second step, a tool 446 (e.g. a tap) is threaded through the opening of the adjuster block bolt tab 432, to remove zinc build up from the threads of the opening of the adjuster block bolt tab 432. In one embodiment, in a third step, an adhesive (e.g. Loctite®) is applied to the opening of the adjuster block nut 436. In one embodiment, as depicted in FIG. 4H, in a fourth step, the adjuster block nut set screw 438 is positioned in the opening of the adjuster block nut 436 and the adjuster block nut 436 is dropped into the slot 444 of the adjuster block 426. In one embodiment, in a fifth step, the adjuster block 426 is positioned on the surface of the machine base plate 400 as depicted in FIG. 4D so that the adjuster block pin holes 440 are aligned with the machine base plate pin slots 402*a*, 402*b*, 402*c*. In one embodiment, in a sixth step, the adjuster block bolt 430 is threaded into the adjuster block nut 436 in the slot 444 of the adjuster block 426. In an example embodiment, during the sixth step, the adjuster block bolt 430 is threaded until it reaches the end of the slot 444 and is then reversed a partial turn (e.g. ½-¾ turn). In an example embodiment, as depicted in FIG. 4I, during a seventh step, a tool 448 (e.g. Allen wrench) is used to tighten the adjuster block nut set screw 438 into the opening in the adjuster block nut 436 and into the adjuster block bolt 430 to rotatably fix the adjuster block nut 436 to the adjuster block bolt 430.

The method of installing the adjuster block 426 discussed above with reference to FIGS. 4F-4I is merely one example of a method for installing the adjuster block 426. In another embodiment of the method, in a first step the adjuster block bolt 430 is passed through the threaded opening of the adjuster block bolt tab 432. In a second step, the adjuster block bolt 430 is then passed through the adjuster block nut 436 positioned in the slot 444. In a third step, the adjuster block nut set screw 438 is then threaded through the opening of the adjuster block nut 436 and into the adjuster block bolt 430, to rotatably fix the adjuster block bolt 430 to the adjuster block nut 436. In a fourth step, the adjuster block 426 is then mounted to the machine base plate 400 so that the adjuster block pin holes 440 are aligned with the machine base plate pin slots 402*a*, 402*b*, 402*c*. In a fifth step, the adjuster block bolt tab 432 is then mounted to the machine base plate 400 using the mounting tabs 433 (FIG. 4E), where bolts are passed through openings 435 in the mounting tabs 433 and into threaded openings in the machine base plate 400.

Figure 4J:
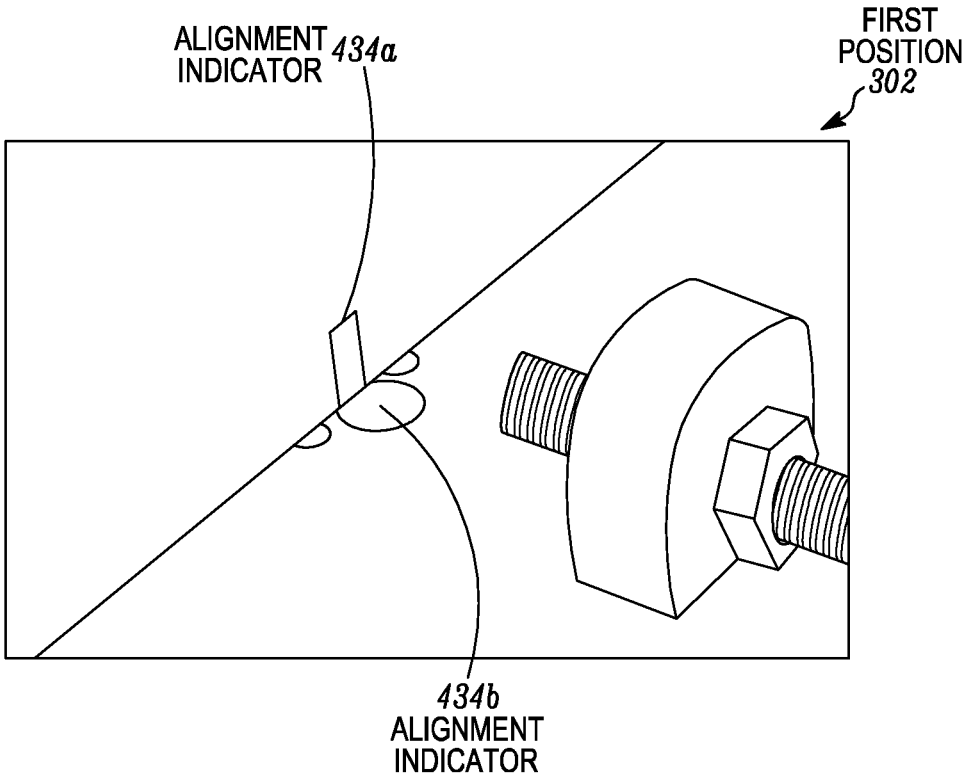
FIG. 4J is an image that illustrates an example of a perspective view of alignment indicators when the apparatus is in the first position of FIG. 3A, according to an embodiment.

In some embodiments, FIG. 4D depicts that adjustment block alignment indicators 434 are provided that are used to indicate when the adjustment block 426 (and consequently the bottom plate 226 and tooling plate 228) are in one of a plurality of positions. FIG. 4J is an image that illustrates an example of a perspective view of alignment indicators 434 when the apparatus 200 is in the first position 302 of FIG. 3A, according to an embodiment. In some embodiments, the first position 302 is defined as a position where the head assembly 224 (including the bottom plate 226) is centered within the shroud and/or is centered relative to the frame 216. In an embodiment, the first position 302 is also defined by the adjuster block 426 being centered on the machine base plate 400. However, the first position 302 is not limited to a position where the head assembly 224 is centered within the shroud or centered relative the frame 216. As depicted in FIG. 4J, the first position 302 is indicated by the alignment indicators 434 based on an alignment indicator 434*a* on the adjustment block 426 being aligned with a center alignment indicator 434*b* on the machine base plate 400.

Figure 4K:
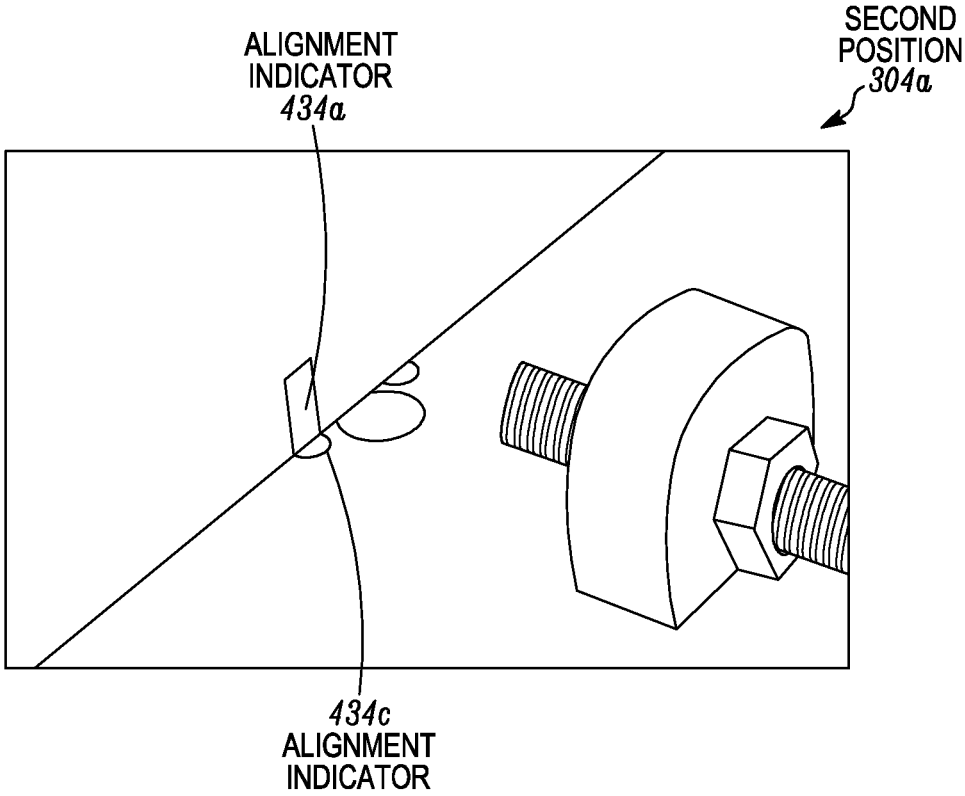
FIG. 4K is an image that illustrates an example of a perspective view of alignment indicators when the apparatus is in the second position of FIG. 3B, according to an embodiment.

As previously discussed, the apparatus 200 is configured to displace the head assembly 224 (e.g. bottom plate 226) and tooling plate 228 from the first position 302 in the first direction 230 to a second position 304*a* where the tooling plate 228 is aligned with a wall 104 surface. In some embodiments, the second position 304*a* represents a range of adjustment of the head assembly 224 in the first direction 230. FIG. 4K is an image that illustrates an example of a perspective view of alignment indicators 434 when the apparatus 200 is in the second position 304*a* of FIG. 3B, according to an embodiment. As depicted in FIG. 4K, the second position 304*a* is indicated by the alignment indicators 434 based on the alignment indicator 434*a* on the adjustment block 426 being aligned with an outer alignment indicator 434*c* on the machine base plate 400. In an example embodiment, the center alignment indicator 434*b* and outer alignment indicator 434*c* are spaced apart by 12 mm.

Figure 4L:
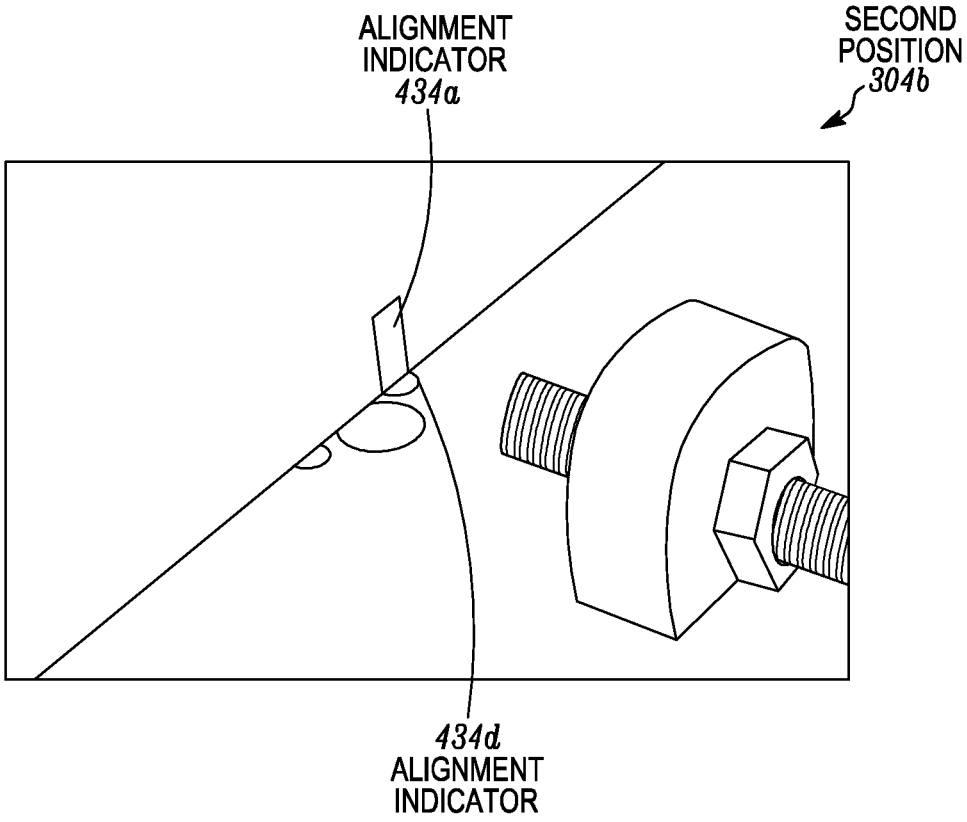
FIG. 4L is an image that illustrates an example of a perspective view of alignment indicators when the apparatus is in the second position of FIG. 3B, according to an embodiment.

As previously discussed, the apparatus 200 is configured to displace the head assembly 224 (e.g. bottom plate 226) and tooling plate 228 from the first position 302 in the second direction 232. In one embodiment, the head assembly 224 and tooling plate 228 can be adjusted from the first position 302 in the second direction 232 to a second position 304*b*, in a similar manner as the head assembly 224 and tooling plate 228 can be adjusted from the first position 302 in the first direction 230 to the second position 304*a*. In some embodiments, the second position 304*b* represents a range of adjustment of the head assembly 224 in the second direction 232. FIG. 4L is an image that illustrates an example of a perspective view of alignment indicators 434 when the apparatus 200 is in the second position 304*b*, according to an embodiment. As depicted in FIG. 4L, the second position 304*b* is indicated by the alignment indicators 434 based on the alignment indicator 434*a* on the adjustment block 426 being aligned with an outer alignment indicator 434*d* on the machine base plate 400. In one embodiment, the outer alignment indicators 434*c*, 434*d* are positioned at equal and opposite distances from the center alignment indicator 434*b* on the machine base plate 400.

Figure 5A:
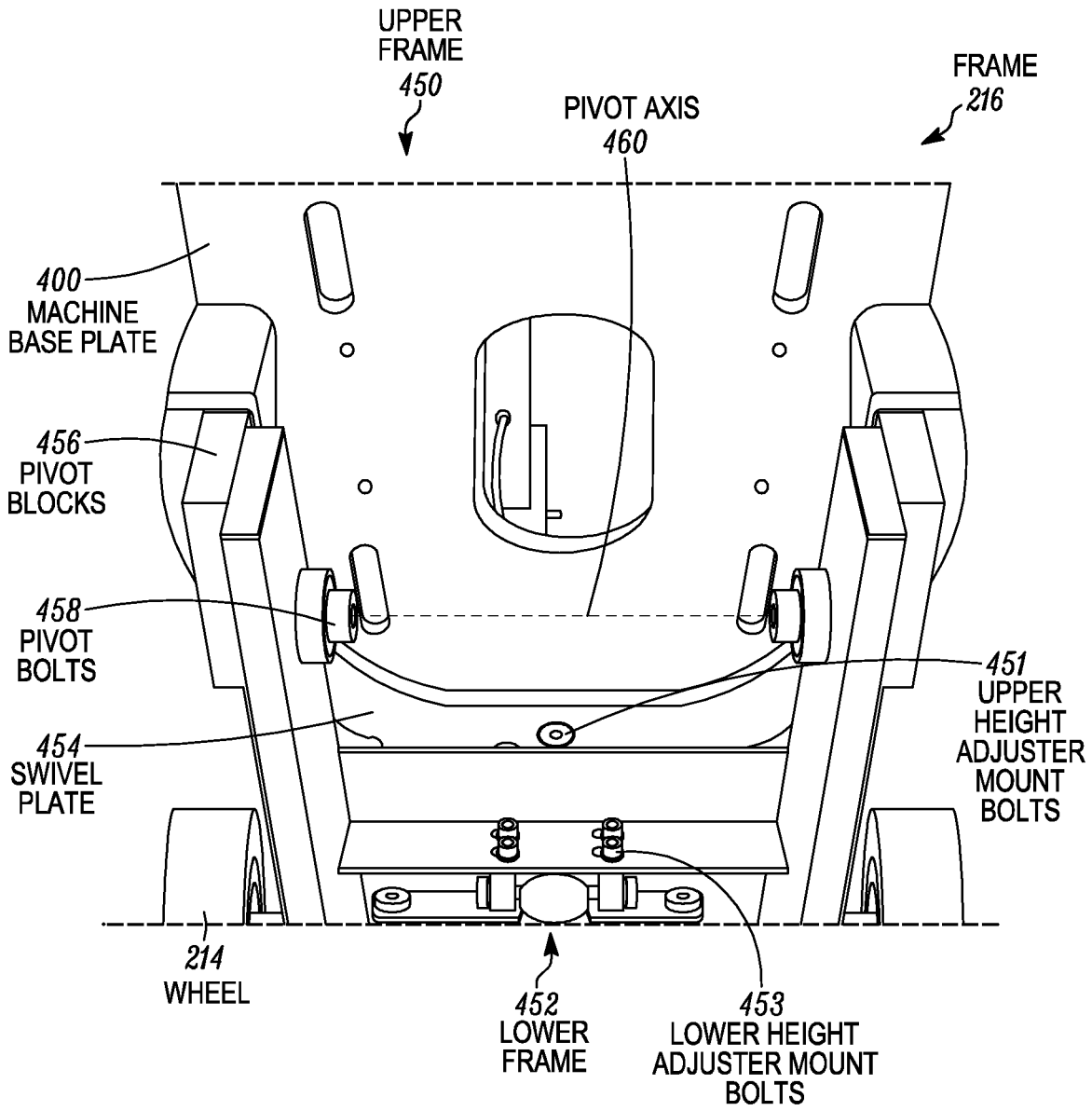
FIG. 5A is an image that illustrates an example of a bottom perspective view of the frame of the apparatus of FIG. 2A, according to an embodiment.

FIG. 5A is an image that illustrates an example of a bottom perspective view of the frame 216 of the apparatus 200 of FIG. 2A, according to an embodiment. As depicted in FIG. 5A, the frame 216 includes an upper frame 450 and a lower frame 452, where the wheels 214 are mounted to the lower frame 452 and the head assembly 224 (and machine base plate 400) is mounted to the upper frame 450. In one embodiment, the upper frame 450 and the lower frame 452 are pivotally coupled about a pivot axis 460 using a pair of pivot bolts 458. In an example embodiment, pivot blocks 456 of the upper frame 450 are pivotally coupled to the lower frame 452 with the pivot bolts 458. In an example embodiment, the pivot bolts 458 are shoulder bolts. In an embodiment, the upper frame 450 is pivoted relative to the lower frame 452 so that the tooling plate 228 mounted on the bottom plate 226 is oriented parallel to the floor surface.

Figure 5B:
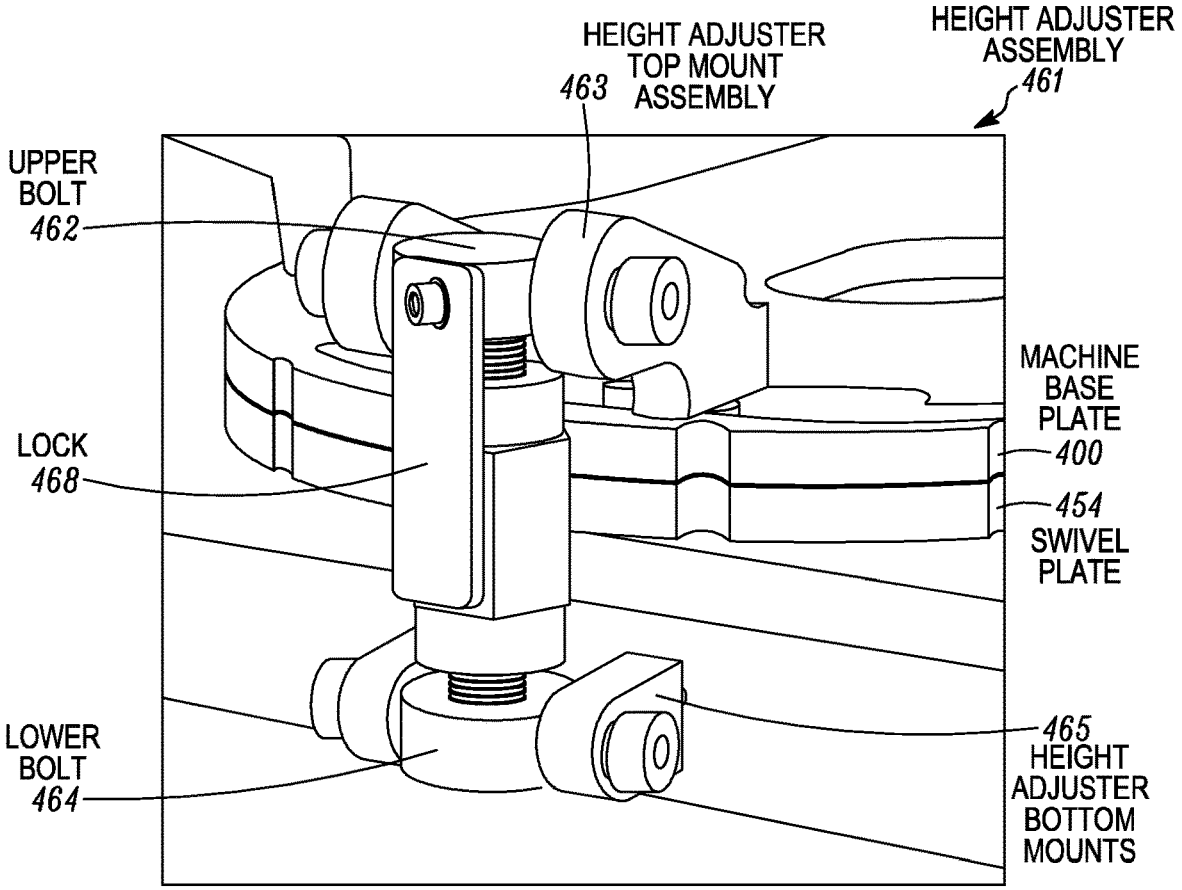
FIG. 5B is an image that illustrates an example of a perspective view of a height adjuster nut connected to the frame of FIG. 5A and in a locked position, according to an embodiment.

FIG. 5B is an image that illustrates an example of a perspective view of a height adjuster nut 466 connected to the frame 216 of FIG. 5A and in a locked position, according to an embodiment. In one embodiment, an upper bolt 462 is mounted to the upper frame 450. In an example embodiment, the upper bolt 462 is mounted to a height adjuster top mount assembly 463 (using a pair of bolts) and the height adjuster top mount assembly 463 is mounted to a swivel plate 454 of the upper frame 450 through a height adjuster swivel slot 478*a* (FIG. 5G) of the machine base plate 400. In an example embodiment, the height adjuster top mount assembly 463 is mounted to the swivel plate 454 by securing a plurality of upper height adjuster mount bolts 451 (FIG. 5A) through a plurality of spacers 467 (FIG. 5C) and into the swivel plate 454. In other embodiments, no swivel plate 454 is provided and the height adjuster top mount assembly 463 is secured to the machine base plate 400. In this embodiment, the machine base plate 400 is not rotated relative to the lower frame 452.

In another embodiment, a lower bolt 464 is mounted to the lower frame 452. In an example embodiment, the lower bolt 464 is mounted to height adjuster bottom mounts 465 (using a pair of bolts) and the height adjuster bottom mounts 465 are mounted to the lower frame 452. In an example embodiment, the height adjuster bottom mounts 465 are mounted to the lower frame 452 using a plurality of lower height adjuster mount bolts 453 (FIG. 5A).

In some embodiments, the upper bolt 462 has external threads oriented in a first direction and the lower bolt 464 has external threads oriented in a second direction opposite to the first direction. In these embodiments, the height adjuster nut 466 includes an opening at opposite ends, where the opening includes internal threads. A first end of the height adjuster nut 466 threadably engages the external threads of the upper bolt 462 and a second end of the height adjuster nut 466 threadably engages the external threads of the lower bolt 464. In this embodiment, upon rotation of the height adjuster nut 466 (e.g. using an adjustment tool), the upper bolt 462 and the lower bolt 464 are displaced in opposite directions within the opening of the height adjuster nut 466.

In one example embodiment, when the height adjuster nut 466 is rotated in a first direction, the upper bolt 462 and the lower bolt 464 move away from each other, i.e. the external threads of both bolt 462, 464 within the opening of the height adjuster nut 466 move away from each other and consequently the bolt 462, 464 separate from each other. In another example embodiment, when the height adjuster nut 466 is rotated in a second direction opposite to the first direction, the upper bolt 462 and the lower bolt 464 move toward each other, i.e. the external threads of both bolt 462, 464 within the opening of the height adjuster nut 466 move further inward into the opening of the height adjuster nut 466.

Figure 5C:
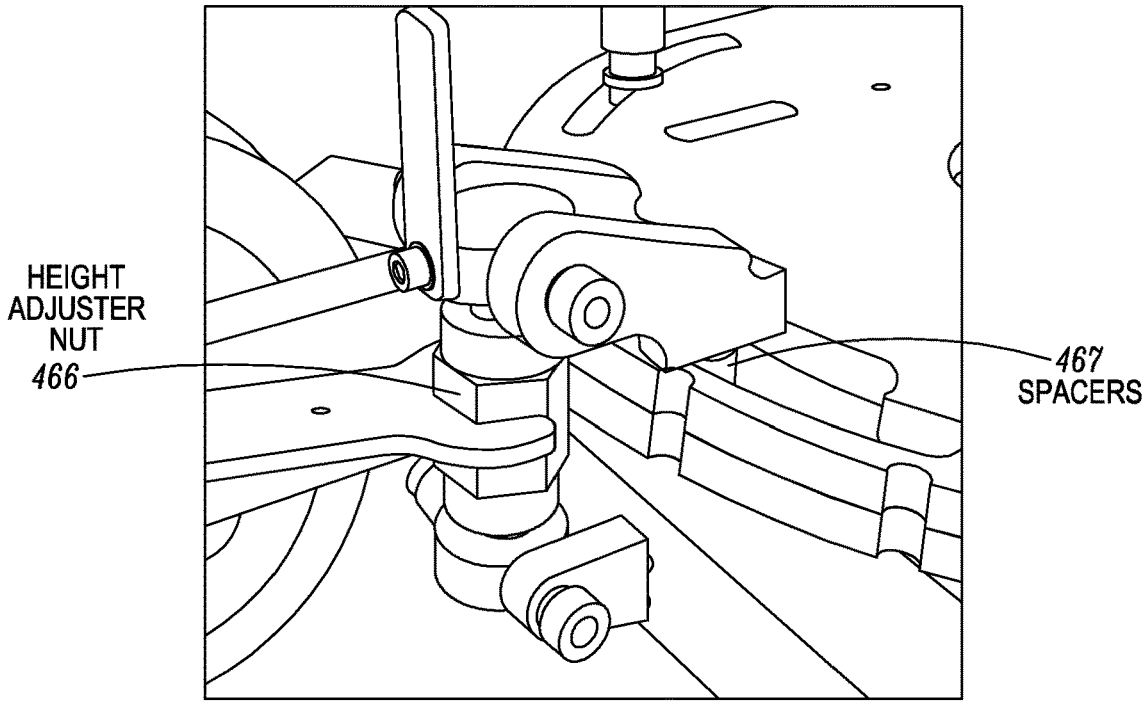
FIG. 5C is an image that illustrates an example of a perspective view of the height adjuster nut of FIG. 5B in an unlocked position, according to an embodiment.

In an example embodiment, the height adjuster nut 466 in FIG. 5B is in the locked position, so that the height adjuster nut 466 cannot be adjusted. This advantageously prevents the height adjuster nut 466 from being accidentally adjusted through operating conditions (e.g. vibrations). In one embodiment, a rotatable lock 468 is provided and is rotatably coupled to the upper bolt 462. In other embodiments, the rotatable lock 468 is rotatably coupled to the lower bolt 464. When the lock 468 is rotated to the position shown in FIG. 5B, the height adjuster nut 466 cannot be rotated. FIG. 5C is an image that illustrates an example of a perspective view of the height adjuster nut 466 of FIG. 5B in an unlocked position, according to an embodiment. In an example embodiment, the unlocked position of FIG. 5C is obtained by simply rotating the lock 468 from the locked position of FIG. 5B to the unlocked position of FIG. 5C. In the unlocked position of FIG. 5C, the height adjuster nut 466 can be rotated using various means (e.g. tool).

Figure 5D:
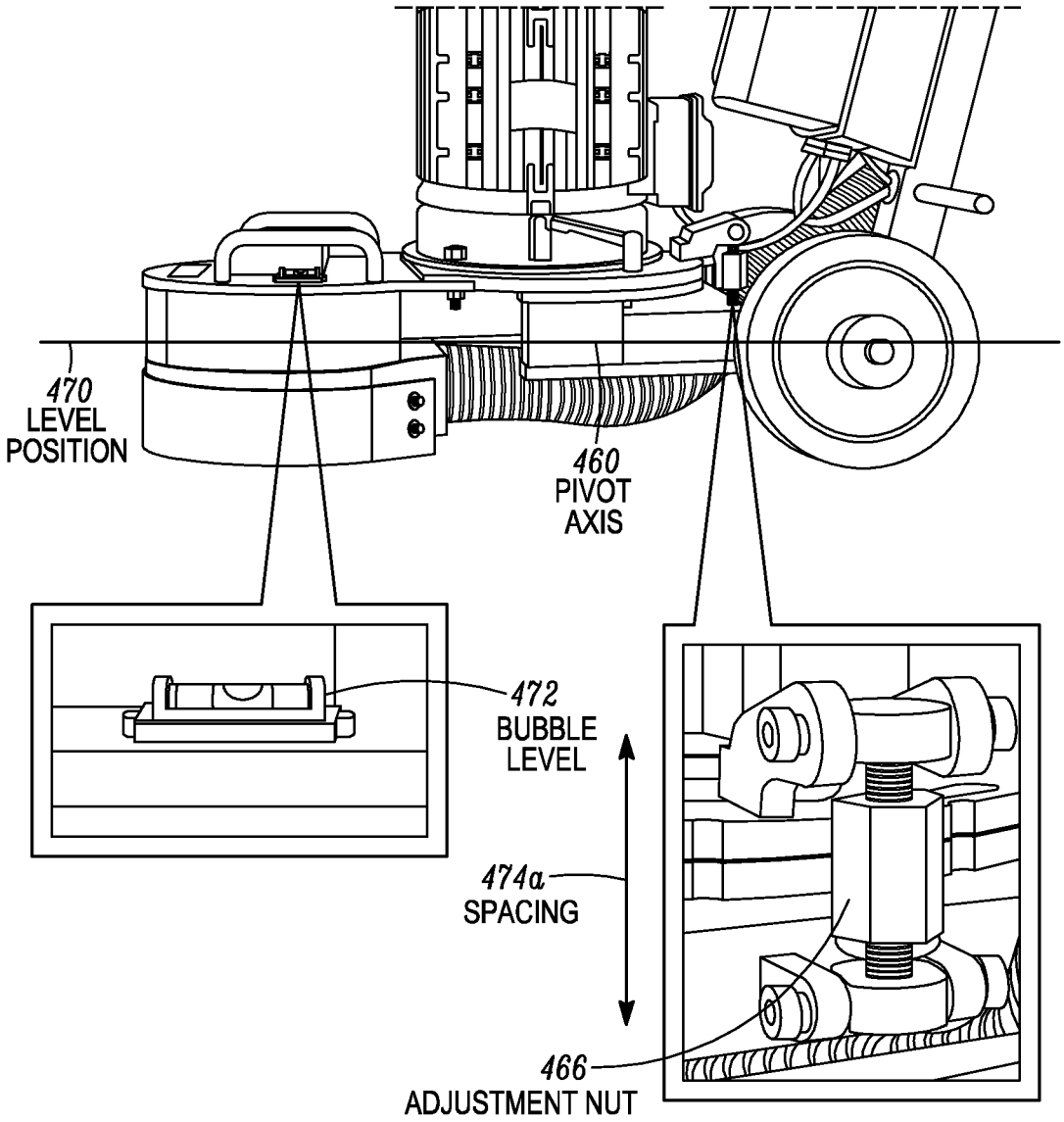
FIG. 5D is an image that illustrates an example of a side view of the apparatus of FIG. 2A in a level position, according to an embodiment.

FIG. 5D is an image that illustrates an example of a side view of the apparatus 200 of FIG. 2A in a level position 470, according to an embodiment. In one embodiment, the level position 470 is defined as a position where the machine base plate 400 is level with the floor surface. In an example embodiment, a bubble level 472 is provided on the frame 216 and indicates that the machine base plate 400 is level with the floor surface in the level position 470. As further depicted in FIG. 5D, in the level position 470, the adjustment nut 466 is arranged so that a particular spacing 474*a* is provided between the upper bolt 462 and lower bolt 464.

Figure 5E:
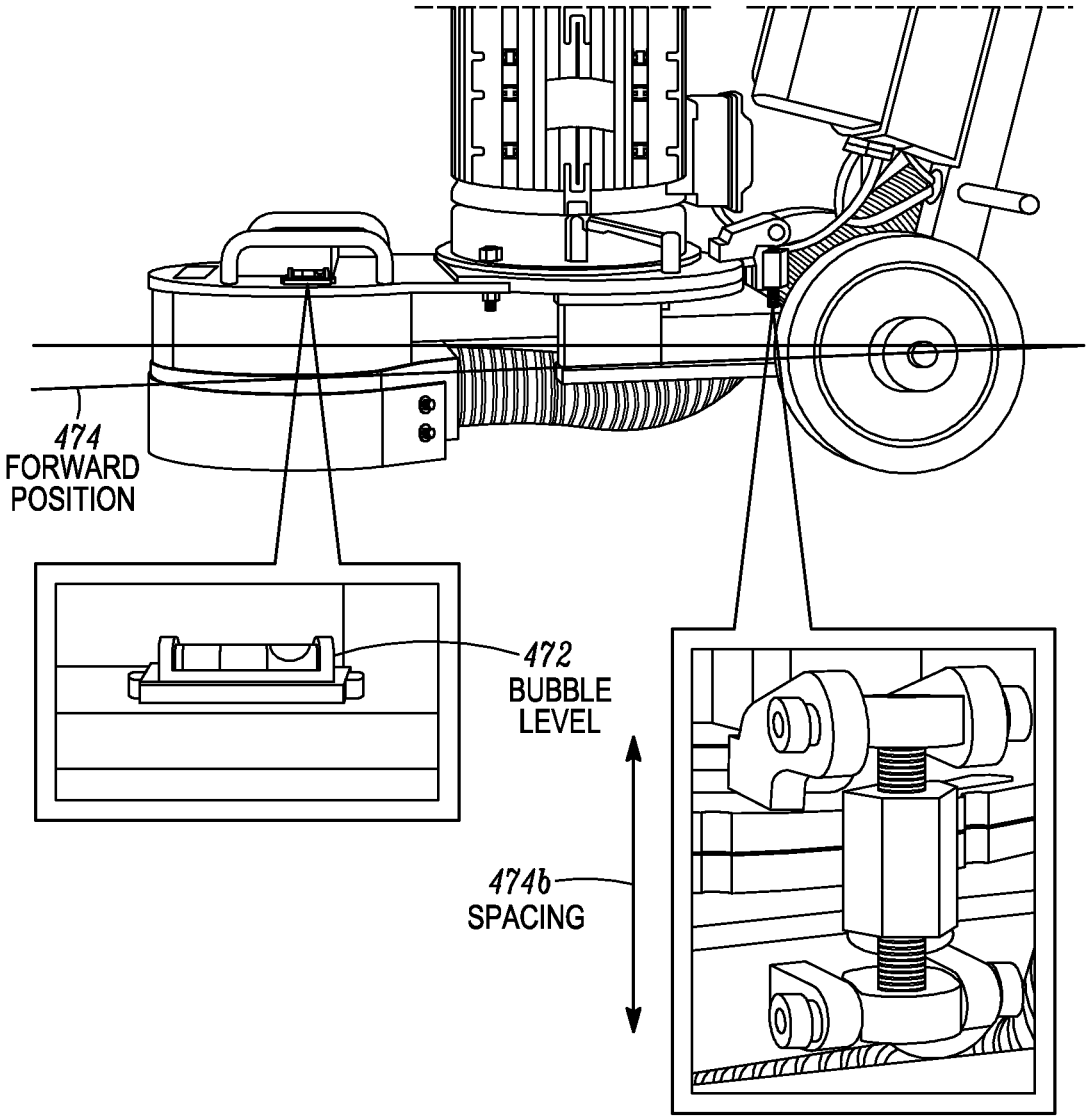
FIG. 5E is an image that illustrates an example of a side view of the apparatus of FIG. 2A in a forward position, according to an embodiment.
Figure 5F:
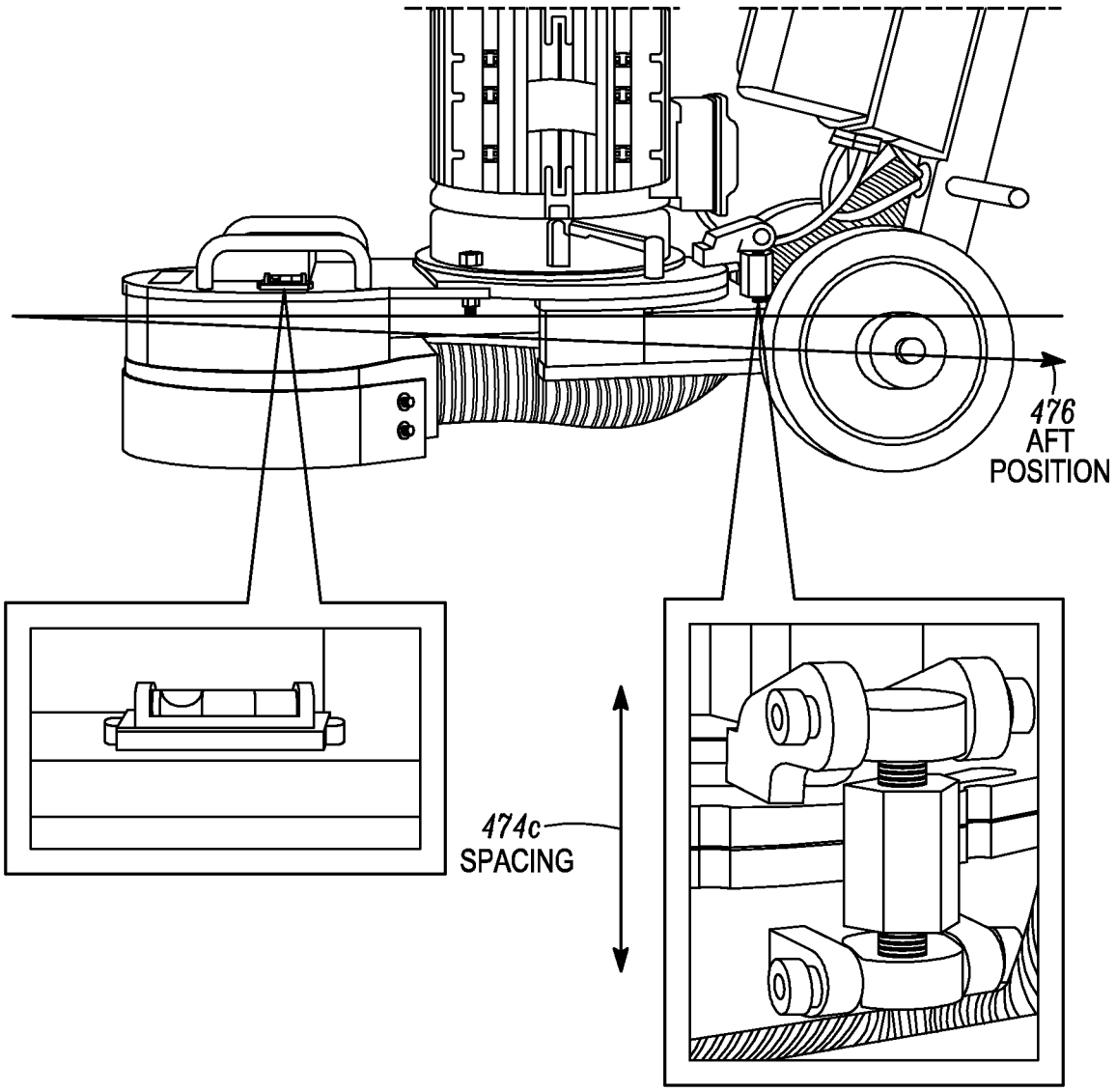
FIG. 5F is an image that illustrates an example of a side view of the apparatus of FIG. 2A in an AFT position, according to an embodiment.

Based on a thickness of a tooling plate 228 mounted on the bottom plate 226, the height adjustment nut 466 can be adjusted, to maintain the machine base plate 400 at a level position, so that the tooling plate 228 is maintained at an orientation that is parallel to the floor surface. FIGS. 5E-5F depict images that illustrate a side view of the apparatus 200 in different positions. In one example (e.g. FIG. 5E), the height adjuster nut 466 is adjusted so that a spacing 474*b* is between the upper bolt 462 and lower bolt 464, in order to maintain the machine base plate 400 at the level position. In another example (e.g. FIG. 5F), the height adjuster nut 466 is adjusted so that a spacing 474*c* is between the upper bolt 462 and lower bolt 464, in order to maintain the machine base plate 400 at the level position. As depicted in FIGS. 5E-5F, the spacings 474*b*, 474*c* of the height adjuster nut 466 are different since depending on the thickness of the tooling plate 228, the height adjuster nut 466 is adjusted to a different spacing 474, in order to maintain the machine base plate 400 at the level position, i.e. level with the floor surface. In an example embodiment, the height adjuster bolt 466 can be used to tilt the machine base plate 400 by about 5 degrees upward and about 8 degrees downward (relative to the lower frame 452). Although FIGS. 5A-5F depict embodiments employing a height adjuster nut 466 to pivot the upper frame 450 relative to the lower frame 452, the embodiments of the invention are not limited to this arrangement and include any arrangement appreciated by one of ordinary skill in the art that could be used to pivot the upper frame 450 relative to the lower frame 452. In an example embodiment, a simple motor could be coupled to the upper frame 450 and the lower frame 452 and used to pivot the upper frame 450 relative to the lower frame 452. In an example embodiment, such a motor could be any one of a hydraulic motor (e.g. hydraulic pistons) and an electric motor (e.g. servo motor).

As depicted in FIG. 5B, the upper frame 450 includes the machine base plate 400 and the swivel plate 454. In some embodiments, the machine base plate 400 can be rotated or swiveled with respect to the swivel plate 454. An advantage of this feature is that the head assembly 224 (and consequently the bottom plate 226 and tooling plate 228) can be correspondingly rotated with respect to the swivel plate 454 and also with respect to the lower frame 452. In conventional concrete grinders (FIG. 1A), the handle of the concrete grinder is typically wider than the frame 112 of the grinder and thus prevents the concrete grinder from achieving zero-tolerance edging, i.e. being pushed along the intersection of the wall 104 surface and floor 106 surface (FIG. 1B). To overcome this noted drawback, the inventors of the present invention designed the apparatus 200 with the features discussed herein. In some embodiments, the noted drawback was overcome with the introduced swivel or rotation between the machine base plate 400 and the swivel plate 454 (and lower frame 452).

Figure 5G:
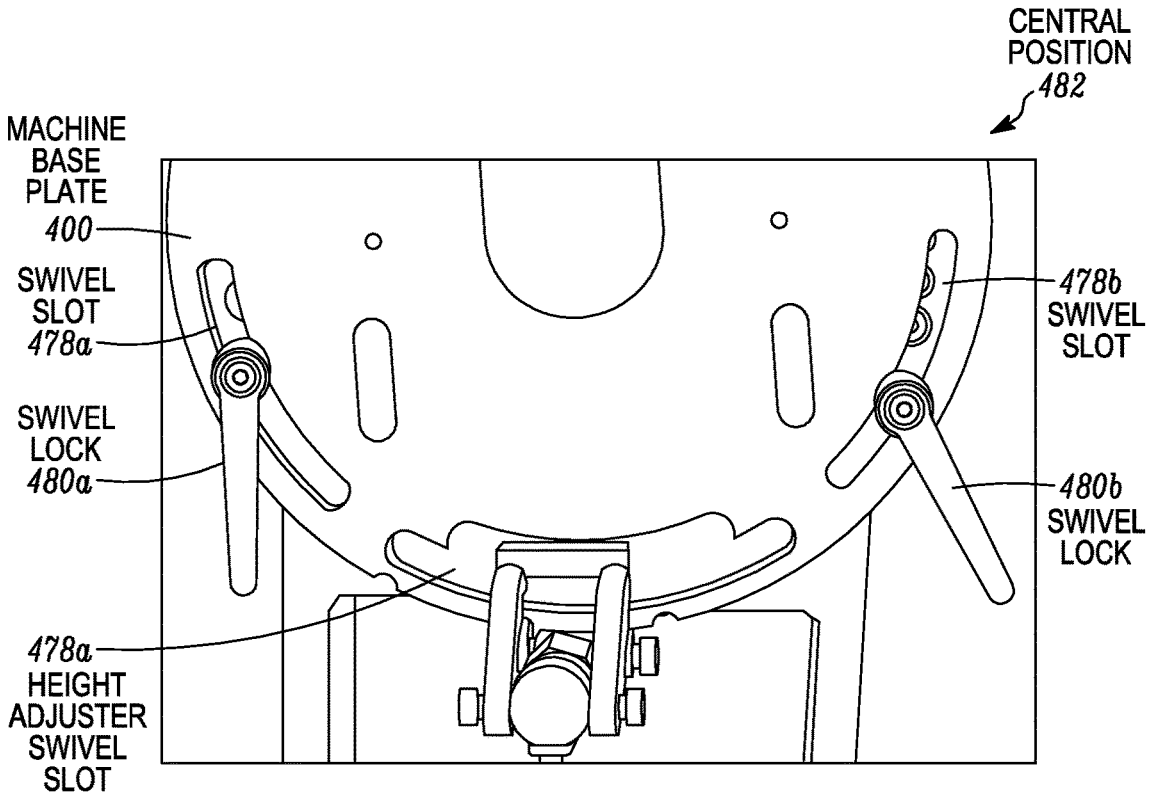
FIG. 5G is an image that illustrates an example of a top view of the upper frame in a central position relative to the lower frame of FIG. 5A, according to an embodiment.

FIG. 5G is an image that illustrates an example of a top view of the upper frame 450 in a central position 482 relative to the lower frame 452 of FIG. 5A, according to an embodiment. In one embodiment, the central position 482 is a position defined by an alignment between the machine base plate 400 and the lower frame 452 of the apparatus 200. In the central position 482, the head assembly 224 and bottom plate 226 are aligned with the lower frame 452 of the apparatus 200. In one embodiment, the machine base plate 400 includes a plurality of slots including a height adjuster swivel slot 478*a* in which the height adjuster top mount assembly 463 is mounted to the swivel plate 454 using spacers 467 (FIGS. 5B-5C). Additionally, in one embodiment, the machine base plate 400 includes swivel slots 478*a*, 478*b* and swivel locks 480*a*, 480*b* respectively positioned in the swivel slots 478*a*, 478*b*. To rotate the machine base plate 400 relative to the swivel plate 454 and lower frame 452, the swivel locks 480*a*, 480*b* are first unlocked. In an example embodiment, the swivel locks 480*a*, 480*b* are unlocked by rotating the swivel locks 480*a*, 480*b* in a first direction (e.g. counterclockwise direction). Once the swivel locks 480*a*, 480*b* are unlocked, the machine base plate 400 is rotated relative to the swivel plate 454 until a desired pivot position 484 is obtained.

Figure 5H:
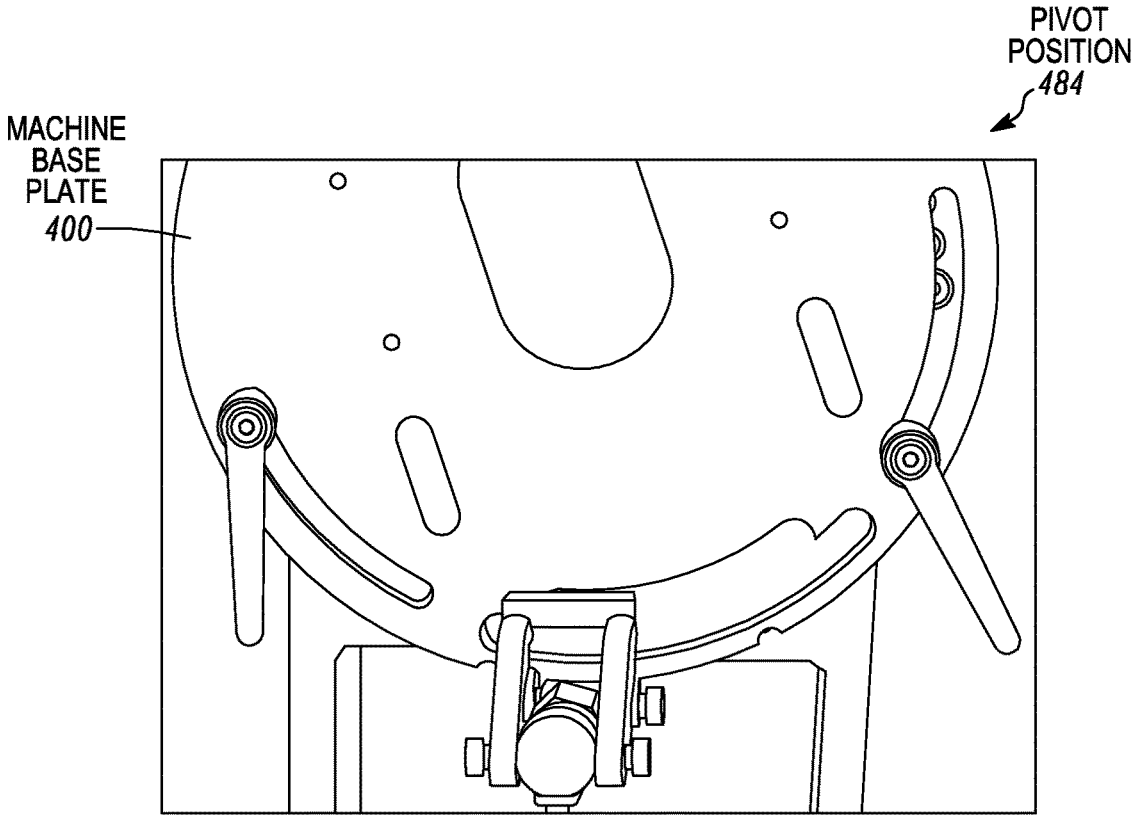
FIG. 5H is an image that illustrates an example of a top view of the upper frame in a pivot position relative to the lower frame of FIG. 5A, according to an embodiment.

FIG. 5H is an image that illustrates an example of a top view of the upper frame 450 in a pivot position 484 relative to the lower frame 452 of FIG. 5A, according to an embodiment. In the embodiment of FIG. 5H, the pivot position 484 is a maximum pivot position between the machine base plate 400 and the swivel plate 454. In an example embodiment, the maximum pivot position is obtained when the swivel locks 480*a*, 480*b* have shifted to a maximum position within the swivel slots 478*a*, 478*b*. In an example embodiment, an angle between the central position 482 and the pivot position 484 is in a range of about ±20 degrees. Although FIG. 5H depicts a maximum pivot position, the machine base plate 400 can be rotated to and locked at any pivot position between the central position 482 and the pivot position 484, depending on the particular needs of a project. After rotating the machine base plate 400 to the pivot position 484, the swivel locks 480*a*, 480*b* are locked (e.g. turning in clockwise direction until tight) to fix the machine base plate 400 in the pivot position 484. In an example embodiment, in the pivot position 484, the machine base plate 400 and bottom plate 226 are oriented at an angle (e.g. 20 degrees) that is offset from the lower frame 452.

Figure 5I:
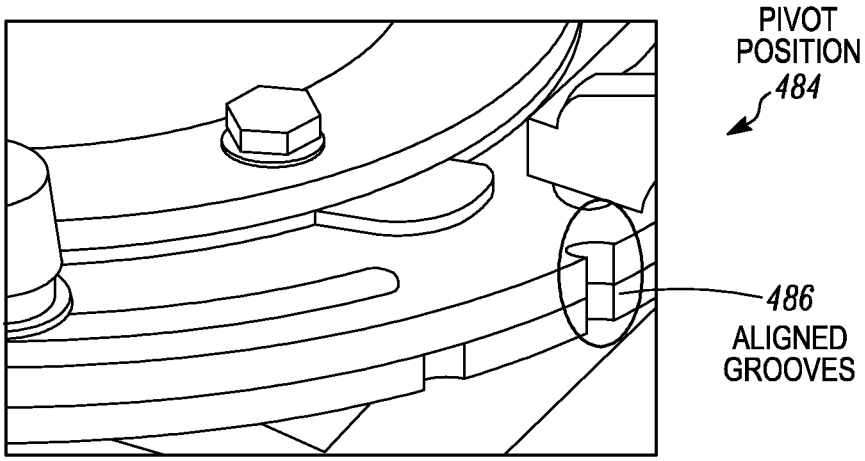
FIG. 5I is an image that illustrates an example of a perspective view of aligned grooves in the base plate and swivel plate in the pivot position of FIG. 5H, according to an embodiment.
Figure 5J:
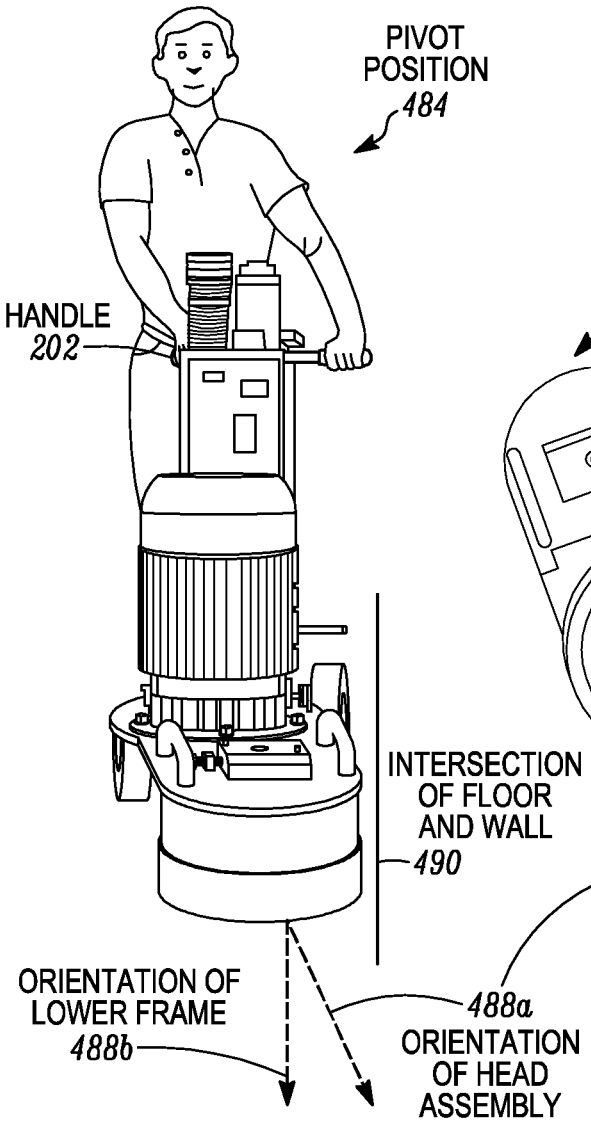
FIG. 5J is an image that illustrates an example of a front view of the apparatus of FIG. 2A with the upper frame in the pivot position, according to an embodiment.
Figure 5K:
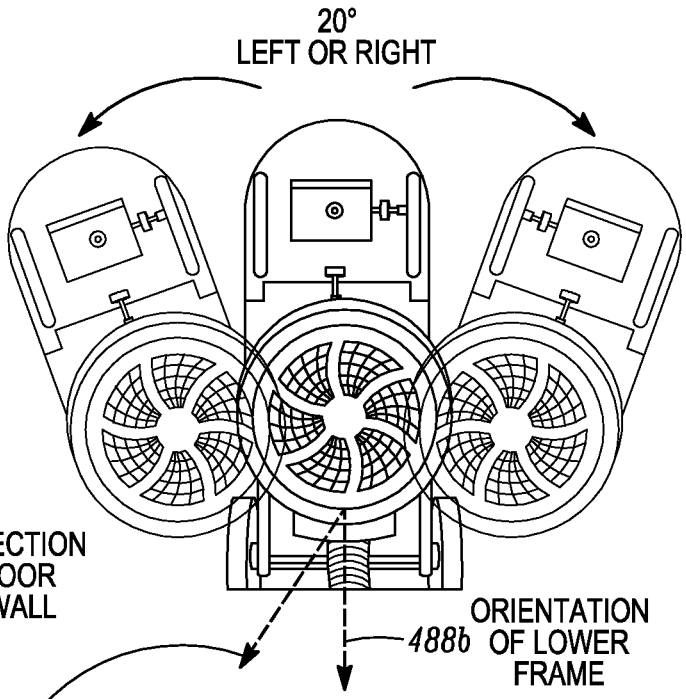
FIG. 5K is an image that illustrates an example of a top view of the apparatus of FIG. 2A with the upper frame in the pivot position, according to an embodiment.

FIG. 5J is an image that illustrates an example of a front view of the apparatus 200 of FIG. 2A with the upper frame 450 in the pivot position 484, according to an embodiment. In one embodiment, when the upper frame 450 is positioned in the pivot position 484, an orientation 488*b* of the lower frame 452 is about parallel with an intersection 490 of the wall and floor and thus the path of travel (e.g. path of wheels 214) of the apparatus 200 is about parallel with the intersection 490. Additionally, as depicted in FIG. 5J, an orientation 488*a* of the machine base plate 400 (and head assembly 224) is oriented inward toward the intersection 490 and inward toward the wall surface. By orienting the head assembly 224 toward the intersection 490 of the floor and wall surfaces, positioning the head assembly 224 over the intersection 490 and orienting the path of travel along the intersection 490, zero-tolerance edging of the floor surface is achieved, while the user pushes the apparatus 200 along a path that is parallel to the intersection 490 and parallel to the wall 104 surface. FIG. 5K is an image that illustrates an example of a top view of the apparatus 200 of FIG. 2A with the upper frame 450 in the pivot position 484, according to an embodiment. In one embodiment, the top view of FIG. 5K depicts the range of angles over which the machine base plate 400 can be rotated. In some embodiments of the apparatus 200, no swivel plate 454 is provided and thus the machine base plate 400 is not rotatable with respect to the swivel plate 454. In these embodiments, the height adjuster top mount assembly 463 is mounted to the machine base plate 400.

FIG. 5I is an image that illustrates an example of a perspective view of aligned grooves 486 in the base plate 400 and swivel plate 454 in the pivot position 484 of FIG. 5H, according to an embodiment. In one embodiment, the base plate 400 and swivel plate 454 each include one or more spaced grooves 486. In the central position 482, each groove 486 of the base plate 400 is aligned with a groove 486 of the swivel plate 454. In the pivot position 484, one or more grooves 486 of the base plate 400 are aligned with a groove 486 of the swivel plate 454. In an example embodiment, where the base plate 400 and swivel plate 454 are each provided with four spaced apart grooves 486, all four grooves 486 are aligned in the central position 482 and two of the four grooves 486 are aligned in the pivot position 484.

Figure 6A:
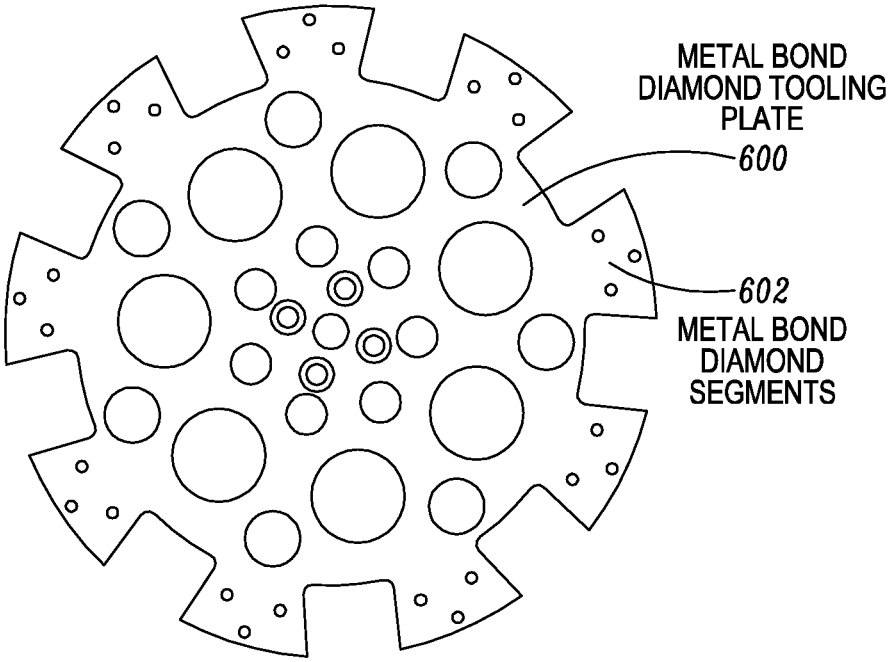
FIG. 6A is an image that illustrates an example of a front view of a metal bond diamond tooling plate, according to an embodiment.

FIG. 6A is an image that illustrates an example of a front view of a metal bond diamond tooling plate 600, according to an embodiment. In one embodiment, the metal bond diamond tooling plate 600 includes one or more metal bond diamond segments 602. In some embodiments, the metal bond diamond segments 602 are similar to the tooling 229 discussed previously above. In an example embodiment, the tooling plate 600 has different diameters (e.g. 12 inch, 20 inch) and includes a plurality of circumferentially located trapezoidal tooling segments 602 for accepting metal bond tooling.

Figure 6B:
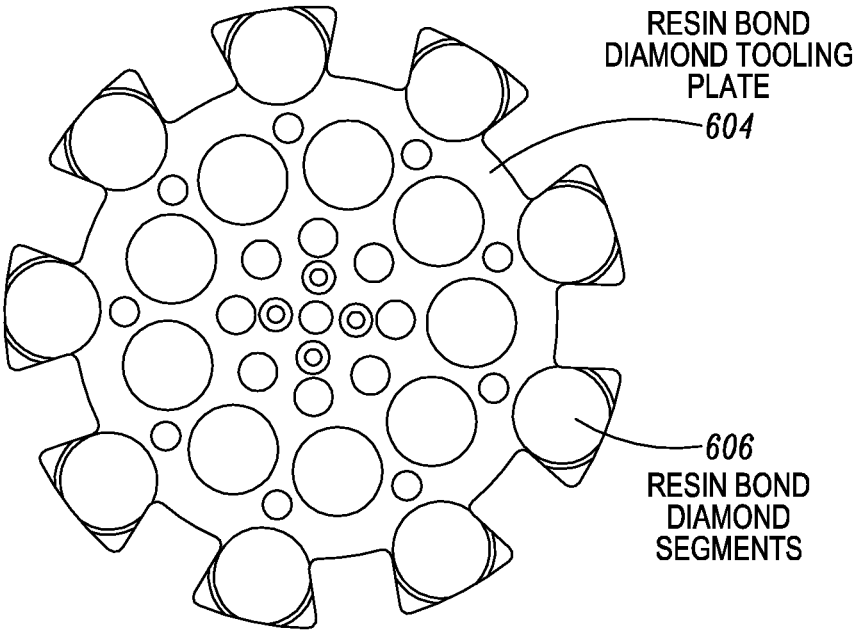
FIG. 6B is an image that illustrates an example of a front view of a resin bond diamond tooling plate, according to an embodiment.

FIG. 6B is an image that illustrates an example of a front view of a resin bond diamond tooling plate 604, according to an embodiment. In some embodiments, the resin bond diamond tooling plate 604 includes one or more resin bond diamond segments 606.

In an example embodiment, each tooling plate 600, 602 (e.g. 12 inch or 20 inch) comprises a plurality of circumferentially located trapezoidal tooling segments for accepting metal bond tooling or a plurality of circumferentially located round cavities for accepting resin bond tooling that each carry a grinding or polishing surface. Concrete grinding refers to a method that uses a machine equipped with metal bond diamonds for grinding the concrete floor, beginning with a lower grit diamond and working toward higher grit diamond to smooth and tighten the concrete floor. Concrete polishing continues from the last highest grit metal bond diamond that was used and involves tooling made from resin bond diamonds. The difference between metal and resin bond tooling is that the diamonds in the metal bond are held together in a matrix composed of an assortment of metal elements such as copper, tin, iron, etc. and diamonds in the resin bond are held together in a matrix composed of resin material. Concrete polishing is a process by which the floor is honed from a low grit to as high a grit as desired to produce an extremely smooth floor that if so desired can shine like a mirror as higher resin diamond grits are used.

Figure 6C:
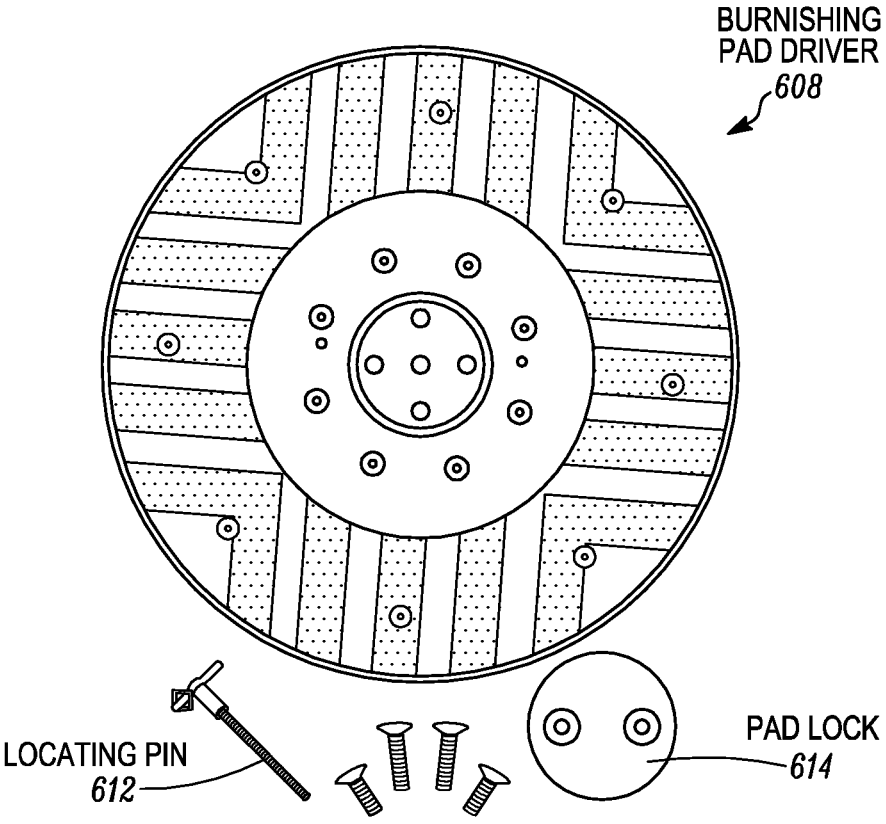
FIG. 6C is an image that illustrates an example of a front view of a burnishing pad driver, according to an embodiment.
Figure 6D:
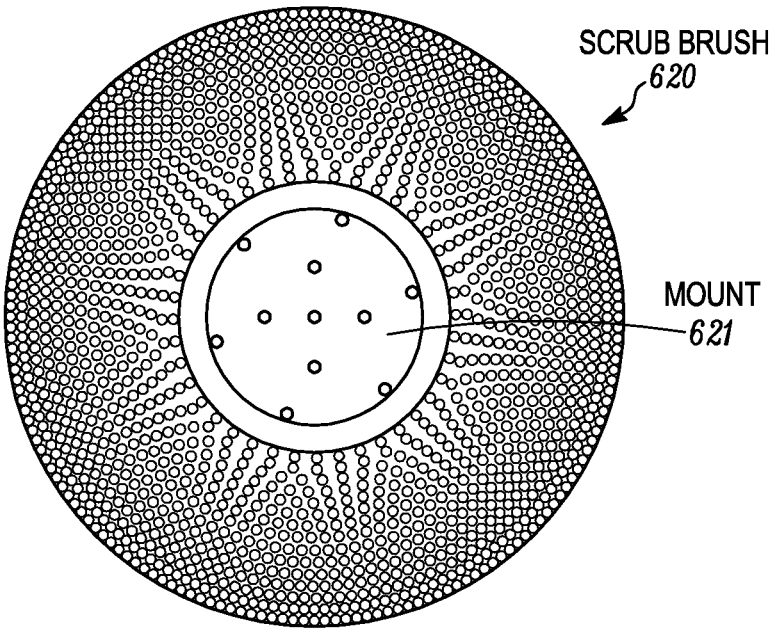
FIG. 6D is an image that illustrates an example of a front view of a scrub brush, according to an embodiment.
Figure 6E:
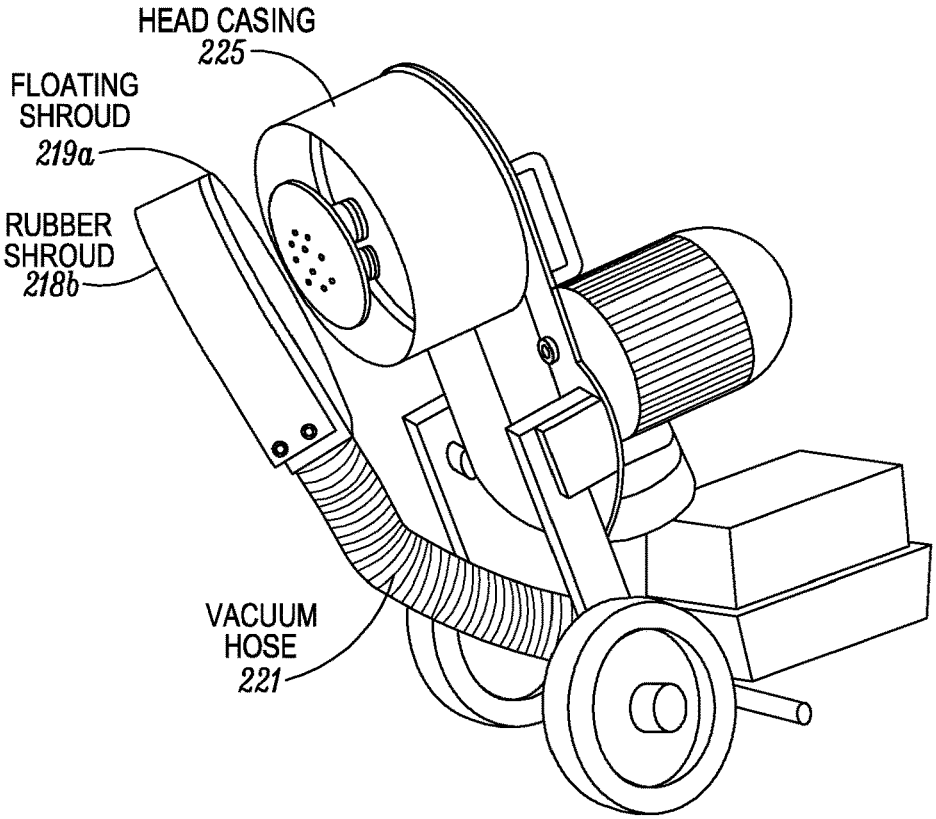
FIG. 6E is an image that illustrates an example of a perspective view of installing a shroud with a first diameter on the apparatus of FIG. 2A, according to an embodiment.
Figure 6F:
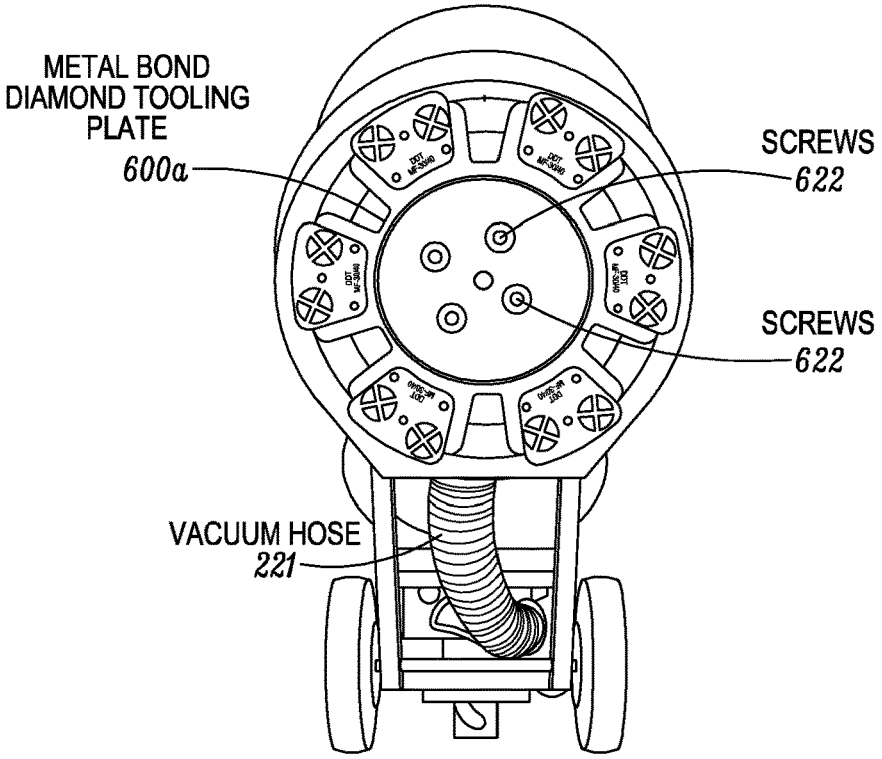
FIG. 6F is an image that illustrates an example of a front view of a diamond tooling plate of a first diameter mounted to the bottom plate of the apparatus of FIG. 2A, according to an embodiment.
Figure 6G:
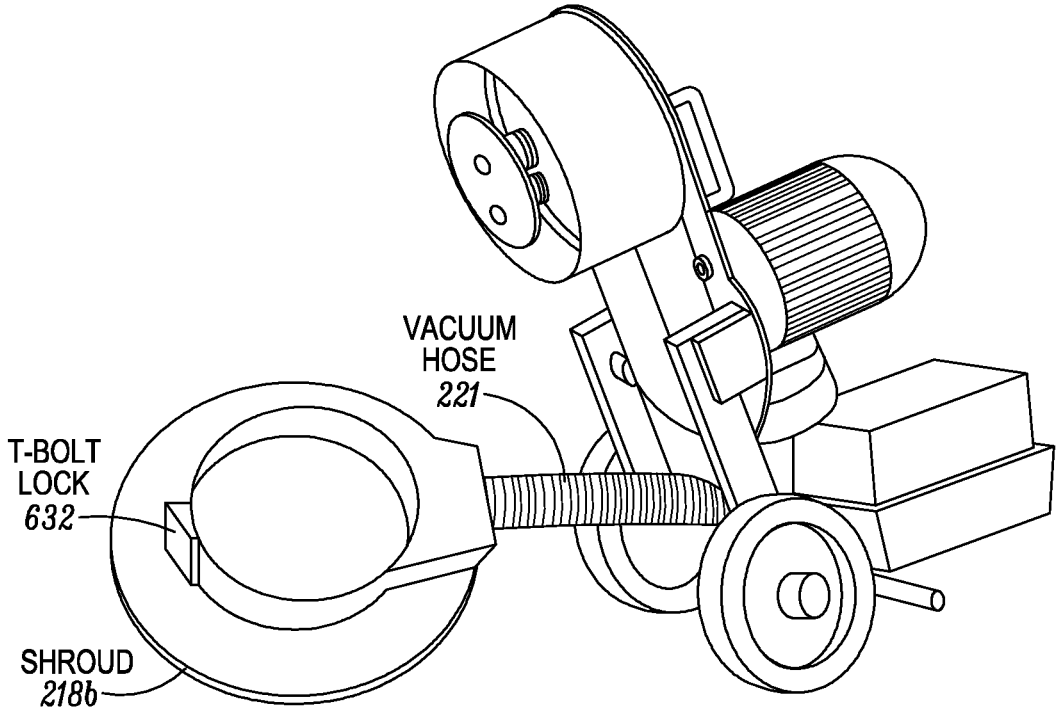
FIG. 6G is an image that illustrates an example of a perspective view of installing a shroud with a second diameter on the apparatus of FIG. 2A, according to an embodiment.
Figure 6H:
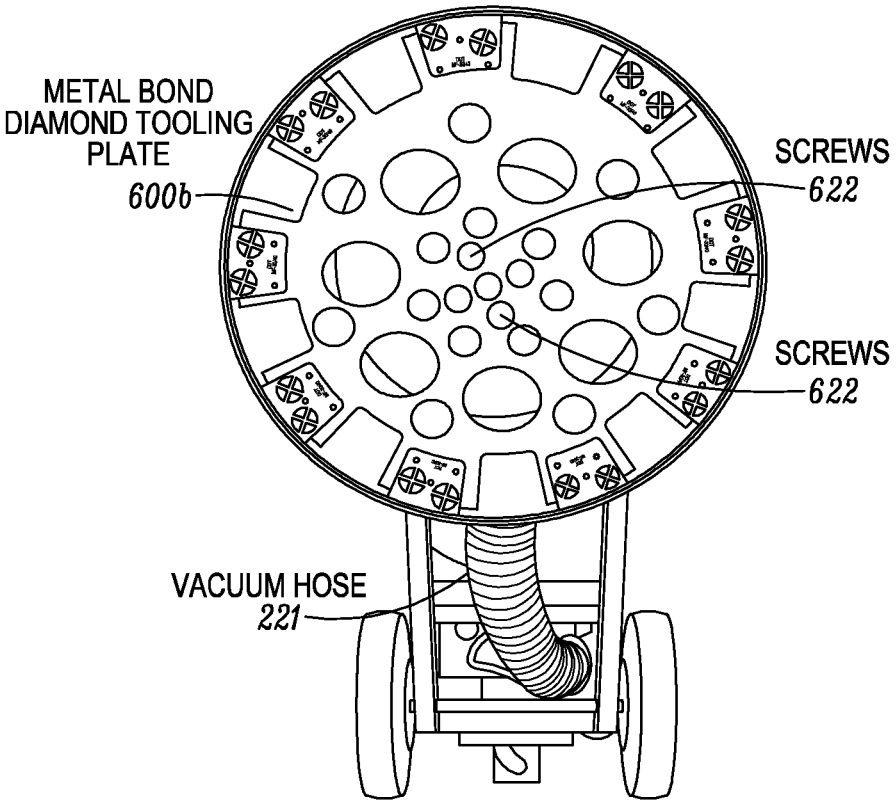
FIG. 6H is an image that illustrates an example of a front view of a diamond tooling plate of a second diameter mounted to the bottom plate of the apparatus of FIG. 2A, according to an embodiment.
Figure 6I:
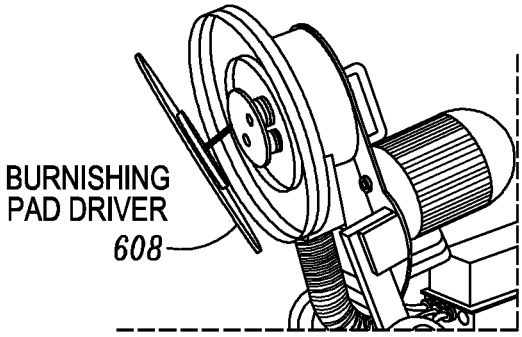
FIG. 6I is an image that illustrates an example of a side view of securing the burnishing pad driver to the bottom plate of the apparatus of FIG. 2A, according to an embodiment.
Figure 6J:
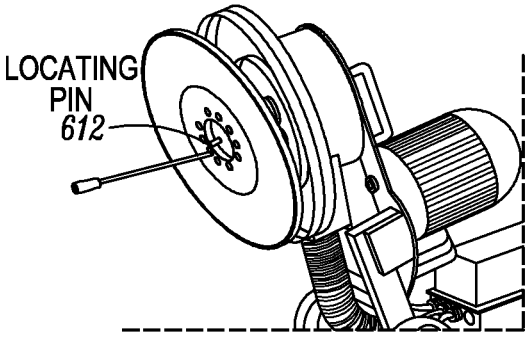
FIG. 6J is an image that illustrates an example of a side view of securing the burnishing pad driver to the bottom plate of the apparatus of FIG. 2A, according to an embodiment.
Figure 6K:
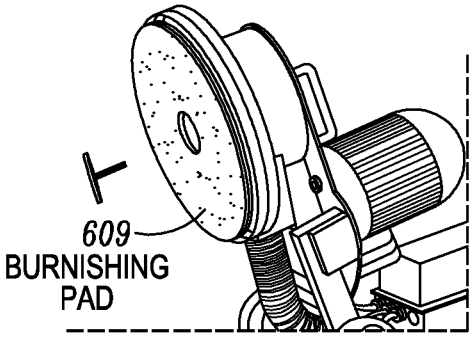
FIG. 6K is an image that illustrates an example of a side view of securing a burnishing pad to the bottom plate of the apparatus of FIG. 2A, according to an embodiment.
Figure 6L:
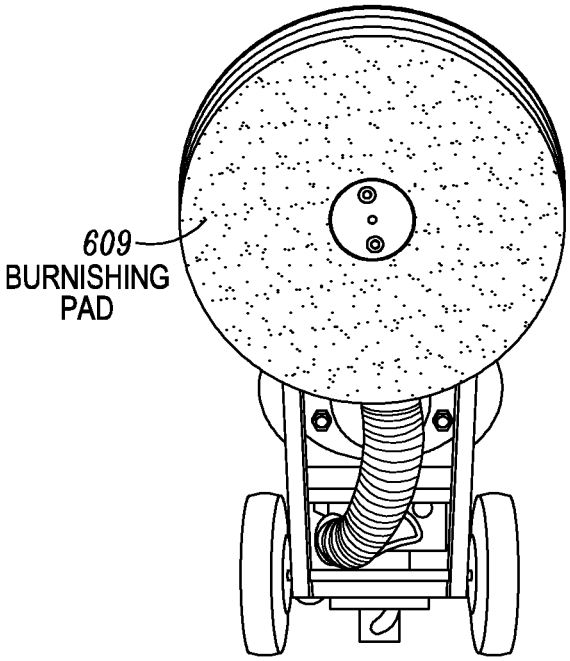
FIG. 6L is an image that illustrates an example of a side view of securing a burnishing pad to the bottom plate of the apparatus of FIG. 2A, according to an embodiment.
Figure 6M:
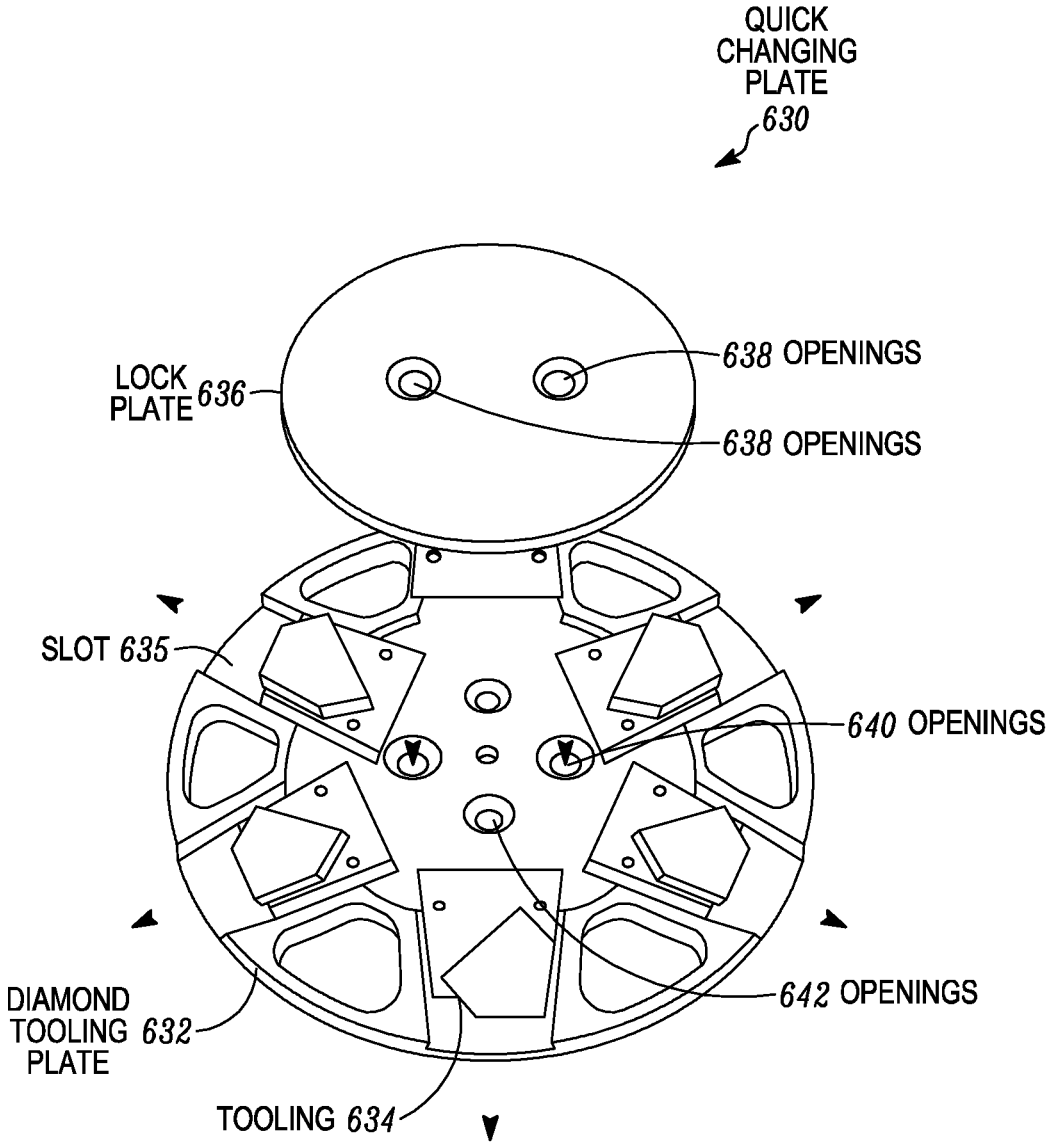
FIG. 6M is an image that illustrates an example of an exploded view of a quick change tooling plate, according to an embodiment.

FIG. 6M is an image that illustrates an example of an exploded view of a quick change tooling plate 630, according to an embodiment. In some embodiments, the quick change tooling plate 630 is similar to the tooling plate 228, but does not require screws to mount the tooling 634 to the diamond tooling plate 632. Instead, the tooling 634 is slid into respective slots 635. A lock plate 636 is provided and positioned within an interior of the quick change plate 630 such that an outer surface of the lock plate 636 abuts an inner surface of the tooling 634, thereby maintaining the tooling 634 in each slot 635. In an embodiment, the quick change plate 630 is particularly advantageous for use in the apparatus 200, where zero-tolerance edging is possible along an edge of a floor surface that intersects with a wall surface. The inventors of the present invention recognized that during zero-tolerance edging, contact between the wall surface and an outer surface of the tooling 634 (that extend beyond the shroud) will likely occur. In order to ensure that the tooling 634 are fixed in the slots 635 and are not dislodged during such contact, the lock plate 636 was introduced, which abuts the inner surface of the tooling 634 and thus keeps the tooling 634 within the respective slot 635. To mount the quick change plate 630 to the bottom plate 226, a pair of screws are passed through a first pair of openings 642 in the diamond tooling plate 632 and into a pair of openings in the bottom plate 226. This secures the diamond tooling plate 632 to the bottom plate 226. The lock plate 636 is then positioned within the interior of the diamond tooling plate 632. A pair of screws are passed through aligned openings 638 of the lock plate 636 and openings 640 in the diamond tooling plate 632 and into a pair of openings in the bottom plate 226.

FIG. 6C is an image that illustrates an example of a front view of a burnishing pad driver 608, according to an embodiment. Additionally, other equipment is depicted that is used to mount the burnishing pad driver 608 onto the bottom plate 226 including a locating pin 612 and a pad lock 614. The burnishing process utilizes burnishing pads that for the most part help remove wax or other similar chemicals from a floor using a stripping pad or similar pad and in turn reapply the wax or other chemicals using a variety of burnishing pads, by melting the material into the floor using a burnishing pad that rotates at high speed thereby creating heat and melting and driving the material into the tiny pores of the concrete floor. Burnishing pads are also available with various diamond grits impregnated into the pad which at times can remove some of the resin bond diamond polishing process or bring back to life a polished concrete floor that has lost its shine.

FIG. 6D is an image that illustrates an example of a front view of a scrub brush 620, according to an embodiment. In some embodiments, the scrub brush 620 includes any type of scrub brush appreciated by one of ordinary skill in the art, including scrub brushes manufactured by Malish® US of Mentor, Ohio. However, the scrub brush 620 need not be from any particular manufacturer. Additionally, the scrub brush 620 includes a mount 621 with a plurality of openings that correspond to the openings in the bottom plate 226. In some embodiments, scrub brushes provided by manufacturers are retrofitted with the mount 621 that is customized to align with the openings of the bottom plate 226 of the apparatus 200. In an example embodiment, any of the tooling plates 600, 602, burnishing pad driver 608 or scrub brush 620 can be mounted on the bottom plate 226 and thus the apparatus 200 can be used as a versatile all-in-one grinder, polisher, burnisher and zero-tolerance edger.

In order to install a burnishing pad 609 onto the bottom plate 226 and convert the apparatus 200 into a burnisher, the following steps are performed. In one embodiment, if one of the tooling plates 600, 602 is mounted on the bottom plate 226, the screws that mount the tooling plate 600, 602 to the bottom plate 226 are initially unscrewed so that the tooling plate 600, 602 is removed from the bottom plate 226. FIG. 6I is an image that illustrates an example of a side view of securing the burnishing pad driver 608 to the bottom plate 226 of the apparatus 200 of FIG. 2A, according to an embodiment. FIG. 6J is an image that illustrates an example of a side view of securing the burnishing pad driver 608 to the bottom plate 226 of the apparatus 200 of FIG. 2A, according to an embodiment. As depicted in FIGS. 6I-6J, a first step in securing the burnishing pad driver 608 to the bottom plate 226 is securing the locating pin 612 through a central opening in the burnishing pad driver 608 and into an opening in the bottom plate 226. This advantageously holds the burnishing pad driver 608 (hands-free) on the bottom plate 226 as the user secures the burnishing pad driver 608 to the bottom plate 226 with additional screws. In an example embodiment, two screws (e.g. M12×1.75×25 screws) are secured through openings in the burnishing pad driver 608 and into holes in the bottom plate 226 using a tool (e.g. 8 mm Allen wrench). This secures the burnishing pad driver 608 to the bottom plate 226.

FIG. 6K is an image that illustrates an example of a side view of securing a burnishing pad 609 to the bottom plate 226 of the apparatus 200 of FIG. 2A, according to an embodiment. In this step, the burnishing pad 609 is positioned over the burnishing pad driver 608 and two screws (e.g. M12×. 1.75×50 screws) are secured through openings in the openings in the pad lock 614 and into the bottom plate 226 using a tool (e.g. 8 mm Allen wrench). This secures the burnishing pad 609 to the bottom plate 226 and thus converts the apparatus 200 into a burnisher. FIG. 6L is an image that illustrates an example of a side view of securing a burnishing pad 609 to the bottom plate 226 of the apparatus 200 of FIG. 2A, according to an embodiment.

In one embodiment, a diamond tooling plate 600*a* of a first diameter (e.g. 12") can be replaced with a diamond tooling plate 600*b* of a second larger diameter (e.g. 20"), so to convert the apparatus 200 to a larger diameter grinder. Additionally, a diamond tooling plate 600*b* of a second diameter can be replaced with a diamond tooling plate 600*a* of a first smaller diameter, so to convert the apparatus 200 to a smaller diameter grinder.

FIG. 6E is an image that illustrates an example of a perspective view of installing a rubber shroud 218*a* and floating shroud 219*a* with a first diameter on the apparatus 200 of FIG. 2A, according to an embodiment. As previously discussed, the rubber shroud 218*a* is secured around a perimeter of the floating shroud 219*a* by securing each side of the rubber shroud 218*a* on shroud pins on each side of the floating shroud 219*a*. Additionally, a vacuum hose 221 outlet is secured to a dust port inlet on the floating shroud 219*a*. The floating shroud 219*a* is then placed over the head casing 225. FIG. 6F is an image that illustrates an example of a front view of a diamond tooling plate 600*a* of a first diameter mounted to the bottom plate 226 of the apparatus 200 of FIG. 2A, according to an embodiment. In an example embodiment, the diamond tooling plate 600*a* is mounted to the bottom plate 226 by screwing four screws (e.g. M12×1.75×25) through the diamond tooling plate 600*a* and into four holes in the bottom plate 226.

To replace the diamond tooling plate 600*a* of the first diameter with the diamond tooling plate 600*b* of a larger second diameter, the diamond tooling plate 600*a* is first dismounted from the bottom plate 226, by unscrewing the four screws. The floating shroud 219*a* and rubber shroud 218*a* are then removed from the head casing 225 and the vacuum hose inlet 221 is detached from the dust port inlet of the floating shroud 219*a*. FIG. 6G is an image that illustrates an example of a perspective view of installing a shroud 218*b* with a second diameter on the apparatus 200 of FIG. 2A, according to an embodiment. To install the shroud on the head casing 225, the vacuum hose 221 is first attached to a dust port outlet on the shroud 218*b*. The shroud 218*b* is then positioned over the head casing 225. The shroud 218*b* is then secured around the head casing 225 using a T-bolt lock 632. FIG. 6H is an image that illustrates an example of a front view of a diamond tooling plate 600*b* of a second diameter mounted to the bottom plate 226 of the apparatus 200 of FIG. 2A, according to an embodiment. In an example embodiment, the diamond tooling plate 600*b* is mounted to the bottom plate 226 by screwing four screws (e.g. M12×1.75×25) through the diamond tooling plate 600*b* and into four holes in the bottom plate 226.

Figure 7:
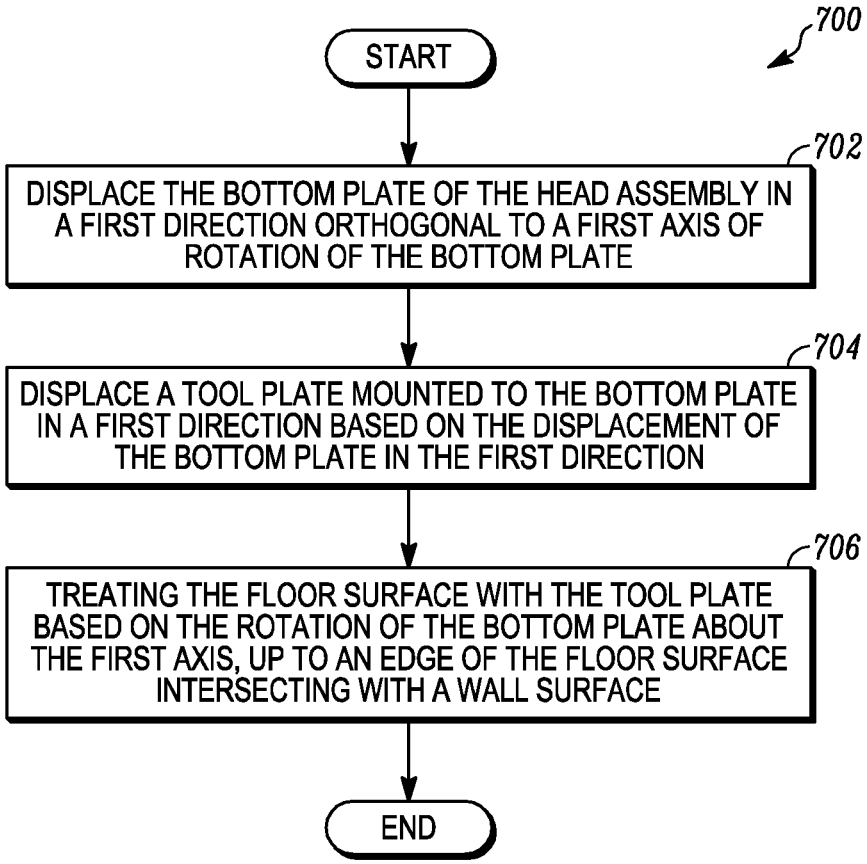
FIG. 7 is a flow diagram that illustrates an example of a method for treating a floor surface, according to an embodiment.

FIG. 7 is a flow diagram that illustrates an example of a method 700 for treating a floor surface using the apparatus 200. In step 702, the bottom plate 226 of the head assembly 224 is displaced in the first direction 230. In step 704, the tool plate 228 mounted to the bottom plate 226 is also displaced in the first direction 230 based on the displacement of the bottom plate 226 in the first direction 230. In step 706, the floor surface is treated with the tool plate 228 based on rotation of the bottom plate 226, where the floor surface is treated up to an edge of the floor surface intersecting with the wall surface. In some embodiments, steps 702, 704 may be omitted.

Figure 8A:
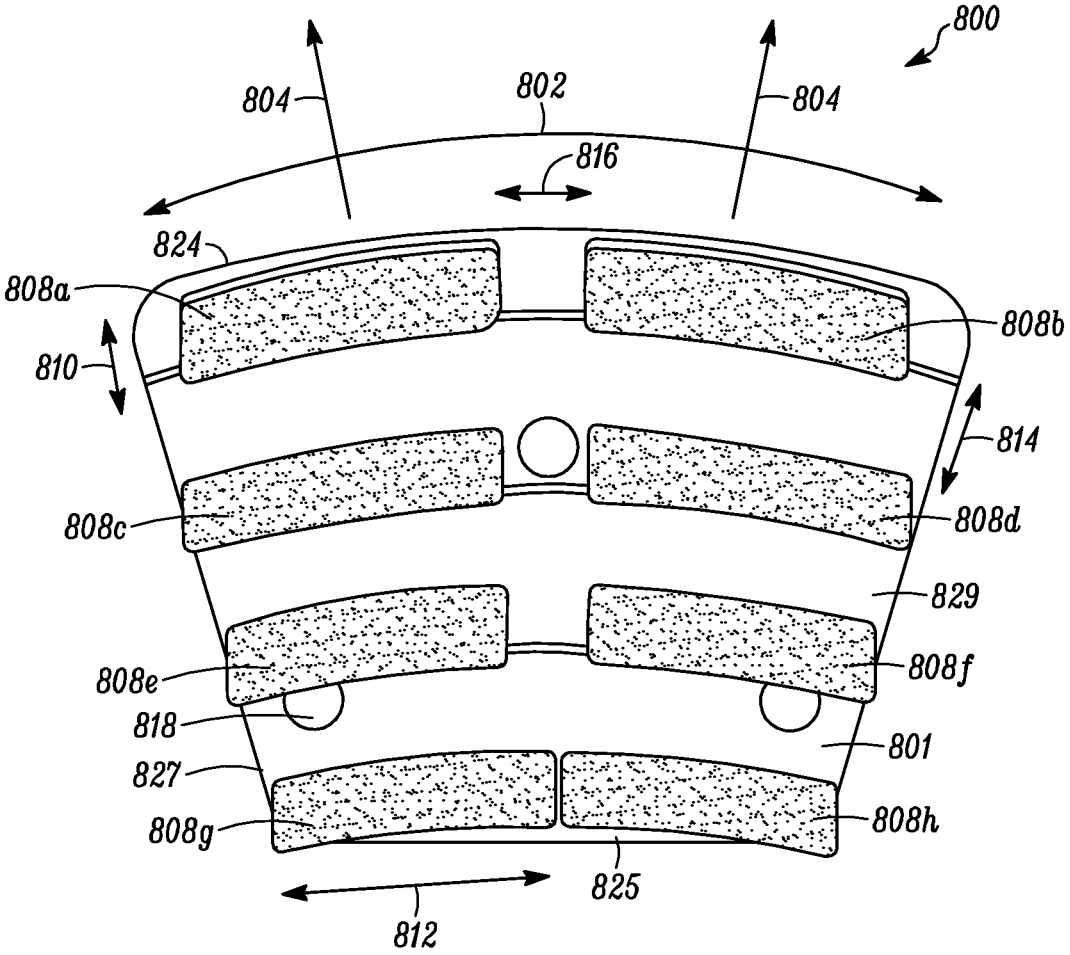
FIGS. 8A-8C are images that illustrates an example of a front view of different tooling for a diamond tooling plate, according to an embodiment.
Figure 8B:
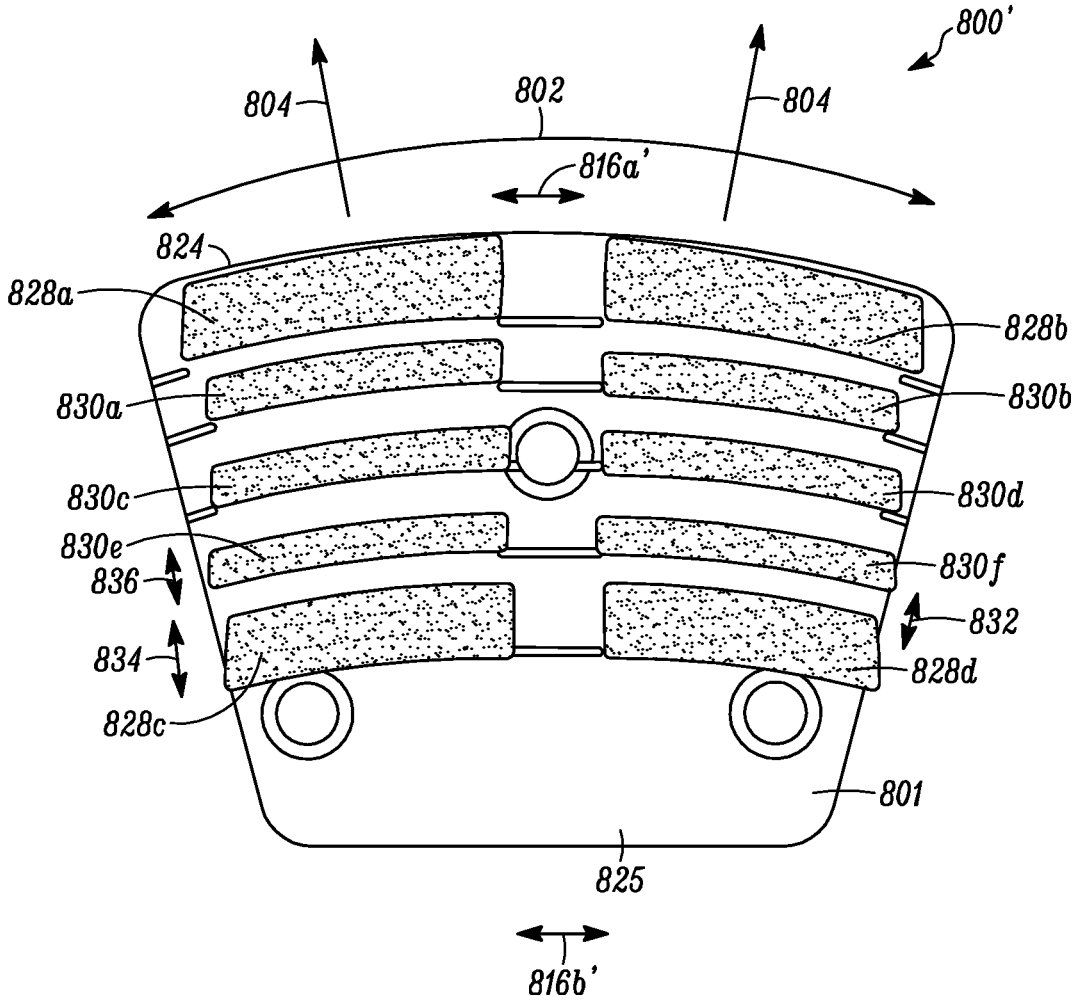
Figure 8C:
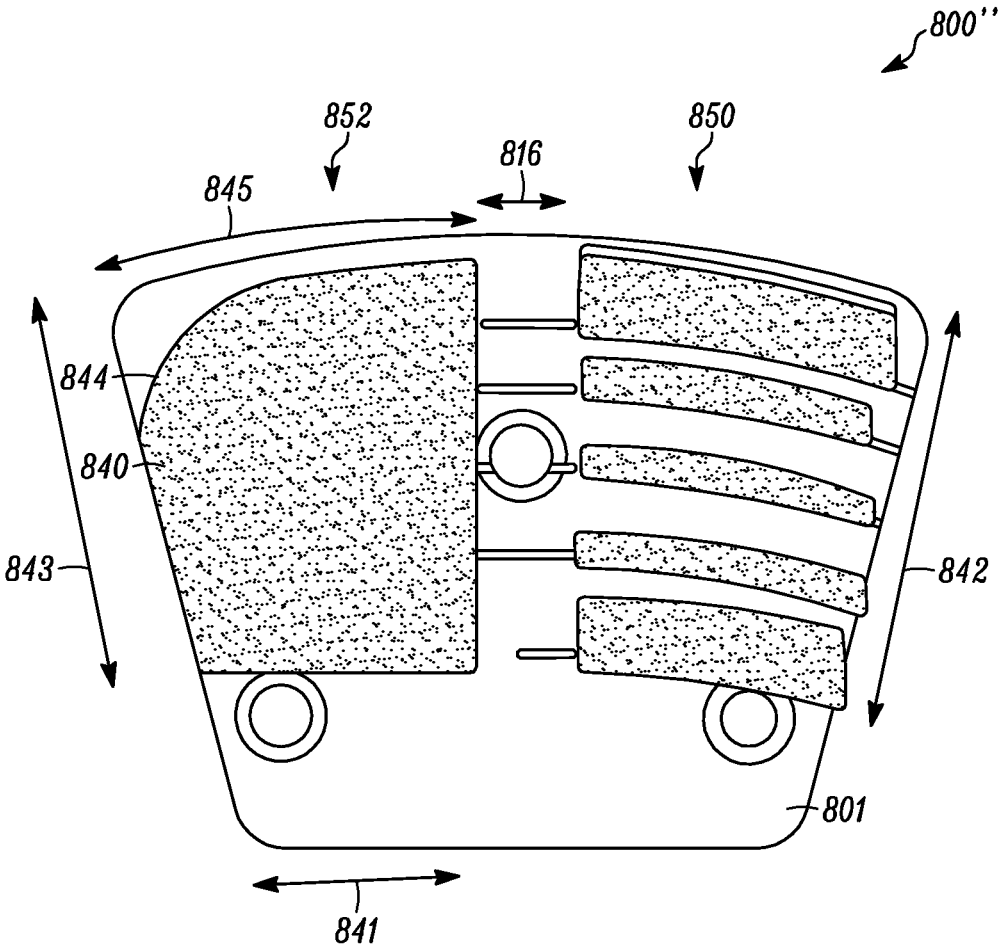
Figure 11:
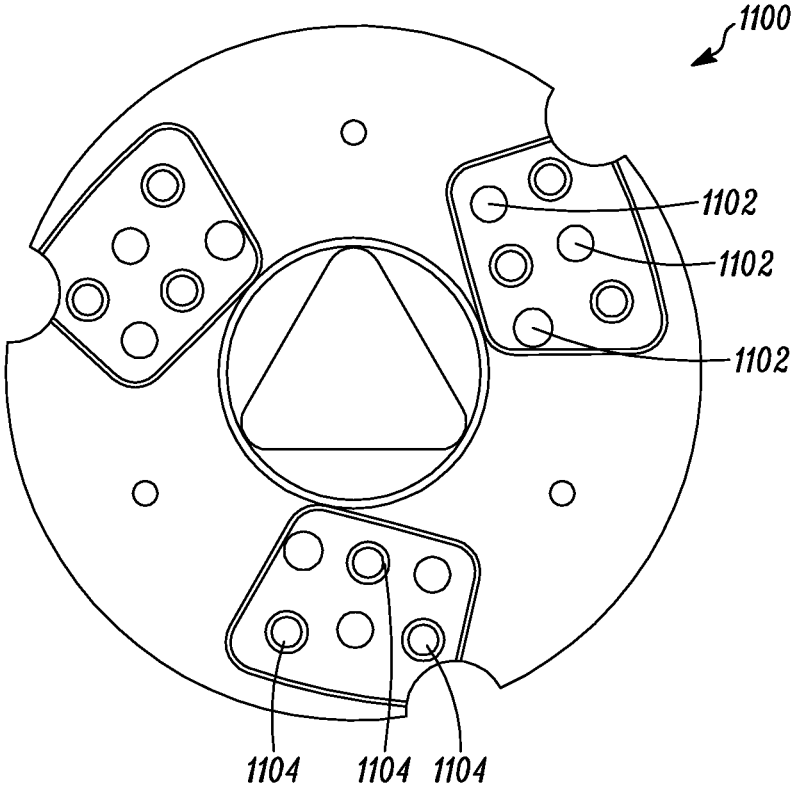
FIG. 11 is an image that illustrates an example of a diamond tooling plate to mount the tooling of FIGS. 8A-8C, according to an embodiment.

FIGS. 8A-8C are images that illustrates an example of a front view of different tooling 800, 800', 800" for a tooling plate, according to an embodiment. In one embodiment, the tooling 800, 800', 800" can be used on the diamond tooling plate 228, 600. In other embodiments, the tooling 800, 800', 800" can be used on the diamond tooling plate 1100 (FIG. 11). For these embodiments, one or more fasteners (e.g. M6×1×14 screws) are passed through one or more holes 818 in the backing plate 801 of the tooling and through corresponding holes of the diamond tooling plate (e.g. 228, 600, 1100) and into a bottom plate (e.g. bottom plate 226 of FIG. 2B). In still other embodiments, the tooling 800, 800', 800" can be secured to one or more magnetic sections (e.g. section 1104 of FIG. 11) of a tooling plate (e.g. tooling plate 1100) by bringing a back surface of the backing plate 801 into close proximity of the magnetic sections of the tooling plate which cause a magnetic force to securely tighten the backing plate 801 against the tooling plate.

In still other embodiments, the tooling 800, 800', 800' can be used on the quick change plate 630 (FIG. 6M) where a respective tooling is positioned in each slot 635. Thus, the tooling 800, 800', 800" can be used in any bolt-on tooling plate or any quick change plate or any tooling plate with magnetic sections, as appreciated by one of ordinary skill in the art. In an example embodiment, each tooling 800, 800', 800" includes a plurality of holes 818 (e.g. three holes) which are aligned with a plurality of corresponding holes 1102 (e.g. three holes with a 0.4375" diameter) in the tooling plate 1100 (FIG. 11) or in corresponding holes (e.g. three holes) in the tooling plate 600 (FIG. 6A). Three fasteners (e.g. M6×1×14 screws) are then passed through the holes 818 of the tooling 800, 800', 800" and the three holes of the tooling plate, to secure the tooling to the tooling plate. The holes of the tooling plate are then aligned with holes in the bottom plate (e.g. bottom plate 226 of FIG. 2B) of the grinding machine and the screws are secured into the holes of the bottom plate, which rotatably fixes the tooling plate to the bottom plate. In an example embodiment, three tooling are secured to each diamond tooling plate 1100 and three diamond tooling plates 1100 are secured to three respective bottom plates of a grinding machine similar to the apparatus 200 (not depicted) where each bottom plate rotates in the same direction. In other embodiments, three diamond tooling plates 1100 are secured to four bottom plates of a grinding machine similar to the apparatus 200 (not depicted) where two bottom plates rotate in one direction and two bottom plates rotate in an opposite direction. However, the tooling 800, 800', 800" can be secured to any tooling plate appreciated by one of ordinary skill in the art that is mounted to a bottom plate of any grinding machine that is appreciated to one of ordinary skill in the art for purposes of removing or grinding stock material from a surface.

FIG. 8A depicts a tooling 800 that includes a backing plate 801 and a plurality of segments 808*a*-808*f*. In an embodiment, the backing plate 801 is made of any metal material or material appreciated by one of ordinary skill in the art. In an embodiment, each segment 808 includes a bond and diamonds. In an example embodiment, the bond comprises a combination of different types of bonds mixed together (e.g. soft bond, hard bond, etc.). In another example embodiment, the diamonds of each segment 808 comprises two or more grit sizes among 16/20, 30/40, 80/100 and 120/150. In one example embodiment, the diamonds of each segment 808 includes each of the grit sizes 16/20, 30/40, 80/100, 120/150. The inventors of the present invention recognized that the inclusion of different types of bonds in the bond and/or different grit sizes in the diamonds of the segments 808 advantageously permit the segment 808 to be used on a wider variety of stock material and/or surfaces than conventional tooling employing a single type of bond and diamond grit size.

In an embodiment, the segments 808*a*-808*f* of the tooling 800 are secured to the backing plate 801 (e.g. brazed) so that some of the segments (808*a*, 808*b*), (808*c*, 808*d*) and (808*e*, 808*f*) are spaced apart in a circumferential direction 802 that is defined by an arc from a first side 827 to a second side 829 of the tooling 800. Although six circumferentially spaced segments 808 are depicted in FIG. 8A, in other embodiments less or more than six circumferentially spaced segments are provided on the backing plate 801. In one embodiment, a spacing 816 between the segments 808 in the circumferential direction 802 defines a radial slot that extends in a radial direction 804 (e.g. orthogonal to the circumferential direction 802) up to the top 824 of the tooling 800. As discussed in the method below, the radial slot defined by the spacing 816 advantageously provides an efficient path for the evacuation of removed and grinded stock material off a surface that the tool 800 is grinding over. This is due to the alignment of the slot defined by the spacing 816 with the centrifugal force (e.g. outer radial) imparted on the loose stock material. In an example embodiment, the spacing 816 is about equal (e.g. within ±10%) for each pair of spaced segments (808*a*, 808*b*), (808*c*, 808*d*), (808*e*, 808*f*). In an example embodiment, the circumferential spacing 816 between the segments 808 in the circumferential direction 802 is about 7.75 millimeters (mm) or in a range from about 6 mm to about 9 mm and/or in a range from about 5 mm to about 10 mm. In another embodiment, a thickness 810 of the segments 808 in the radial direction 804 is about 6.5 mm or in a range from about 5 mm to about 8 mm. In some embodiments, the thickness 810 of the segments 808 is about equal (e.g. within ±10%) for each segment 808 of the tooling 800.

In an embodiment, the segments 808*a*-808*f* of the tooling 800 are secured to the backing plate 801 so that some of the segments (808*a*, 808*c*), (808*b*, 808*d*), (808*c*, 808*e*), (808*d*, 808*f*), (808*e*, 808*g*) and (808*f*, 808*h*) are spaced apart in the radial direction 804 that is orthogonal to the circumferential direction 802. Although FIG. 8A depicts several pairs of segments radially spaced apart, in other embodiments less (e.g. only one) or more than these number of pairs of radially spaced apart segments are provided. In one embodiment, a spacing 814 between the segments 808 in the radial direction 804 is about 7.5 mm or in a range from about 6 mm to about 9 mm. In an embodiment, the spacing 814 forms a circumferential slot between the radially spaced segments and advantageously provides a route to evacuate removed or grinded stock material off a surface over which the tool 800 is grinding (e.g. since the circumferential slot is aligned with the direction 802 of rotation of the tool 800). In some embodiments, the radial spacing 814 is about equal (e.g. within ±10%) for each pair of radially spaced segments. In other embodiment, the radial spacing 814 is not equal for one or more pairs of radially spaced segments. In another embodiment, a length 812 of the segments 808*e*, 800*f*, 808*g*, 808*h* in the circumferential direction 802 is about 24 mm or in a range from about 20 mm to about 28 mm. In another embodiment, a length 812 of the segments 8081, 800*b*, 808*c*, 808*d* in the circumferential direction 802 is about 27 mm or in a range from about 22 mm to about 32 mm.

In an embodiment, the tooling 800 includes a continuous segment or adjacent segments (808*g*, 808*h*) along a bottom 825 (e.g. in a recess 906) of the backing plate 801 between the first side 827 and the second side 829. In an example embodiment, the adjacent segments 808*g*, 808*h* are spaced apart in the circumferential direction 802 by a negligible distance such that they are effectively one continuous segment. In other embodiments, one continuous segment is positioned in the recess 906 along the bottom 825 of the backing plate 801. In an example embodiment, since the backing plate 801 has a trapezoid shape with narrowing width from the top surface 824 to the bottom surface 825, in one embodiment, a width of the bottom surface 825 is narrowed such that the pair of segments 808 (e.g. with length 812) are about equal to a width of the backing plate 801 at the bottom surface 825. In some embodiments, the adjacent segments (808*g*, 808*h*) are excluded.

In an embodiment, a top surface 824 of the backing plate 801 is shaped based on the arc in the circumferential direction 802. In an example embodiment, the top surface 824 has an arc length of about 76 mm or in a range from about 60 mm to about 90 mm. In another embodiment, the backing plate 801 is milled or shaped to define a plurality of recesses 906 (FIG. 9A) which are sized or shaped to securely receive the segments 808*a*-808*f*. In an example embodiment, the segments are welded or brazed within the recesses 906, using techniques appreciated by one skilled in the art. In one embodiment, the recesses 906 are spaced apart in the radial direction 804 and are each oriented in the circumferential direction 802. In an example embodiment, each recess 906 is sized and shaped to receive a pair of segments 808. As depicted in FIG. 8A, in one embodiment, the backing plate 801 takes a trapezoid shape with a narrowing width from the top surface 824 to a bottom surface 825. In other embodiments, the backing plate 801 takes a rectangular shape. In an example embodiment, in order to achieve about equal circumferential spacing 816 between the spaced segments (808*a*, 808*b*), (808*c*, 808*d*), (808*e*, 808*f*), in one embodiment the length 812 of the spaced segments (808*e*, 808*f*) is less than the length 812 of the spaced segments (808*a*, 808*b*), (808*c*, 808*d*). In an example embodiment, the length 812 of the segments 808*e*, 808*f* is about 24 mm and the length 812 of the segments 808*a*, 808*b*, 808*c*, 808*d* is about 27 mm. In an example embodiment, the slightly reduced length 812 of the spaced apart segments (808*e*, 808*f*) advantageously permits the circumferential spacing 816 to remain relatively constant despite the narrowing of the width of the backing plate 801 towards the bottom surface 825.

In an embodiment, the circumferential direction 802 is defined such that upon securing the tooling 800 to a tooling plate (e.g. tooling plate 228, 600), the circumferential direction 802 is aligned with a rotation direction of the tooling plate about a rotation axis of a bottom plate of a grinding machine (e.g. axis 223 of FIG. 2B). In other embodiments, the circumferential direction 802 is defined based on a rotation direction of any tooling plate appreciated by one of ordinary skill in the art to which the tooling 800 is mounted (e.g. tooling plate 1100 of FIG. 11) due to rotation of the bottom plate of a grinding machine that the tooling plate is mounted to during removal of the stock material from the surface.

FIG. 8B depicts a tooling 800' that is similar to the tooling 800 previously discussed with the exception of the features discussed herein. In one embodiment, unlike the tooling 800 that includes a plurality of segments 808 with about equal thickness 810, the tooling 800' includes a plurality of segments (828, 830) where the thickness is not equal in the radial direction 804 among the segments (828, 830). In an embodiment, the segments of the tooling 800' includes outer segments (828*a*, 828*b*) secured to the backing plate 801 adjacent the top surface 824 and outer segments (828*c*,

828*d*) secured to the backing plate 801 adjacent the bottom surface 825, where the outer segments have a thickness 834 (e.g. about 6.5 mm or in a range from about 5 mm to about 8 mm) in the radial direction 804. The segment of the tooling 800' also include inner segments 830*a*-830*f* secured to the backing plate 801 along an interior of the backing plate 801 between the top outer segments (828*a*, 828*b*) and bottom outer segments (828*c*, 828*d*). In an embodiment, a thickness 836 (e.g. about 3.5 mm or in a range from about 2.5 to about 4.5 mm) of the inner segments 830*a*-830*f* in the radial direction 804 is smaller than the thickness 834 of the outer segments in the radial direction. The inventors of the present invention recognized that the reduced thickness 836 of the inner segments advantageously accommodates build-up of certain removed/dislodged stock material (e.g. paint, coating, epoxy, etc.,) in the gap between the inner segments 830, which increases the effectively surface area of the tooling 800' and thus reduces the wear of the tooling 800' over the surface. In one example embodiment, the tooling 800' has increased surface area of segments relative to the tooling 800 and thus imparts less pressure (e.g. pounds per square inch) than the tooling 800. Consequently, the tooling 800' is considered "less aggressive" than the tooling 800, and thus is effective to be used for removing such stock material as paint, coating, epoxy and/or urethane from a surface. In contrast, the tooling 800 is considered "more aggressive" since it imparts more pressure (e.g. pounds per square inch) on the stock material and is most effective to be used for removing such stock material as glue, mastic, coating, thin-set or concrete material. Additionally, the inventor of the present invention recognized that an increased thickness 834 of the outer segments 828 effectively provides a barrier to protect the thinner inner segments 830 from loose debris (e.g. loose change, nails, etc.) on the floor surface from damaging the inner segments 830 as the tooling 800' moves over the floor surface.

In an embodiment, the spacing 832 in the radial direction 804 between adjacent pairs of segments is depicted. In an example embodiment, the spacing 832 between an outer segment and inner segment, such as between segments (828*a*, 830*a*), (828*b*, 830*b*), (828*c*, 830*e*), (828*d*, 830*f*) is about 2 mm or in a range from about 1.5 mm to about 2.5 mm. In another example embodiment the spacing 832 between inner segments, such as between segments (830*a*, 830*c*), (830*c*, 830*e*), (830*b*, 830*d*), (830*d*, 830*f*) is about 3 mm or in a range from about 2.5 mm to about 3.5 mm. In an embodiment, the radial spacing 832 of the tooling 800' is less than the radial spacing 814 of the tooling 800.

In an embodiment, the length 812 of the segments 828*a*, 828*b*, 830*a*, 830*b*, 830*c*, 830*d*, 830*e*, 830 is about equal, such as about 26-27 mm or in a range from about 20 mm to about 30 mm. However, in one example embodiment, the length 812 of the segments 828*c*, 828*d* is less than the length 812 of the other sections and is about 23 mm or in range from about 18 mm to about 28 mm.

In an embodiment, the circumferential spacing 816' of the tooling 800' is different than the circumferential spacing 816 of the tooling 800. In one embodiment, the circumferential spacing 816*a*' adjacent the top surface 824 is greater (e.g. about 11.5 mm or in a range from about 9 mm to about 14 mm) than the circumferential spacing 816*b*' adjacent the bottom surface 825 (e.g. about 8.5 mm or in a range from about 7 mm to about 10 mm). Thus, in one embodiment, the circumferential spacing 816' of the tooling 800' is tapered from the top surface 824 to the bottom surface 825. In another embodiment, the circumferential spacing 816' is non-tapered but is different in value than the circumferential spacing 816 (e.g. larger) of the tooling 800.

FIG. 8C depicts a tooling 800" where the backing plate 801 includes a first region 850 and a second region 852. In an embodiment, the first region 850 includes segments that are similar to the segments (828*b*, 830*b*, 830*d*, 830*f*, 828*d*) of the tooling 800' and secured to the backing plate 801 in a similar manner as those segments are secured to the backing plate 801 in the tooling 800'. Although FIG. 8C depicts that that the first region 850 is on a right side of the tooling 800" and the second region 852 is on a left side of the tooling 800", in another embodiment, the regions could be reversed. In another embodiment, a single segment 840 is secured to the backing plate 801 in the second region 852, where a radial thickness 843 (e.g. about 35 mm or in a range from about 28 mm to about 42 mm) of the single segment 840 is based on a radial height 842 (e.g. about 35 mm or in a range from about 28 mm to about 42 mm) of the segments in the first region 850. In an example embodiment, the single segment 840 has a top width 845 of about 28 mm or in a range from about 22 mm to about 34 mm and/or a bottom width 841 of about 23 mm or in a range from about 18 mm to about 28 mm. In another embodiment, the single segment 840 includes a rounded corner 844 to adapt to the corner of the backing plate 801. In another embodiment, the circumferential spacing 816 is similar to that of the tooling 800. In another embodiment, a length 841 of the single segment 840 in the circumferential direction 802 is about the same as the length 812 of the segment 808. The inventors of the present invention developed the tooling 800" as a further enhancement of the tooling 800' since the single segment 840 increases the overall surface area of the tooling 800" above the surface area of the tooling 800' so that the tooling 800" imparts fewer pressure (e.g. pounds per square inch) than the tooling 800'. In an example embodiment, the tooling 800" is considered "less aggressive" than the tooling 800' and is effective to be used on stock material and/or surfaces that are somewhat aggressive, such as soft concrete. The increased surface area ensures that the tooling 800" does not wear away too fast and the single segment 840 acts as an effective "wear bar". Additionally, after the segments of the tooling 800" in the first region 850 cut into and remove the stock material and/or surface, the single segment 840 acts to smooth out the abrasions or cuts in the stock material and/or surface and thus not only extends the life of the tooling 800" but assists with smoothing cuts in the surface after the segments in the first region 850 remove stock material from the surface.

Figure 9A:
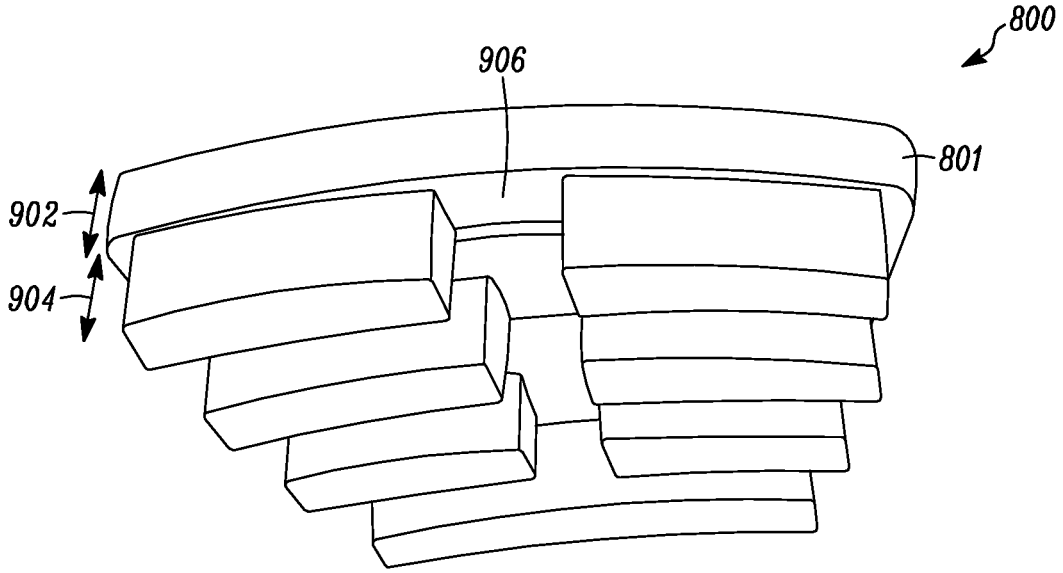
FIGS. 9A-9C are images that illustrates an example of a top perspective view of different tooling for a diamond tooling plate, according to an embodiment.
Figure 9B:
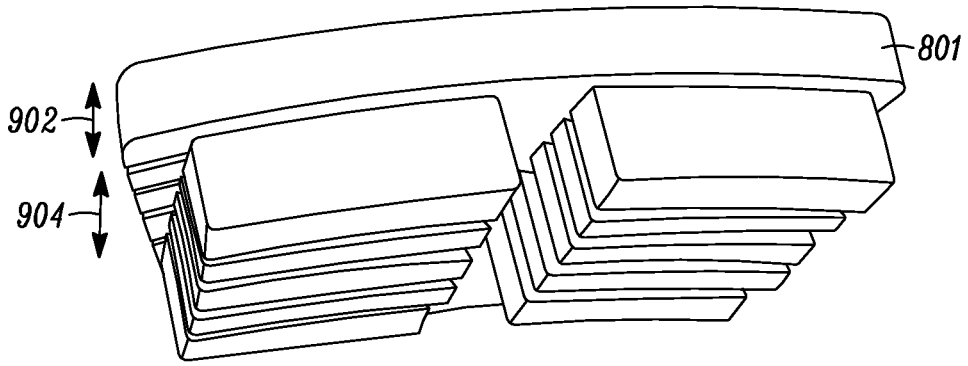
Figure 9C:
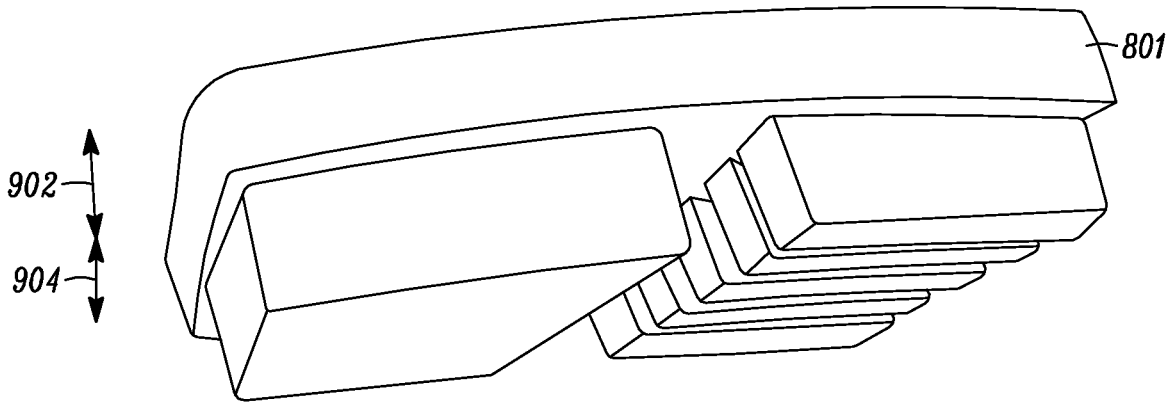
Figure 10:
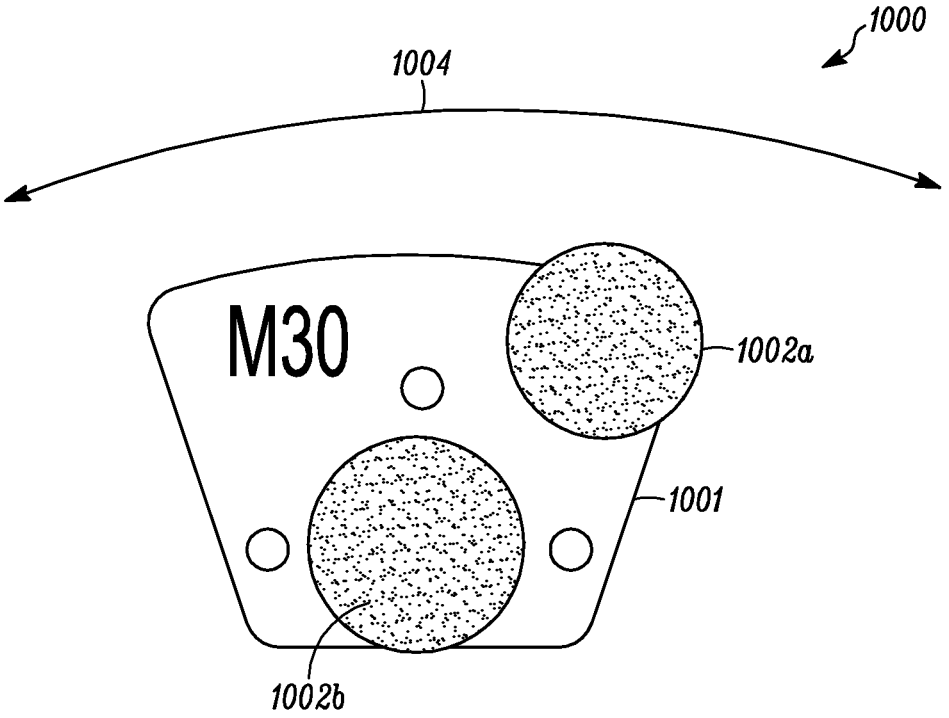
FIG. 10 (PRIOR ART)
FIG. 10 is an image that illustrates an example of a front view of conventional tooling for a diamond tooling plate.

FIGS. 9A-9C are images that illustrates an example of a top perspective view of different tooling 800, 800', 800" for a diamond tooling plate, according to an embodiment. In an embodiment, FIGS. 9A-9C depict that the backing plate 801 has a depth 902 such as about 7 mm or in a range from about 5.5 mm to about 9 mm. In another embodiment, FIGS. 9A-9C depict that the segments of each tooling have depth 904 of about 10 mm or in a range from about 8 mm to about 12 mm.

Figure 13:
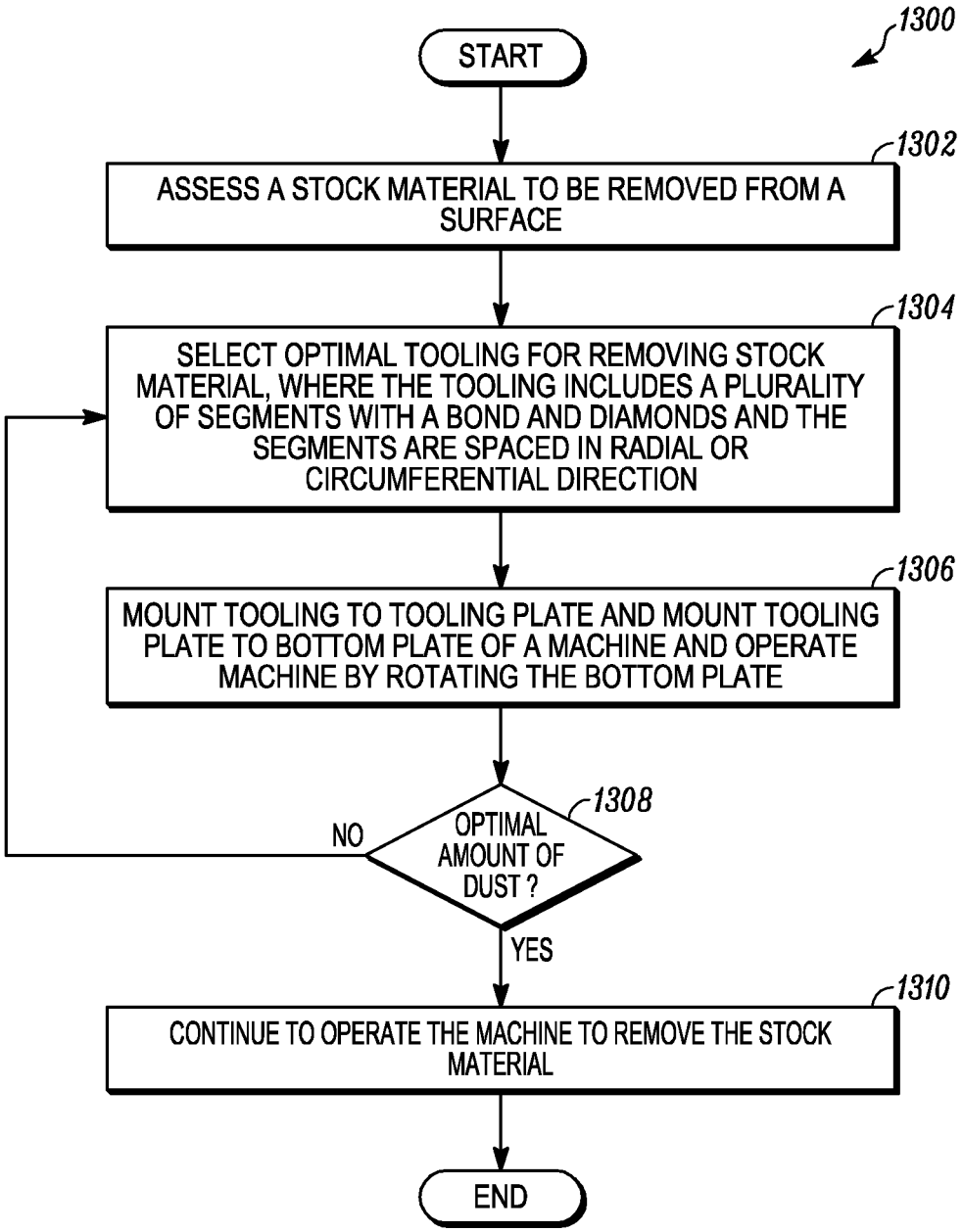
FIG. 13 is a flow diagram that illustrates an example of a method for treating a floor surface, according to an embodiment.

FIG. 13 is a flow diagram that illustrates an example of a method 1300 for treating a floor surface, according to an embodiment. Although steps are depicted in FIG. 13 as integral steps in a particular order for purposes of illustration, in other embodiments, one or more steps, or portions thereof, are performed in a different order, or overlapping in time, in series or in parallel, or are omitted, or one or more additional steps are added, or the method is changed in some combination of ways.

In step 1302, a stock material to be removed from a surface is assessed. In one embodiment, the stock material is on a floor surface. In an example embodiment, in step 1302 the stock material to be removed is identified from one or more of coating, mastic, glue, thin-set, concrete, paint, epoxy, urethane.

In step 1304, an optimal tooling is selected for removing the stock material identified in step 1302. In one example embodiment, the optimal tooling selected in step 1304 is selected from among the tooling 800, 800', 800" based on the identified stock material. In one example embodiment, in step 1304 where the identified stock material is one of glue, mastic or epoxy, the tooling 800 is selected in step 1304. In another example embodiment, in step 1304 where the identified stock material is one of coating, paint, epoxy or urethane, the tooling 800' is selected in step 1304. In yet another example embodiment, in step 1304 where the identified stock material is soft concrete, the tooling 800" is selected in step 1304. However, the selection of the tooling 800, 800', 800" is not limited in step 1304 to these specific stock materials and in step 1304 any of the tooling 800, 800', 800" can be selected in step 1304 based on the identified stock material in step 1302.

In step 1306, the tooling 800, 800', 800" selected in step 1304 is mounted to a tooling plate of a machine that is used to remove stock material from the floor surface. In one example embodiment, the tooling plate is the tooling plate 1100 of FIG. 11 and a plurality of fasteners (e.g. three M6×1×14 screws or bolts) are passed through the holes 818 (e.g. three holes) in each tooling 800, 800', 800" and into corresponding holes 1102 (e.g. three holes) in each tooling plate 1100. In another embodiment, in step 1306 the tooling 800, 800', 800" selected in step 1304 is mounted to the tooling plate (e.g. tooling plate 1100) by securing the back of the backing plate 801 to magnetic sections (e.g. magnetic sections 1104) provided on the tooling plate at each region where the tooling is to be secured to the tooling plate. This is repeated until the tooling plate (e.g. tooling plate 1100) has the number of the tooling (e.g. three in the tooling plate 1100) mounted to the tooling plate. In an example embodiment, the tooling plate is then mounted to a bottom plate of the machine that is used to remove the stock material from the surface (e.g. bottom plate 226 of FIG. 2B). In yet another embodiment, the tooling plate is the quick change plate 630 (FIG. 6M) and in step 1306 the tooling 800, 800', 800" selected in step 1304 is positioned in the slots 635 and secured in the quick change plate 630 as previously discussed and the quick change plate 630 is mounted to the bottom plate of the machine.

In step 1306, after the tooling is mounted to the machine, the machine is operated so that the tooling plate and tooling 800, 800', 800" are rotated in the circumferential direction 802 to remove the stock material from the floor surface.

In step 1308, the user observes whether an amount of dust produced during step 1306 is greater than an optimal amount of dust or is less than an optimal amount of dust. As appreciated by one of skill in the art, when the amount of dust produced in step 1306 exceeds an optimal amount of dust, the tooling determined in step 1304 is too aggressive. In this embodiment, the method moves back to block 1304 and a less aggressive tooling is selected. In an example embodiment, if it is determined in step 1308 that the tooling 800 produces too much dust when removing a stock material (e.g. soft concrete), then it is determined that the tooling 800 is too aggressive for the stock material and thus the method 1300 moves back to step 1304 where the tooling 800' or 800" is selected and steps 1304, 1306, 1308 are repeated.

Also as appreciated by one of skill in the art, in step 1308 when the amount of dust produced in step 1306 is less than an optimal amount of dust, the tooling determined in step 1304 is not aggressive enough. In this embodiment, the method moves back to block 1304 and a more aggressive tooling is selected. In an example embodiment, if it is determined in step 1308 that the tooling 800" does not produce enough dust when removing the stock material (e.g. glue), then it is determined that the tooling 800" is not aggressive enough for the stock material and thus the method 1300 moves back to step 1304 where the tooling 800 is selected and steps 1304, 1306, 1308 are repeated. As appreciate by one skilled in the art, step 1308 ensures that the optimal amount of dust is produced, which in turn ensures that the bond of the tooling 800, 800', 800" wears away at the appropriate rate so to expose the diamonds of the tooling 800', 800', 800" at the appropriate rate.

Figure 12A:
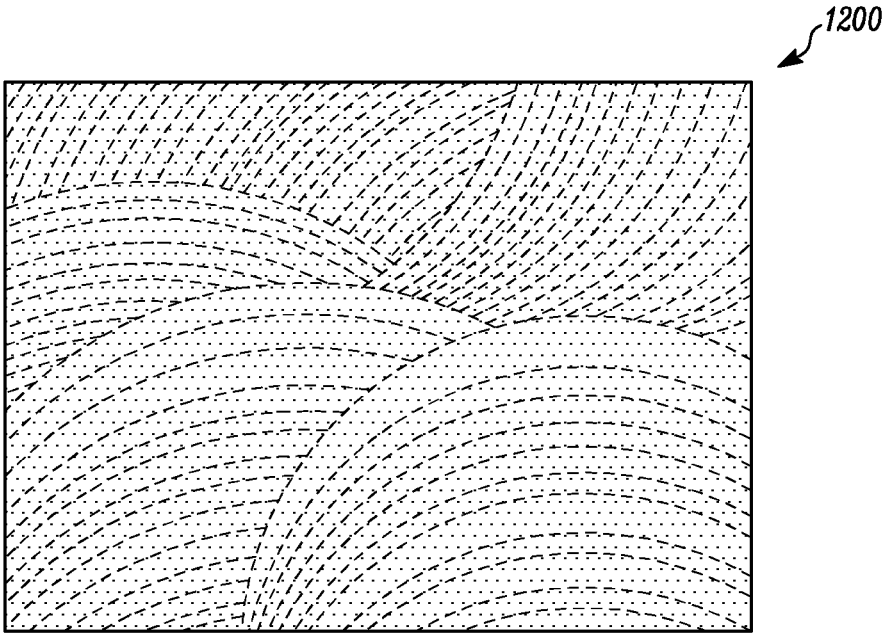
FIG. 12A is an image that illustrates an example of a plan view of a surface finish after treating with the tooling of FIG. 8A, according to an embodiment.
Figure 12B:
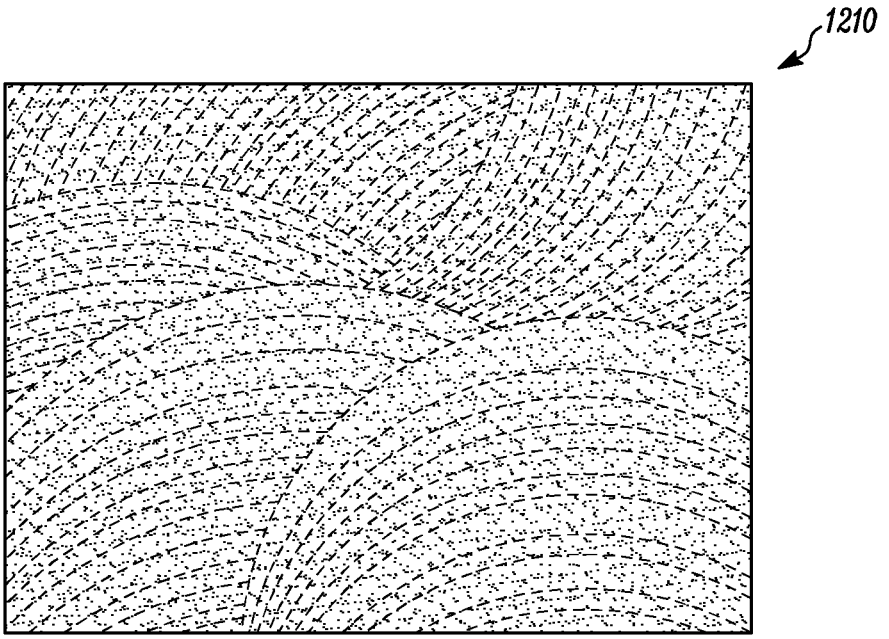
FIG. 12B is an image that illustrates an example of a plan view of a surface finish after treating with the tooling of FIG. 8B, according to an embodiment.
Figure 12C:
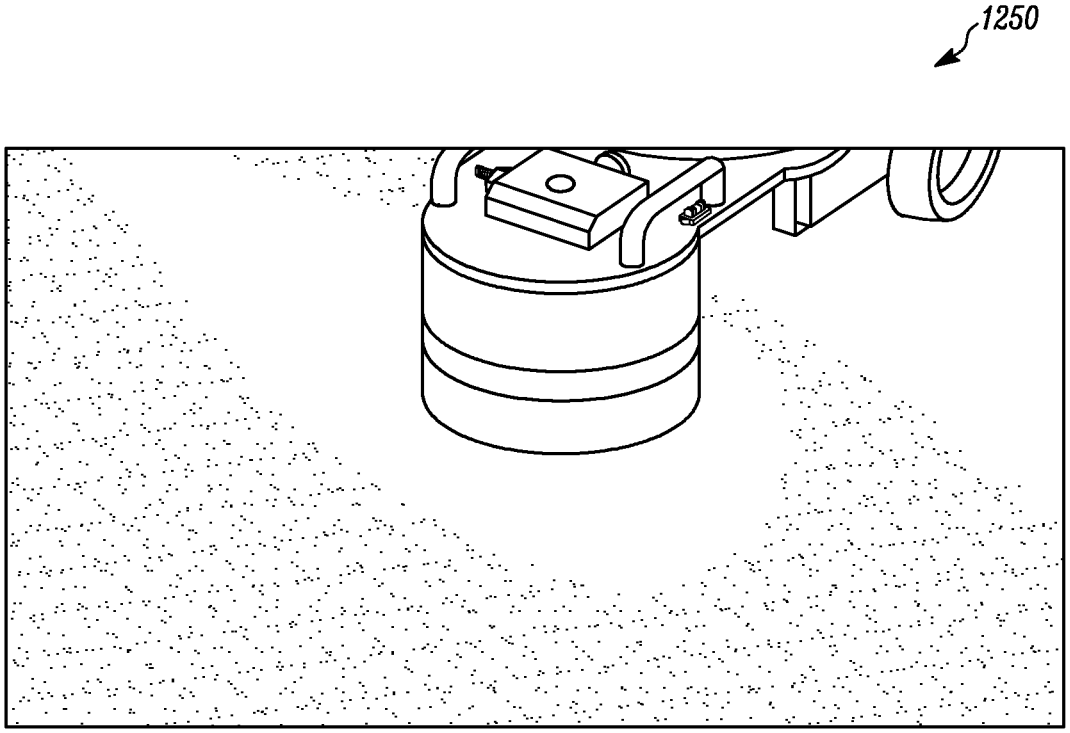
FIG. 12C is an image that illustrates an example of a plan view of a surface finish being treated with the tooling of FIG. 8C, according to an embodiment.

In an embodiment, in step 1308 if an optimal amount of dust is produced, the method 1300 moves to step 1310 where the machine is continued to operate to remove the stock material along the floor surface. In an embodiment, in step 1310 the machine (e.g. apparatus 200) is moved along the floor surface based on the wheels attached to the frame. In other embodiments, in step 1310 the machine is a hand operated tool that moves the tooling plate and tooling over the surface from which stock material is to be removed. In an embodiment, FIG. 12A depicts a finish 1200 of the surface based on use of the tooling 800. In another embodiment, FIG. 12B depicts a finish 1210 of the surface based on use of the tooling 800'. In yet another embodiment, FIG. 12C depicts a finish 1250 of the surface based on use of the tooling 800".

In an example embodiment, in step 1308 where the tool 800 is used, the radial gap (e.g. defined by circumferential spacing 816) between the circumferentially spaced segments 808 advantageously provides a route to evacuate dislodged stock material from the floor surface which has centrifugal forces imparted on the dislodged stock material (e.g. centrifugal forces aligned in radial direction aligned with the radial gap). Additionally, in another embodiment, the longitudinal slot defined by the radial gap 814 between the radially spaced segments 808 advantageously provides a route or path to direct dislodged stock material that is traveling in the circumferential direction 802 of rotation of the tooling 800. In yet another embodiment, the juncture of the circumferential slot and radial slot provides an effective route for dislodged stock material to pass along the circumferential slot (e.g. due to rotation of the tooling) and subsequently enter the radial slot and pass in the outer radial direction (e.g. due to centrifugal forces) past the top surface 824 and out of the tooling 800.

In an embodiment, in step 1308 the use of the tooling 800' advantageously permits dislodged stocked material from the surface to build up in the spacing 832 between the radially spaced segments, due to the small spacing 832. This optimally permits an increased effective surface area of the tooling 800' (e.g. the actual surface area of the segments and the additional surface area of the built up stock material in the spacing 832) and thus reduced pressure on the stock material and floor surface which in turn leads to reduced wear and extended life of the tooling 800'. In another embodiment, in step 1308 the use of the tooling 800" advantageously permits the above discussed advantages of the tooling 800' (e.g. for the first region 850) and an additional advantage of the increased surface area of the single segment 840 which increases the overall surface area of the tooling 800" and thus reduces wear and extends the life of the tooling 800".

In the foregoing specification, the invention has been described with reference to specific embodiments thereof. It will, however, be evident that various modifications and changes may be made thereto without departing from the broader spirit and scope of the invention. The specification and drawings are, accordingly, to be regarded in an illustrative rather than a restrictive sense. Throughout this specification and the claims, unless the context requires otherwise, the word "comprise" and its variations, such as "comprises" and "comprising," will be understood to imply the inclusion of a stated item, element or step or group of items, elements or steps but not the exclusion of any other item, element or step or group of items, elements or steps. Furthermore, the indefinite article "a" or "an" is meant to indicate one or more of the item, element or step modified by the article. As used herein, unless otherwise clear from the context, a value is "about" another value if it is within a factor of two (twice or half) of the other value. While example ranges are given, unless otherwise clear from the context, any contained ranges are also intended in various embodiments. Thus, a range from 0 to 10 includes the range 1 to 4 in some embodiments.

What is claimed is:

1. A tooling for mounting to a tooling plate to remove stock material from a surface based on rotation of the tooling plate about an axis, said tooling comprising:

a backing plate made of metal material;

a plurality of segments, each segment comprising a bond and diamonds;

wherein the plurality of segments are secured to the backing plate such that a spacing is provided between the plurality of segments in a circumferential direction defined by an arc from a first side to a second side of the backing plate and wherein the circumferential direction is further defined such that upon securing the tooling to the tooling plate, the circumferential direction is aligned with a rotation direction of the tooling plate about the axis.

2. The tooling of claim 1, wherein the spacing is also provided between the plurality of segments in a radial direction orthogonal to the circumferential direction, wherein the backing plate has a trapezoidal shape with narrowing width from a top surface to a bottom surface and wherein the backing plate defines at least one of:

the top surface that is shaped based on the arc in the circumferential direction; and a plurality of recesses sized to secure the plurality of segments within the plurality of recesses, wherein the plurality of recesses are spaced apart in the radial direction and are each oriented based on the arc in the circumferential direction.

3. The tooling of claim 1, wherein the spacing is also provided between the plurality of segments in a radiation direction orthogonal to the circumferential direction.

4. The tooling of claim 1, wherein the spacing is also provided between the plurality of segments in a radial direction orthogonal to the circumferential direction and wherein a first spacing provided between a first pair of segments is in the circumferential direction and wherein a second spacing provided between a second pair of segments is in the radial direction.

5. The tooling of claim 4, wherein the plurality of segments comprise a plurality of the first pair of segments with a plurality of the first spacings therebetween and a plurality of the second pair of segments with a plurality of the second spacings therebetween.

6. The tooling of claim 5, wherein the plurality of the first spacings between the plurality of first segments defines a slot in the radial direction that extends to a top of the backing plate.

7. The tooling of claim 5, wherein a thickness of the segments in the radial direction is about equal among the plurality of segments.

8. The tooling of claim 7, further comprising a continuous segment or adjacent segments along a bottom of the backing plate between the first side to the second side.

9. The tooling of claim 5, wherein a thickness of the segments in the radial direction is not equal among the plurality of segments.

10. The tooling of claim 9, wherein a first thickness of an inner segment of the plurality of segments is less than a second thickness of outer segments of the plurality of segments, wherein the outer segments are positioned along a top and a bottom of the backing plate and the inner segment is positioned between the outer segments.

11. The tooling of claim 5, wherein a thickness of the segments in the radial direction is not equal among the plurality of sections in a first region of the backing plate and wherein in a second region of the backing plate adjacent the first region a single segment is provided with a thickness in the radial direction that is based on a radial height of the first region;

wherein a first thickness of an inner segment of the plurality of segments in the first region of the backing plate is less than a second thickness of outer segments of the plurality of segments in the first region, wherein the outer segments are positioned along a top and a bottom of the first region of the backing plate and the inner segment is positioned between the outer segments.

12. The tooling of claim 1, wherein a thickness of the segments in a radial direction orthogonal to the circumferential direction is not equal among the plurality of sections in a first region of the backing plate and wherein in a second region of the backing plate adjacent the first region a single segment is provided with a thickness in the radial direction that is based on a radial height of the first region.

13. The tooling of claim 12, wherein the second spacing of the segments in the radial direction of the second tool is less than the second spacing of the segments in the radial direction of the first tool.

14. The tooling of claim 1, wherein at least one of:

the bond of each segment comprises a mixture of bonds, wherein each bond comprises a distinct mixture of minerals and elements comprising cobalt, copper and nickel;

the diamonds of each segment comprises a combination of grit size diamonds comprising 16/20, 30/40, 80/100 and 120/150.

15. The tooling of claim 1, wherein the backing plate defines one or more holes such that one or more fasteners are configured to pass through the one or more holes and through corresponding one or more holes in the tooling plate to secure the backing plate to the tooling plate.

16. The tooling of claim 1, wherein the backing plate is milled or shaped to define a plurality of recesses that are sized or shaped to securely receive the plurality of segments, and wherein the plurality of segments are welded or brazed within the recesses.

17. The tooling of claim 1, wherein the diamonds of each segment comprises diamonds having two or more different grit sizes.

18. The tooling of claim 17, wherein the diamonds of each segment comprises diamonds having two or more grit sizes among 16/20, 30/40, 80/100 and 120/150.

19. An assembly comprising:

the tooling plate of claim 1, wherein the tooling plate is a metal bond diamond tooling plate; and the tooling of claim 1.

20. The assembly of claim 19, wherein the metal bond diamond tooling plate comprises one or more metal bond diamond segments including one or more circumferentially located trapezoidal tooling segments for accepting the tooling and wherein the tooling has a trapezoidal shape.

* * * * *